US009656784B2

(12) United States Patent
Moehlenbrock

(10) Patent No.: US 9,656,784 B2
(45) Date of Patent: May 23, 2017

(54) EASY OPEN AND RECLOSABLE PACKAGE WITH DISCRETE LAMINATE, WITH DIE-CUT, ANCHORED TO SECOND SIDE PANEL

(71) Applicant: Cryovac, Inc., Duncan, SC (US)

(72) Inventor: Andrew W. Moehlenbrock, Simpsonville, SC (US)

(73) Assignee: Cryovac, Inc., Charlotte, NC (US)

( * ) Notice: Subject to any disclaimer, the term of this patent is extended or adjusted under 35 U.S.C. 154(b) by 526 days.

(21) Appl. No.: 14/300,367

(22) Filed: Jun. 10, 2014

(65) Prior Publication Data

US 2014/0286597 A1 Sep. 25, 2014

Related U.S. Application Data

(62) Division of application No. 13/221,082, filed on Aug. 30, 2011, now Pat. No. 8,800,250.
(Continued)

(51) Int. Cl.

| | |
|---|---|
| ***B65D 33/20*** | (2006.01) |
| ***B65B 43/04*** | (2006.01) |
| ***B65B 43/42*** | (2006.01) |
| ***B65B 61/02*** | (2006.01) |
| ***B65B 61/18*** | (2006.01) |
| ***B65B 9/067*** | (2012.01) |
| ***B65B 9/20*** | (2012.01) |
| ***B65D 75/30*** | (2006.01) |

(52) U.S. Cl.
CPC ..... *B65D 33/20* (2013.01); *B65B 9/067* (2013.01); *B65B 9/20* (2013.01); *B65B 43/04* (2013.01); *B65B 43/42* (2013.01); *B65B 61/02* (2013.01); *B65B 61/18* (2013.01); *B65D 75/30* (2013.01); *B31B 2219/9019* (2013.01); *B31B 2219/9029* (2013.01); *B31B 2237/10* (2013.01); *B31B 2237/20* (2013.01); *B31B 2237/406* (2013.01); *B31B 2237/50* (2013.01)

(58) Field of Classification Search
USPC ..... 53/450–452, 128.1, 133.1, 133.3, 133.4, 53/133.5, 133.6, 133.8, 139.2; 493/189, 493/209, 193–196, 198–201, 210, 238, 493/211–213, 374, 379–383
See application file for complete search history.

(56) References Cited

U.S. PATENT DOCUMENTS

| | | | |
|---|---|---|---|
| 2,991,001 | A | 7/1961 | Hughes |
| 3,259,303 | A | 7/1966 | Repko |

(Continued)

FOREIGN PATENT DOCUMENTS

| | | |
|---|---|---|
| EP | 0179624 A2 | 4/1986 |
| IT | 01319964 | 11/2003 |

(Continued)

*Primary Examiner* — Christopher Harmon

(57) ABSTRACT

An easy-open and reclosable package includes a pouch including a discrete laminate including a tape including a base strip coated with a pressure sensitive adhesive, and a panel section having a die cut defining a die cut segment, the panel section adhered by the PSA to the base strip; the panel section anchored to a first side panel; the second surface of the base strip anchored to the inner surface of a second side panel; and a product in the pouch. The die cut segment is so arranged with respect to the pressure sensitive adhesive that when the package is opened, the package can be reclosed by adhering the pressure sensitive adhesive to the first side panel.

6 Claims, 39 Drawing Sheets

Related U.S. Application Data

(60) Provisional application No. 61/443,414, filed on Feb. 16, 2011.

(56) References Cited

U.S. PATENT DOCUMENTS

| | | | |
|---|---|---|---|
| 3,272,424 | A | 9/1966 | Rodkey |
| 3,349,993 | A | 10/1967 | Ells et al. |
| 3,456,867 | A | 7/1969 | Repko |
| 4,260,061 | A | 4/1981 | Jacobs |
| 4,410,130 | A | 10/1983 | Herrington |
| 4,673,601 | A | 6/1987 | Lamping et al. |
| 4,759,643 | A | 7/1988 | Canno |
| 4,785,940 | A | 11/1988 | Wilson |
| 4,913,293 | A | 4/1990 | Sanders |
| 4,934,535 | A | 6/1990 | Muckenfuhs et al. |
| 5,044,772 | A | 9/1991 | Larson |
| 5,205,649 | A | 4/1993 | Fullerton |
| 5,391,136 | A | 2/1995 | Makowka |
| 5,401,533 | A | 3/1995 | Borland |
| 5,658,077 | A | 8/1997 | Hoftman |
| 5,806,984 | A | 9/1998 | Yeager |
| 5,836,697 | A | 11/1998 | Chiesa |
| 5,855,435 | A | 1/1999 | Chiesa |
| 5,882,749 | A | 3/1999 | Jones et al. |
| 5,954,433 | A | 9/1999 | Yeager |
| 6,012,844 | A | 1/2000 | Huseman et al. |
| 6,056,141 | A | 5/2000 | Navarini |
| 6,196,716 | B1 | 3/2001 | Geyer |
| 6,461,044 | B1 | 10/2002 | Anderson |
| 6,502,986 | B1 | 1/2003 | Bensur et al. |
| 6,517,243 | B2 | 2/2003 | Huffer et al. |
| 6,659,645 | B1 | 12/2003 | Schulz |
| 6,969,196 | B2 | 11/2005 | Woodham et al. |
| 7,033,077 | B2 | 4/2006 | Taylor |
| 7,165,888 | B2 | 1/2007 | Rodick |
| 7,406,810 | B2 | 8/2008 | Clune et al. |
| 7,424,796 | B2 | 9/2008 | Shepard et al. |
| 7,681,732 | B2 | 3/2010 | Moehlenbrock et al. |
| 7,722,255 | B2 | 5/2010 | Chiesa |
| 8,091,323 | B2 | 1/2012 | Paterson |
| 2003/0118254 | A1 | 6/2003 | Razeti et al. |
| 2004/0001927 | A1 | 1/2004 | Moran et al. |
| 2004/0013322 | A1 | 1/2004 | Taylor |
| 2006/0062496 | A1 | 3/2006 | Clune et al. |
| 2008/0152264 | A1 | 6/2008 | Pokusa et al. |
| 2009/0266036 | A1 | 10/2009 | Zerfas et al. |
| 2009/0279813 | A1 | 11/2009 | Pokusa et al. |
| 2011/0036741 | A1 | 2/2011 | Moehlenbrock |
| 2011/0038570 | A1 | 2/2011 | Moehlenbrock et al. |
| 2011/0038571 | A1 | 2/2011 | Moehlenbrock |
| 2011/0103718 | A1 | 5/2011 | Bosman |
| 2011/0147383 | A1 | 6/2011 | Soudais et al. |
| 2011/0204056 | A1 | 8/2011 | Veternik et al. |
| 2012/0052161 | A1 | 3/2012 | Woodham |
| 2012/0156415 | A1 | 6/2012 | Willey et al. |

FOREIGN PATENT DOCUMENTS

| | | | |
|---|---|---|---|
| JP | 3161665 | U | 7/2010 |
| WO | 2006005848 | A1 | 1/2006 |
| WO | 2007057060 | A1 | 5/2007 |
| WO | 2008001768 | A1 | 1/2008 |

EASY OPEN AND RECLOSABLE PACKAGE WITH DISCRETE LAMINATE, WITH DIE-CUT, ANCHORED TO SECOND SIDE PANEL

The present application is a divisional application of, and claims the benefit of, U.S. Ser. No. 13/221,082 filed Aug. 30, 2011, which claims the benefit of U.S. Provisional Application No. 61/443,414, filed Feb. 16, 2011, that application incorporated herein by reference in its entirety.

FIELD OF THE INVENTION

This invention relates to an easy-open and reclosable package with a discrete laminate, with a die-cut, anchored to a second side panel, and to methods of making the package.

BACKGROUND OF THE INVENTION

Food and non-food products, including produce, snack foods, cheese and the like have long been packaged in containers such as pouches, bags, or lidded trays or formed webs made from various thermoplastic materials such as polyethylene, polypropylene, or polyester (PET). These containers can be formed from a web or webs of thermoplastic material on packaging equipment, using various packaging processes, at a processing/packaging facility. Such equipment and processes includes horizontal form/fill/seal (HFFS), vertical form/fill/seal (VFFS), thermoforming/lidstock, and continuous horizontal packaging (sometimes referred to as Flow-wrap). In each case, the product is manually or automatically placed in a pouch, bag, formed web, tray, etc., the filled container is optionally vacuumized or gas flushed, and the mouth of the container is hermetically or non-hermetically sealed to close and finish the package.

Opening of the finished package (i.e. opening with the use of tools such as scissors or knives) can provide access to the product by the consumer.

Common in the industry is the use of plastic zipper closures; press-to-close or slide zippers; interlocking closures; reclosable fasteners with interlockable fastener elements; interlocking rib and groove elements having male and female profiles; interlocking alternating hook-shaped closure members, and the like. These terms appear in the patent literature, and to some extent may overlap in meaning. These features provide reclosability, and in some cases may provide an easy-open feature to the package. However, such features are not always easy to open or reclose.

Also relatively common is the use of pressure sensitive adhesive to provide a reclosability feature to a package.

There is need in the marketplace for a package, and methods of packaging that can be used in a manner that requires little or no modification to the packager's packaging equipment, while providing a manually (i.e. by hand, without the need for tools such as scissors or knives) openable and easy to reclose feature, optionally while maintaining hermeticity of the package when made, and without the use of plastic zipper closures; press-to-close or slide zippers; interlocking closures; reclosable fasteners with interlockable fastener elements; interlocking rib and groove elements having male and female profiles; interlocking alternating hook-shaped closure members, and the like.

Some retail packages currently do not offer an easy-open and/or reclosable feature. Examples are some produce bags and snack food bags. In the produce market, there is a need for a cost-effective way to manually open, and repeatably reclose, retail produce bags, e.g. a package made in HFFS, VFFS, thermoforming/lidstock, or continuous horizontal packaging processes.

The present invention relates to a package, and methods of making the package, which package is manually openable, and reclosable, i.e. can be opened and reclosed a number of times, and adapted to package non-food products, as well as food products such as e.g. produce, snack foods, cheese, luncheon meat, sausage, culinary nuts, trail mix, etc., as well as products for the medical industry. The package optionally maintains a hermetic seal until the package is opened.

There is also a need in the marketplace for a discrete laminate that can be anchored to a processor's packaging material of choice to provide easy-open and reclosable functionalities to a package made from that web/laminate combination with only relatively minor modifications to the processor's packaging material, packaging process or equipment.

SUMMARY OF THE INVENTION

Statement of Invention/Embodiments of the Invention

In a first aspect, an easy-open and reclosable package comprises:

- a pouch comprising
  - a first and second side panel each comprising an outer and inner surface, a first and second side edge, and a first and second end, the first and second side panels joined together along their respective first and second side edges with a seal;
  - a first end;
  - a second end defined by the second ends of the first and second side panels respectively; and
  - a discrete laminate having a first and second end, the discrete laminate comprising
    - a tape comprising
      - a base strip comprising a first and second surface, a first and second side edge, and a first and second end, at least one of the first and second surfaces of the base strip comprising a sealant, and
      - a pressure sensitive adhesive coated on at least a first portion of the first surface of the base strip, and
    - a panel section comprising an outer and inner surface, a first and second side edge, a first and second end, and a die cut;
  - wherein
    - the at least first portion of the first surface of the base strip is adhered by the pressure sensitive adhesive to a first part of the inner surface of the panel section, the panel section is anchored to the first side panel, and the second surface of the base strip is anchored to the inner surface of the second side panel,
    - the first end of the panel section is joined to the second side panel,
    - the panel section and the second side panel are joined together along their respective first and second side edges with a seal, and
    - the die cut defines a primary die cut segment, the primary die cut segment so arranged with respect to the base strip that when the package is opened, the package can thereafter be reclosed by adhering the pressure sensitive adhesive to the first side panel; and
  - a product disposed in the pouch.

Optionally, according to various embodiments of the first aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

the first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

a supplemental seal seals the inner surface of the panel section to the first surface of the base strip.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In a second aspect, an easy-open and reclosable package comprises a pouch comprising a folded web comprising an exterior and interior surface, and a first and second edge, a first transverse seal at a first end of the folded web, a second transverse seal at a second end of the folded web, and a longitudinal seal extending along the length of the folded web;

a discrete laminate comprising a tape comprising a base strip comprising a first and second surface, a first and second end, and a first and second side edge, at least one of the first and second surfaces of the base strip comprising a sealant, a pressure sensitive adhesive coated on at least a first portion of the first surface of the base strip, a panel section comprising an outer and inner surface, a first and second side edge, a first and second end, and a die cut;

wherein the at least first portion of the first surface of the base strip is adhered by the pressure sensitive adhesive to a first part of the inner surface of the panel section, the panel section is anchored to the folded web, and the second surface of the base strip is anchored to the interior surface of the folded web; and the die cut defines a primary die cut segment, the primary die cut segment so arranged with respect to the base strip that when the package is opened, the package can thereafter be reclosed by adhering the pressure sensitive adhesive to the folded web;

and a product disposed in the pouch.

Optionally, according to various embodiments of the second aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the interior surface of the folded web.

a second part of the inner surface of the panel section is anchored to the exterior surface of the folded web.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

the primary die cut segment is spaced apart from a first and second side seal respectively.

the primary die cut segment extends laterally across the package from the first side edge to the second side edge of the package.

the primary die cut segment is underlain entirely by at least one of a clear area, or the interior surface of the folded web.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

a supplemental seal seals the inner surface of the panel section to the first surface of the base strip.

In a third aspect, a method of making an easy-open and reclosable package in a horizontal form/fill/seal process comprises providing a lay-flat web comprising a first and second surface;

providing a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, a panel section comprising an outer and inner surface, a first and second side edge, and a die cut, wherein the at least first portion of the first surface of the base strip is adhered by the pressure sensitive adhesive to a first part of the inner surface of the panel section;

advancing the lay-flat web to a forming device to convert the lay-flat web to a folded web;

advancing the discrete laminate such that when the package is made, the discrete laminate is part of the package;

making side seals in the folded web and the discrete laminate;

cutting the folded web and the discrete laminate to produce an open pouch comprising a first and second side panel each comprising an outer and inner surface, a first and second side edge, and a first and second end, the first and second side panels joined together along their respective first and second side edges by a seal, the panel section and second side panel joined along their respective first and second side edges by a seal, a first end of the panel section joined to the second side panel;

putting a product in the open pouch; and sealing a first end of the pouch to close the pouch;

wherein the die cut defines a primary die cut segment, the primary die cut segment so arranged with respect to the base strip that when the package is opened, the package can thereafter be reclosed by adhering the pressure sensitive adhesive to the first side panel;

at any time during the method of making the package, anchoring the panel section to the lay-flat web, the folded web, or the first side panel, and anchoring the second surface of the base strip to the lay-flat web, the interior surface of the folded web, or the inner surface of the second side panel, such that such that when the package is completed, the panel section is anchored to the first side panel, and the second surface of the base strip is anchored to the inner surface of the second side panel; and the web is cut at the side seals during the step of making side seals in the folded web, or before, during or after any subsequent steps.

Optionally, according to various embodiments of the third aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

the first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package is absent a discrete release liner for a PSA layer or coating.

the package can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

a supplemental seal seals the inner surface of the panel section to the first surface of the base strip.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In a fourth aspect, a method of making an easy-open and reclosable package in a horizontal form/fill/seal process comprises providing a lay-flat web comprising a first and second surface;

providing a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, and a panel section comprising an outer and inner surface, a first and second side edge, and a die cut, wherein the at least first portion of the first surface of the base strip is adhered by the pressure sensitive adhesive to a first part of the inner surface of the panel section;

wherein i) the panel section is anchored to the lay-flat web, or ii) the second surface of the base strip is anchored to the lay-flat web;

advancing the lay-flat web with the discrete laminate anchored thereto to a forming device to convert the lay-flat web to a folded web;

making side seals in the folded web and the discrete laminate;

cutting the folded web and the discrete laminate to produce an open pouch comprising a first and second side panel each comprising an outer and inner surface, first and second side edges, and a first and second end, the first and second side panels joined together along their respective first and second side edges by a seal, the panel section and second side panel joined along their respective first and second side edges by a seal;

putting a product in the open pouch;

wherein the die cut defines a primary die cut segment, the primary die cut segment so arranged with respect to the base strip that when the package is opened, the package can thereafter be reclosed by adhering the pressure sensitive adhesive to the first side panel; and wherein the web is cut at the side seals during the step of making side seals in the folded web, or before, during or after any subsequent steps; and completing the anchoring of the discrete laminate to the lay-flat web, folded web, or side panels such that the panel section is anchored to the first side panel, and the second surface of the base strip is anchored to the inner surface of the second side panel, and sealing a first end of the pouch to close the pouch.

Optionally, according to various embodiments of the fourth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package is absent a discrete release liner for a PSA layer or coating.

the package can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

a supplemental seal seals the inner surface of the panel section to the first surface of the base strip.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In a fifth aspect, a method of making an easy-open and reclosable package in a vertical form/fill/seal process comprises providing a lay-flat web comprising a first and second surface;

providing a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, and a panel section comprising an outer and inner surface, a first and second side edge, and a die cut, wherein the at least first portion of the first surface of the base strip is adhered by the pressure sensitive adhesive to a first part of the inner surface of the panel section;

advancing the lay-flat web over a forming device to convert the lay-flat web to a folded web;

advancing the discrete laminate such that when the package is made, the discrete laminate is part of the package;

making a longitudinal seal in the folded web and the discrete laminate;

transversely sealing the folded web and the discrete laminate to produce a first transverse seal to define a first pouch, wherein the first transverse seal is a bottom transverse seal of the first pouch;

putting a product in the first pouch;

advancing the folded web and the discrete laminate, with the first pouch, downward a predetermined distance;

transversely sealing the first pouch to produce a top transverse seal in the first pouch, and a bottom transverse seal in a second pouch, the second pouch disposed above the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges, the panel section and second side panel joined along their respective first and second side edges;

wherein the die cut defines a primary die cut segment, the primary die cut segment so arranged with respect to the base strip that when the package is opened, the package can thereafter be reclosed by adhering the pressure sensitive adhesive to the first side panel; and at any time during the method of making the package, anchoring the panel section to the lay-flat web, the folded web, or the first side panel, and anchoring the second surface of the base strip to the lay-flat web, the interior surface of the folded web, or the inner surface of the second side panel, such that such that when the package is completed, the panel section is anchored to the first side panel, and the second surface of the base strip is anchored to the inner surface of the second side panel.

Optionally, according to various embodiments of the fifth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package is absent a discrete release liner for a PSA layer or coating.

the package can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

a supplemental seal seals the inner surface of the panel section to the first surface of the base strip.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In a sixth aspect, a method of making an easy-open and reclosable package in a vertical form/fill/seal process comprises providing a lay-flat web comprising a first and second surface;

providing a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, and a panel section comprising an outer and inner surface, a first and second side edge, and a die cut, wherein the at least first portion of the first surface of the base strip is adhered by the pressure sensitive adhesive to a first part of the inner surface of the panel section;

wherein i) the panel section is anchored to the lay-flat web, or ii) the second surface of the base strip is anchored to the lay-flat web;

advancing the lay-flat web with the discrete laminate anchored thereto over a forming device to convert the lay-flat web to a folded web;

making a longitudinal seal in the folded web and the discrete laminate;

transversely sealing the folded web and the discrete laminate to produce a first transverse seal to define a first pouch, wherein the first transverse seal is a bottom transverse seal of the first pouch;

putting a product in the first pouch;

advancing the folded web and the discrete laminate, with the first pouch, downward a predetermined distance;

transversely sealing the first pouch to produce a top transverse seal in the first pouch, and a bottom transverse seal in a second pouch, the second pouch disposed above the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges, the panel section and second side panel joined along their respective first and second side edges; and wherein the die cut defines a primary die cut segment, the primary die cut segment so arranged with respect to the base strip that when the package is opened, the package can thereafter be reclosed by adhering the pressure sensitive adhesive to the first side panel;

the web is cut at the side seals during the step of making side seals in the folded web, or before, during or after any subsequent steps; and completing the anchoring of the discrete laminate such that the panel section is anchored to the first side panel, and the second surface of the base strip is anchored to the inner surface of the second side panel.

Optionally, according to various embodiments of the sixth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package is absent a discrete release liner for a PSA layer or coating.

the package can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

a supplemental seal seals the inner surface of the panel section to the first surface of the base strip.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In a seventh aspect, a method of making an easy-open and reclosable package having a formed web comprises providing a formed web having a first and second end, an inner and outer surface, and a product cavity;

providing a product;

providing a lidstock, having a first and second end, comprising a lay-flat web comprising an outer and inner surface, and a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, and a panel section comprising an outer and inner surface, a first and second side edge, and a die cut, wherein the at least first portion of the first surface of the base strip is adhered by the pressure sensitive adhesive to a first part of the inner surface of the panel section;

placing the product in the product cavity;

sealing the inner surface of the lidstock to the formed web; and cutting the lidstock and formed web to make the package, wherein the die cut defines a primary die cut segment, the primary die cut segment so arranged with respect to the base strip that when the package is opened, the package can thereafter be reclosed by adhering the pressure sensitive adhesive to the lidstock;

at any time during the method of making the package, the panel section is anchored to the lay-flat web, and the second surface of the base strip is anchored to the inner surface of the formed web.

Optionally, according to various embodiments of the seventh aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the lay-flat web.

a second part of the inner surface of the panel section is anchored to the outer surface of the lay-flat web.

a second end of the base strip extends beyond a second end of the panel section.

a second end of the panel section extends beyond a second end of the base strip.

a second end of the panel section is co-extensive with a second end of the base strip.

the package is absent any zipper.

the package is absent a discrete release liner for a PSA layer or coating.

the package can be opened with a peel force of from 25 grams/inch to 5 pounds/inch.

a supplemental seal seals the inner surface of the panel section to the first surface of the base strip.

the first side edge of the base strip is disposed between and sealed to the first side edge of the panel section and formed web respectively, and the second side edge of the base strip is disposed between and sealed to the second side edge of the panel section and formed web respectively.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the panel section and formed web respectively, and the second side edge of the base strip is disposed between and sealed to the second side edge of the panel section and formed web respectively.

the primary die cut segment is spaced apart from a first and second side seal respectively.

the primary die cut segment extends laterally across the package from a first side edge to a second side edge of the package.

the primary die cut segment is underlain entirely by at least one of a clear area, or the first surface of the formed web.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In an eighth aspect, a method of making an easy-open and reclosable package having a formed web comprises providing a formed web having a first and second end, an inner and outer surface, and a product cavity;

providing a product;

providing a lidstock comprising a lay-flat web comprising an outer and inner surface, and a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, and a panel section comprising an outer and inner surface, a first and second side edge, and a die cut, wherein the at least first portion of the first surface of the base strip is adhered by the pressure sensitive adhesive to a first part of the inner surface of the panel section;

wherein i) the panel section is anchored to the lay-flat web, or ii) the second surface of the base strip is anchored to the inner surface of the formed web;

placing the product in the product cavity;

sealing the lidstock to the inner surface of the formed web; and cutting the lidstock and formed web to make the package, wherein the primary die cut segment is so arranged with respect to the base strip that when the package is opened, the package can thereafter be reclosed by adhering the pressure sensitive adhesive to the lidstock; and completing the anchoring of the discrete laminate to the lay-flat web and the formed web such that the panel section is anchored to the lay-flat web, and the second surface of the base strip is anchored to the inner surface of the formed web.

Optionally, according to various embodiments of the eighth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the lay-flat web.

a second part of the inner surface of the panel section is anchored to the outer surface of the lay-flat web.

a second end of the base strip extends beyond a second end of the panel section.

a second end of the panel section extends beyond a second end of the base strip.

a second end of the panel section is co-extensive with a second end of the base strip.

the package is absent any zipper.

the package is absent a discrete release liner for a PSA layer or coating.

the package can be opened with a peel force of from 25 grams/inch to 5 pounds/inch.

a supplemental seal seals the inner surface of the panel section to the first surface of the base strip.

the first side edge of the base strip is disposed between and sealed to the first side edge of the panel section and formed web respectively, and the second side edge of the base strip is disposed between and sealed to the second side edge of the panel section and formed web respectively.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

the primary die cut segment is spaced apart from a first and second side seal respectively.

the primary die cut segment extends laterally across the package from a first side edge to a second side edge of the package.

the primary die cut segment is underlain entirely by at least one of a clear area, or the first surface of the formed web.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In a ninth aspect, a method of making an easy-open and reclosable package in a continuous horizontal packaging process comprises providing a lay-flat web comprising a first and second surface;

providing a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, and a panel section comprising an outer and inner surface, a first and second side edge, and a die cut, wherein the at least first portion of the first surface of the base strip is adhered by the pressure sensitive adhesive to a first part of the inner surface of the panel section;

advancing the lay-flat web to a forming device to convert the lay-flat web to a folded web having an inner surface;

advancing the discrete laminate such that when the package is made, the discrete laminate is part of the package;

advancing a product to the forming device such that the folded web and the discrete laminate envelop the product;

making a longitudinal seal in the folded web and the discrete laminate;

transversely sealing the folded web and the discrete laminate, with the product therein, to produce a leading transverse seal to define a first pouch;

advancing the folded web and the discrete laminate, with the leading transverse seal, forward a predetermined distance;

transversely sealing the first pouch to produce a trailing transverse seal in the first pouch, and a leading transverse seal in a second pouch, the second pouch disposed upstream of the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges, the panel section and second side panel joined along their respective first and second side edges; wherein the die cut defines a primary die cut segment, the primary die cut segment so arranged with respect to the base strip that when the package is opened, the package can thereafter be reclosed by adhering the pressure sensitive adhesive to the first side panel; and at any time during the method of making the package, anchoring the panel section to the lay-flat web, the folded web, or the first side panel, and anchoring the second surface of the base strip to the lay-flat web, the interior surface of the folded web, or the inner surface of the second side panel, such that such that when the package is completed, the panel section is anchored to the first side panel, and the second surface of the base strip is anchored to the inner surface of the second side panel.

Optionally, according to various embodiments of the ninth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

a first end of the first panel section, and the first end of the second side panel, are joined together with a fold.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package is absent a discrete release liner for a PSA layer or coating.

the package can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

a supplemental seal seals the inner surface of the panel section to the first surface of the base strip.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In a tenth aspect, a method of making an easy-open and reclosable package in a continuous horizontal packaging process comprises providing a lay-flat web comprising a first and second surface;

providing a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, and a panel section comprising an outer and inner surface, a first and second side edge, and a die cut, wherein the at least first portion of the first surface of the base strip is adhered by the pressure sensitive adhesive to a first part of the inner surface of the panel section;

wherein i) the panel section is anchored to the lay-flat web, or ii) the second surface of the base strip is anchored to the lay-flat web;

advancing the lay-flat web with the discrete laminate anchored thereto to a forming device to convert the lay-flat web to a folded web having an inner surface;

advancing a product to the forming device such that the folded web and the discrete laminate envelope the product;

making a longitudinal seal in the folded web and the discrete laminate;

transversely sealing the folded web and the discrete laminate, with the product therein, to produce a leading transverse seal to define a first pouch;

advancing the folded web and the discrete laminate, with the leading transverse seal, forward a predetermined distance;

transversely sealing the first pouch to produce a trailing transverse seal in the first pouch, and a leading transverse seal in a second pouch, the second pouch disposed upstream of the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges, the panel section and second side panel joined along their respective first and second side edges;

wherein the die cut is disposed in the folded web, the die cut defining a primary die cut segment, the primary die cut segment so arranged with respect to the base strip that when the package is opened, the package can thereafter be reclosed by adhering the pressure sensitive adhesive to the first side panel; and completing the anchoring of the discrete laminate such that the panel section is anchored to the first side panel, and the second surface of the base strip is anchored to the inner surface of the second side panel.

Optionally, according to various embodiments of the tenth aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

a first end of the panel section, and the first end of the second side panel, are joined together with a fold.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the package is absent any zipper.

the package is absent a discrete release liner for a PSA layer or coating.

the package can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the package is absent a discrete thread or tear strip.

the primary die cut segment includes a first portion wherein the die cut extends partially through the panel section, and a second portion wherein the die cut extends entirely through the panel section.

a supplemental seal seals the inner surface of the panel section to the first surface of the base strip.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In an eleventh aspect, a pouch comprises a first and second side panel each comprising an outer and inner surface, a first and second side edge, and a first and second end, the first and second side panels joined together along their respective first and second side edges with a seal;

a first end;

a second end defined by the second ends of the first and second side panels respectively; and a discrete laminate having a first and second end, the discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, and a panel section comprising an outer and inner surface, a first and second side edge, a first and second end, and a die cut;

wherein the at least first portion of the first surface of the base strip is adhered by the pressure sensitive adhesive to a first part of the inner surface of the panel section, the panel section is anchored to the first side panel, and the second surface of the base strip is anchored to the inner surface of the second side panel, the first end of the panel section is joined to the second side panel, the panel section and the second side panel are joined together along their respective first and second side edges with a seal, and the die cut defines a primary die cut segment, the primary die cut segment so arranged with respect to the base strip that when the package is opened, the package can thereafter be reclosed by adhering the pressure sensitive adhesive to the first side panel.

Optionally, according to various embodiments of the eleventh aspect of the invention, taken alone or in any suitable combination of these embodiments:

both the first and second surfaces of the base strip comprise a sealant.

the first surface of the base strip is sealed to the inner surface of the panel section with an easy-open seal.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

the first end of the panel section, and the first end of the second side panel, are joined together with a seal.

the first end of the first panel section, and the first end of the second side panel, are joined together with a fold.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the pouch, and a package made from the pouch, is absent any zipper.

a package made from the pouch can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the pouch, and a package made from the pouch is absent a discrete thread or tear strip.

the primary die cut segment includes a first portion wherein the die cut extends partially through the panel section, and a second portion wherein the die cut extends entirely through the panel section.

a supplemental seal seals the inner surface of the first side panel to the first surface of the base strip.

the first side edge of the base strip is disposed between and sealed to the first side edge of the first and second side panels respectively, and the second side edge of the base strip is disposed between and sealed to the second side edge of the first and second side panels respectively.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

In a twelfth aspect, a method of making a bag with a discrete laminate disposed thereon comprises extruding a thermoplastic tube to make a bag tubing;

providing a discrete laminate comprising a tape comprising a base strip comprising a first and second surface, and a first and second side edge, at least one of the first and second surfaces of the base strip comprising a sealant, and a pressure sensitive adhesive coated on at least a first portion of the first surface of the base strip, and a panel section comprising an outer and inner surface, a first and second side edge, and a die cut, wherein the at least first portion of the first surface of the base strip is adhered by the pressure sensitive adhesive to a first part of the inner surface of the panel section;

slitting the tubing at a longitudinal edge thereof to make a slit bag tubing;

anchoring the discrete laminate to the slit bag tubing; and transversely cutting and sealing the slit bag tubing at predetermined intervals to make a plurality of individual bags each with the discrete laminate disposed thereon, each bag comprising a first and second side panel each comprising an outer and inner surface, first and second side edges, and a first and second end, the first and second side panels joined together along their respective first and second side edges by a seal, a first end defined by the first ends of the first and second side panels respectively, an end fold defined by the second ends of the first and second side panels respectively;

wherein the die cut defines a primary die cut segment, the primary die cut segment so arranged with respect to the base strip that when the bag is sealed to make a package, and the package is then opened, the package can thereafter be reclosed by adhering the pressure sensitive adhesive to the first side panel; and at any time during the method of making the bag, anchoring the panel section to the bag tubing, slit bag tubing, or first side panel; and at any time during the method of making the bag, anchoring the second surface of the base strip to the bag tubing, the slit bag tubing, or the inner surface of the second side panel.

Optionally, according to various embodiments of the twelfth aspect of the invention, taken alone or in any suitable combination of these embodiments:

both the first and second surfaces of the base strip comprise a sealant.

the first surface of the base strip is sealed to the inner surface of the panel section with an easy-open se.

the inner surface of the panel section comprises an easy-open sealant.

the first surface of the base strip comprises an easy-open sealant.

a second part of the outer surface of the panel section is anchored to the inner surface of the first side panel.

a second part of the inner surface of the panel section is anchored to the outer surface of the first side panel.

a first end of the panel section, and the first end of the second side panel, are joined together with a seal.

a first end of the first panel section, and the first end of the second side panel, are joined together with a fold.

the second end of the first side panel, and the second end of the second side panel, are joined together with a seal.

the second end of the first side panel, and the second end of the second side panel, are joined together with a fold.

a second end of the base strip extends beyond a second end of the panel section.

a second end of the panel section extends beyond a second end of the base strip.

a second end of the panel section is co-extensive with a second end of the base strip.

the bag, and a package made from the bag, is absent any zipper.

a package made from the bag can be opened with a peel force of from 25 grams/inch to 5 pounds/inch.

a first portion of the primary die cut segment is underlain by the pressure sensitive adhesive, and a second portion of the primary die cut segment is underlain by a clear area, the primary die cut segment so arranged with respect to the base strip that when the primary die cut segment is displaced or removed, at least a portion of the pressure sensitive adhesive is exposed.

the primary die cut segment is completely underlain by the base strip.

the primary die cut segment is partially underlain by the base strip.

when the package is opened, the base strip is not torn through the entire thickness of the base strip.

the second surface of the base strip is substantially free from PSA.

the bag, and a package made from the bag, is absent a discrete thread or tear strip.

the primary die cut segment includes a first portion wherein the die cut extends partially through the panel section, and a second portion wherein the die cut extends entirely through the panel section.

the first side edge of the base strip is disposed between and sealed to the first side edge of the first and second side panels respectively, and the second side edge of the base strip is disposed between and sealed to the second side edge of the first and second side panels respectively.

the first side edge of the base strip is disposed between and sealed to the first side edge of the panel section and second side panel respectively, and the second side edge of the base strip is disposed between and sealed to the second side edge of the panel section and second side panel respectively.

the primary die cut segment is spaced apart from a first and second side seal respectively.

the primary die cut segment extends laterally across the package from the first side edge to the second side edge of the package.

the primary die cut segment is underlain entirely by at least one of a clear area, or the inner surface of the second side panel.

a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

a supplemental seal seals the inner surface of the panel section to the first surface of the base strip.

BRIEF DESCRIPTION OF THE DRAWINGS

The present invention is illustrated by reference to the following drawing figures, encompassing different views of various embodiments of the invention, wherein.

DEFINITIONS

Figure 1:
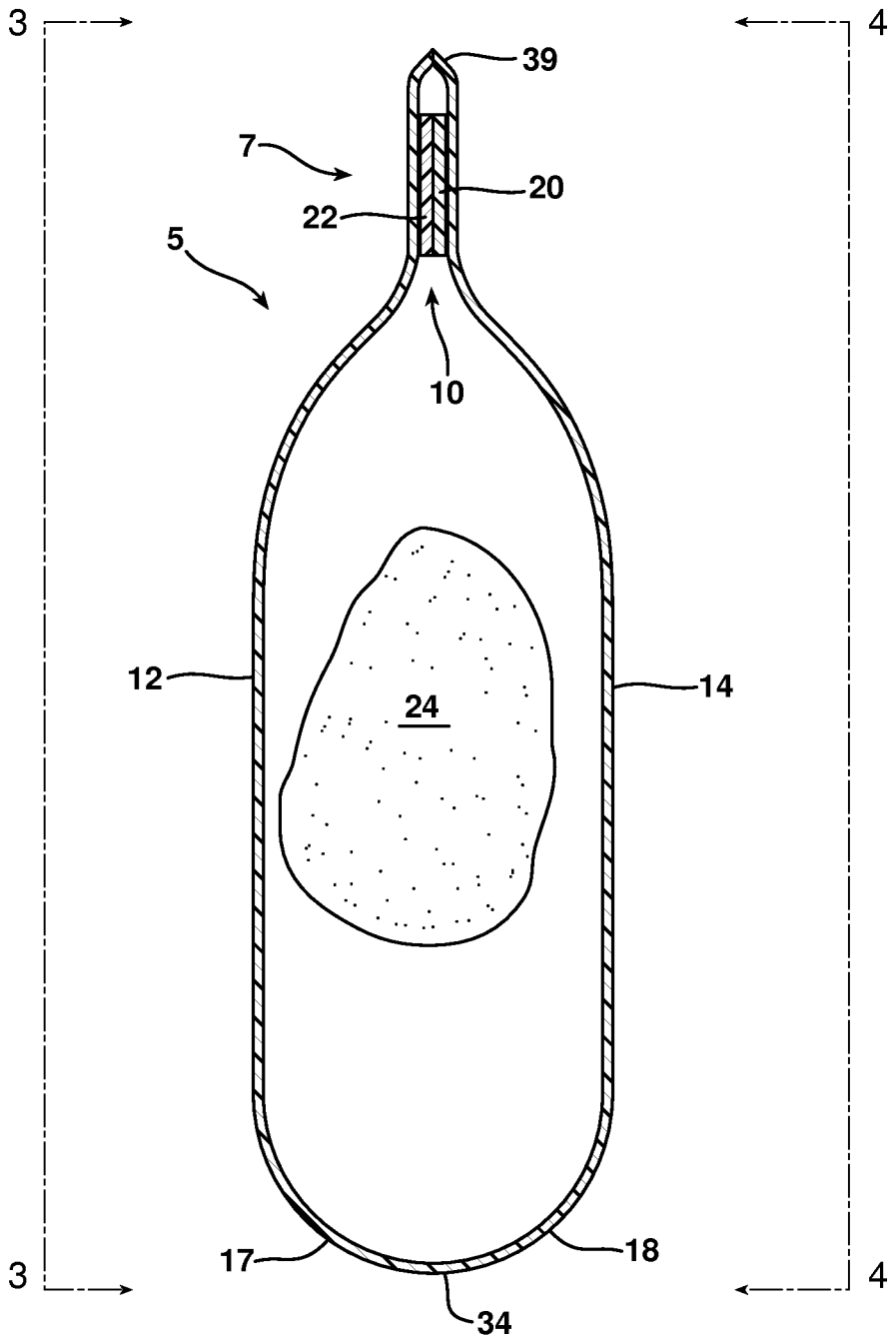
FIG. 1 is an elevational view of a package.

"Anchored", "anchoring" and the like herein refers to sealing or adhering two surfaces together, and refers to the resulting bond between surfaces. Sealing is done by means of a sealant. Adhering is done by means of PSA or permanent adhesive.

In processes described herein where a discrete laminate is anchored to a web or side panel, either during the process wherein the web and discrete laminate are advanced, or when a discrete laminate has been pre-anchored to the web before the start of the process, anchoring can be done by use of any suitable continuous or discontinuous sealing or adhesive material and method. Such anchoring is done to hold the discrete laminate to the web or panel during the relevant packaging process.

In some embodiments, wherein the anchor is already relatively strong or continuous, e.g. a heat seal that constitutes either a relatively strong heat seal, or an easy-open seal as defined herein, the anchor functions not only to hold the discrete laminate to the web or panel during the relevant packaging process, but also as a final seal of that surface of the discrete laminate to the web (lay-flat or folded) or panel made from the web.

Any subsequent disclosed or recited step in the process of sealing one of the surfaces (i.e. the anchored surface) of the discrete laminate to a web or panel, is already completed by the anchoring step. In these embodiments, then, contact of a seal device, e.g. a seal bar in the region of the anchor, in a subsequent step, may add no further or separate seal to that surface of the discrete laminate.

Any subsequent step in the process of sealing the other surface of the discrete laminate to a web or panel, then, may in some embodiments add no further or separate seal to the anchored surface of the discrete laminate.

In some embodiments where the bond is a relatively weak or discontinuous one, e.g. a discontinuous seal, spots or narrow stripes of adhesive. etc., in a subsequent step of sealing one of the surfaces of the discrete laminate to the web or panel, a seal bar that seals one of the surfaces of the discrete laminate to the web or panel can contact the web or panel in the region where the anchor is already disposed. The seal in that region may be either enhanced, or initially created, by the subsequent sealing step.

Sealing of a surface of the discrete laminate to a web or panel, as a process step disclosed or recited herein, should be understood in this light.

"Clear area" herein refers to a selected portion or portions of a first surface of the base strip that has substantially no PSA thereon. The clear area(s) can be provided by 1) not applying PSA to the selected portion(s), or 2) applying the PSA over the entire first surface of the strip, followed by removing most or all of the PSA in the selected portion(s), e.g. by scraping the PSA off the strip by suitable means such as a shim or scraper; removal of most or all of the PSA in this manner will typically be done before the PSA has been cured; or 3) applying the PSA relatively uniformly over the entire first surface of the base strip, as is done in the manufacture of labels, followed by masking or deadening the PSA in the selected portion(s) by any suitable means. Masking or deadening agents that are used will substantially reduce or nullify the adhesive effect of the PSA in the selected portion(s), compared with the adhesive effect of the PSA in portions of the first surface adjacent to the selected portion(s). In general, deadening or masking of the PSA is done after the PSA has been cured; removal of most or all of the PSA is done before the PSA has been cured.

"Closed-loop" herein refers to a die cut that defines a closed pattern or path in the panel section whereby the web material within the path (the die-cut segment) can be removed from the panel.

"Die cut" herein refers to methods of cutting or scoring materials, including rotary die, steel rule die, platen die cutting, and laser cutting or scoring, and/or the resultant cut or score. A die cut can extend entirely or partially through the relevant layer or web, and can leave intact a certain amount of material. "Score" and the like herein refers to a partial die cut that extends partly but not entirely through the thickness of a material, layer, web, panel, panel section, etc, The purpose of the score in the present invention is to provide for controlled tear or separation of material in the act of displacing or removing the die cut segment. The depth of the cut can vary from package to package, and within a single die cut on a given package.

"Die-cut segment" herein refers to a portion of the panel section that can be displaced or completely removed because of the presence of a closed loop or open loop die cut. The die-cut segment is a piece of the panel section, and when displaced or removed can sometimes function as a tamper evidence device, and facilitates access to the interior of the package.

"Discrete" with respect to the discrete laminate is used herein to mean independently made (the discrete laminate is not an integral part of the web when the web is made,) or constituting a separate entity from the web, and from a first or second side panel made from the web.

"Easy-open" herein refers to a package that can be manually opened relatively easily. The physical mode of opening may include any one or more of a) actual peeling at the base strip/web interface (adhesive failure), or b) a sealant layer of the base strip breaking completely through, and peeling then occurring between the sealant layer and an adjacent layer within the strip (delamination failure), or c) breaking within a sealant layer by rupturing of the sealant material itself (cohesive failure), or d) simply peeling of a flap away from the PSA, the flap comprising a piece of the panel section, the piece being a die cut segment as described herein, formed by an open loop die cut, such that the die cut segment is displaced from its original position; or removing a piece of the panel section, the piece being a die cut segment as described herein, formed by a closed-loop die cut. The peel force required to open the package can be measured by an evaluation of seal strength or peel strength in accordance with the test procedure set out in ASTM F88, incorporated herein by reference in its entirety, using a crosshead speed of 8 to 12 inches/minute and an initial jaw gap of from 1.00 inch to 2.00 inch. Typical peel forces for opening the package of the invention can range from e.g. 25 grams/inch to 3 pounds/inch, e.g. from 100 grams/inch to 2 pounds/inch, such as from 200 grams/inch to 1.5 pounds/inch. In some cases, the sealant may actually peel away from the surface to which it is adhered (adhesive failure), or breakage of the sealant and delamination along an adjacent layer interface may occur (delamination failure) or a rupture of the sealant can occur (cohesive failure). Depending on the design and geometry of the seal, peel forces can in some embodiments be higher than 3 pounds/inch, e.g. 3.5, 4.0, 4.5, or 5 pounds/inch, or values intermediate these values. When a die cut segment is displaced or removed from the panel section, such that the PSA is exposed, in some embodiments some part of the scored portion of the die cut segment that remains after the die cutting process, may be torn through in the act of opening the package. The peel force required for this step in the opening process will be within the parameters discussed herein.

"Easy-open seal" herein refers to a seal involving the base strip and web in which materials and sealing conditions are chosen for the base strip and web such that the package is easy-open with a physical mode of opening that includes one or more of adhesive failure, delamination failure, or cohesive failure as described herein.

"Easy-open sealant" herein refers to a material chosen for one or both surfaces of the base strip, such that when such surface is sealed to a web, it provides a package that is easy-open with a physical mode of opening that includes one or more of adhesive failure, delamination failure, or cohesive failure as described herein.

"Ethylene/alpha-olefin copolymer" (EAO) herein refers to copolymers of ethylene with one or more comonomers selected from $C_3$ to $C_{10}$ alpha-olefins such as propene, butene-1, hexene-1, octene-1, etc. EAO includes heterogeneous materials such as linear medium density polyethylene (LMDPE), linear low density polyethylene (LLDPE), and very low and ultra low density polyethylene (VLDPE and ULDPE); single-site catalyzed materials such as homogeneous linear ethylene/alpha olefin copolymers and long chain branched ethylene/alpha olefin copolymers; and multicomponent ethylene/alpha-olefin interpenetrating network resin (or "IPN resin").

"Ethylene homopolymer or copolymer" herein refers to polyethylene (PE) such as ethylene homopolymer such as low density polyethylene (LDPE), medium density polyethylene (MDPE), high density polyethylene (HDPE); ethylene/alpha olefin copolymer such as those defined herein; ethylene/vinyl acetate copolymer (EVA); ethylene/alkyl acrylate copolymer such as ethylene/methyl acrylate copolymer (EMA) or ethylene/ethyl acrylate copolymer (EEA), or ethylene/butyl acrylate copolymer (EBA); ethylene/(meth)acrylic acid copolymer; or ionomer resin (IO).

"Fig." and the like herein refers to a drawing figure; "Figs." and the like herein to drawing figures.

"Film" is used herein to mean a thermoplastic film, laminate, or web, either multi-layer or monolayer, that may be used in connection with the present invention. Film can be of any suitable thickness, e.g. between 0.1 and 30 mils.

"Fin seal" is used herein to mean, in the case of a single web, folding one edge of the web towards the opposite edge of the web, and sealing the facing inner surfaces together. In the case of two webs, a fin seal is a seal formed by sealing the inner surface of the edge of one web to the inner surface of a corresponding edge of another web.

"Lap seal" is used herein to mean a seal made by sealing an inside surface of a web to an outside surface of a web. The inside and outside surfaces can both be on a single web; or the inside surface can be of one web, and the outside surface of a second web.

"Lidstock" herein refers to a film used to cover a container or tray that carries a product, and can be sealed to the tray, typically as a perimeter heat seal. Lidstock typically is supplied to a food processor in a lay flat film rolled onto a roll.

"Longitudinal seal" herein refers to a fin seal or lap seal.

"Near" herein means, with respect to the position of the discrete laminate in relation to the package, that the first end 28 of the base strip of the discrete laminate closest to the first end of the pouch and package will be typically within about three inches of the first end of the pouch. The strip 10 can be closer than this, such as within about two inches, one and one quarter inches, one inch, 0.75 inches, 0.5, 0.4, 0.3, 0.2, or 0.1 inches of the first end of the pouch.

"Olefinic" and the like herein refers to a polymer or copolymer derived at least in part from an olefinic monomer.

"Open-loop" herein refers to a die cut that defines an open pattern or path in the panel section whereby the web material within the path or pattern (the die-cut segment) can be displaced from its original position on the panel section, e.g. by acting as a flap.

"Oxygen barrier" and the like herein refers to materials having an oxygen permeability, of the barrier material, less than 500 $cm^3$ $O_2/m^2$·day·atmosphere (tested at 1 mil thick and at 25° C., 0% RH according to ASTM D3985), such as less than 100, less than 50, less than 25, less than 10, less than 5, and less than 1 $cm^3$ $O_2/m^2$·day·atmosphere. Examples of polymeric materials useful as oxygen barrier materials are ethylene/vinyl alcohol copolymer (EVOH), polyvinylidene dichloride (PVDC), vinylidene chloride/methyl acrylate copolymer, vinylidene chloride/vinyl chloride copolymer, polyamide (nylon), and polyester (PET).

"Polymer" and the like herein means a homopolymer, but also a copolymer thereof, including terpolymer, tetrapolymer, block copolymer, etc.

"Pouch" herein means a pouch or bag.

"Pressure sensitive adhesive" (PSA) herein refers to a repositionable adhesive that bonds firmly with the application of light pressure. It adheres to most surfaces with very slight pressure; is available in solvent and latex or water based forms, and is often based on non-crosslinked rubber adhesives, acrylics, or polyurethanes. PSA forms viscoelastic bonds that are aggressively and permanently tacky; adhere without the need for more than hand pressure; and require no activation by water, solvent, or heat. Some PSA materials are cured by hot air, electron beam, UV, or chemical (peroxide) means. They are available in a wide variety of chemical compositions and systems including acrylic and methacrylate adhesives, emulsion-based acrylic adhesive; rubber-based pressure sensitive adhesive, styrene copolymers (styrene/isoprene/styrene and styrene/butadiene/styrene block copolymers), and silicones. In some embodiments, hot melt adhesives may be useful as well, are included herein for those embodiments as "PSA"; a hot melt adhesive is a thermoplastic adhesive compound, usually solid at room temperature which becomes fluid on heating for use. Suitable commercial examples of PSA include PS-2000™ from Dow, and "acResin®", available from BASF, and comprising a UV-curable polyacrylate that can be applied by conventional hot-melt coaters at temperatures of about 120° C. Suitable tackifiers can be added to acResin® or like compositions to control the tackiness of the adhesive; examples are FORAL® 85 synthetic resin available from Pinova. Tackifiers can be added to the base adhesive composition in any suitable amount, e.g. from 15% to 25% by weight of the total composition of PSA and tackifier, or higher than 25% by weight of the total composition of the PSA and tackifier. In some embodiments, the PSA can be blended with an olefinic additive such as polyethylene, ethylene/methyl acrylate copolymer, or ethylene/vinyl acetate copolymer. These blends can be in any suitable proportions of the PSA and olefinic additive, as long as the easy-open and reclosable functionality of the package is substantially maintained.

"Reclosable" herein refers to a feature or function of a package in accordance with the invention whereby a package can be reclosed by bringing a folded web, panel, or panel section, or portion of a folded web, panel, or panel section into contact with the PSA of the base strip.

"Registration device" herein refers to any mark, pattern, die cut or feature of a web or discrete laminate, that facilitates the advancement of the web or discrete laminate, or a component thereof, in a controlled manner, into a packaging machine, where the web and/or discrete laminate is used to make individual packages. The device can be e.g. printed or placed in uniformly spaced fashion along or near an edge of the web or discrete laminate, i.e. registration marks, or in an area near the middle of a web that does not interfere with decorative printed graphics. These marks are used in connection with appropriate sensors to controllably advance the web or discrete laminate. Where die cuts are used as a registration device, detected by sensors, it may not be necessary to print registration marks on the web or discrete laminate.

"Seal" herein means a bond between two thermoplastic surfaces, e.g. as produced by heat sealing, radio frequency (RF) sealing, ultrasonic sealing, or permanent adhesive, but excluding repositionable adhesive or PSA.

"Sealant" is a polymeric material or blend of materials, such as olefinic polymer or copolymer such as an ethylenic polymer or copolymer, that can form a surface of the base strip or panel section of the invention, or a web to which the base strip or panel section is sealed, and form a bond between two thermoplastic surfaces. A permanent adhesive can also be a sealant. "Sealant" herein, with respect to the base strip or panel section, or a web to which the base strip or panel section is adhered, excludes a repositionable adhesive or PSA.

"Strip" and "panel section" herein refers to an elongate piece of thermoplastic material, typically longer in a first direction than in a direction perpendicular to the first direction, e.g. rectangular; but can also be square, round, oblong, elliptical, or any appropriate shape in plan view. The strip and panel section can be of any suitable thickness, e.g. between 0.1 and 30 mils.

"Tamper evidence", "tampering", and the like herein refers to visual evidence of a breach in a package; i.e. that someone has accidentally or intentionally opened or partially opened the package, or attempted to do so.

"Tape" herein refers to a strip with PSA adhered to at least a portion of a first surface of the strip.

"Thermoplastic" herein includes plastic materials that when heated to a softening or melting point may be reshaped without significant thermal degradation (burning). Thermoplastic includes both materials that are not crosslinked, or that are crosslinked by chemical or radiation means.

"Tray" herein refers to a formed member that has a tray bottom, tray sides, and a tray flange around the upper perimeter of the tray, where the tray bottom and tray sides form an internal cavity within which a product can be placed. The cavity can be enclosed by a lidstock sealed to the tray flange.

"Web" is used herein to mean a thermoplastic film, laminate, or web, either multilayer or monolayer, that may be used in connection with the present invention. The web can be of any suitable thickness, e.g. between 0.1 and 30 mils, and the web can be of any suitable length and width.

"Zipper" and the like herein refers to a plastic zipper closure; press-to-close or slide zipper; interlocking closure; reclosable fastener with interlockable fastener elements; interlocking rib and groove elements having male and female profiles; interlocking alternating hook-shaped closure, and the like.

All compositional percentages used herein are presented on a "by weight" basis, unless designated otherwise.

Drawings herein are not necessarily to scale, and certain features of the invention may be graphically exaggerated for clarity.

DETAILED DESCRIPTION OF THE INVENTION

1. Package

Referring to the drawings, a package 5 according to the invention is shown. Package 5 includes a pouch 7 that can be made from either a single web, or two webs, to form a first side panel 12, and a second side panel 14.

A. Web(s)

In either embodiment, the web or webs comprises a thermoplastic material of any suitable composition, including those having as at least one component olefinic materials such as ethylene or propylene polymers or copolymers, e.g. polyethylene or ethylene/alpha olefin copolymers; polyethylene terephthalate (PET); and including webs typically used in, or useful in, HFFS, VFFS, lidstockltray, continuous horizontal packaging, and bag making apparatus and processes. The web or webs can be monolayer or multilayer in construction, can be coextruded, laminated, or made by any suitable film making process, and can have any suitable thickness.

Examples of web(s) that can be used with a discrete laminate of the invention include H7225B™, a barrier hybrid material used for products requiring a high oxygen barrier, such as shredded cheese; H7525B™, a barrier hybrid material used for products requiring a high oxygen barrier, such as bacon and smoked and processed meat; H7530B, like H7525B but having a thickness of about 3 mils; CP04140™, a low barrier (high OTR) material used in produce packaging, CPM4090, a microwaveable packaging film for fresh cut produce; and T7225B™, a barrier material used as lidstock (non-forming web) for products requiring a high oxygen barrier, such as luncheon meat. These are all commercial products produced by the Cryovac business unit of Sealed Air Corporation.

H7225B™ is a laminate having the construction PET//adhesive//coextruded barrier film, where the PET is a biaxially oriented polyester film, and the barrier film has the construction LOPE (low density polyethylene)/EVA tie/nylon/EVOH+nylon/nylon/EVA tie/EAO. The overall thickness of the laminate of this construction can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7225B™ can be used as a lidstock (non-forming) web.

H7525B™ is a laminate having the construction PET//adhesive//coextruded barrier film, where the PET is a biaxially oriented polyester film, and the barrier film has in one embodiment the construction LDPE (low density polyethylene)/EVA/LLDPE tie/EVOH/LLDPE tie/EVA/EAO. The overall thickness of the laminate of this construction can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7525B™ can be used as a lidstock (non-forming) web.

CP04140™ is a laminate having the construction BOPP//adhesive/monolayer LLDPE film. A typical gauge for the laminate is about 1.8 mils. The LLDPE typically acts as the heat sealant layer of the finished laminate, and in packaging made from the laminate, the LLDPE will form the inner or sealant surface of the package, facing the contained product, and the BOPP will form the outer or skin surface of the package.

CPM4090™ is a laminate having the construction BOPP//adhesive/monolayer LLDPE+LDPE film. A typical gauge for the laminate is about 2 mils. The LLDPE+LDPE layer typically acts as the heat sealant layer of the finished laminate, and in packaging made from the laminate, the LLDPE+LDPE will form the inner or sealant surface of the package, facing the contained product, and the BOPP will form the outer or skin surface of the package.

T7225B™ film has the construction EAO/EAO/LLDPE tie/nylon/EVOH/nylon/EVA tie/EVA tie/nylon. The first layer of EAO typically acts as the heat sealant layer of the film, and in packaging made from the laminate, the EAO will form the inner or sealant surface of the package, facing the contained product, and the nylon of the last layer will form the outer or skin surface of the package. T7225B™ is used as a lidstock (non-forming) web.

Referring to the drawings, the first side panel 12 has a top portion 9, a first side edge 31, a second side edge 33, and a lower portion 17. The second side panel 14 has a top portion 11, a first side edge 35, a second side edge 37, and a lower portion 18. The first and second side panels 12 and 14 are joined together along their respective first and second side edges by either a seal or a fold. As shown, first side edge 31 of first side panel 12 is joined to first side edge 35 of second side panel 14 by a seal 30. Second side edge 33 of first side panel 12 is joined to second side edge 37 of second side panel 14 by a heat seal 32. The second end 34 of the pouch 7 can be either a seal or a fold. Where a single web is used to make the pouch, second end 34 will typically be a fold, although even after the web is folded, a seal such as a heat seal can optionally be installed in the area of the fold. Where two webs of film are used to make panels 12 and 14, second end 34 will be a seal that joins panels 12 and 14 together along their respective lower portions 17 and 18. The two webs can be from the same material, or can be different in composition, structure, etc.

B. Discrete Laminate

Figure 4:
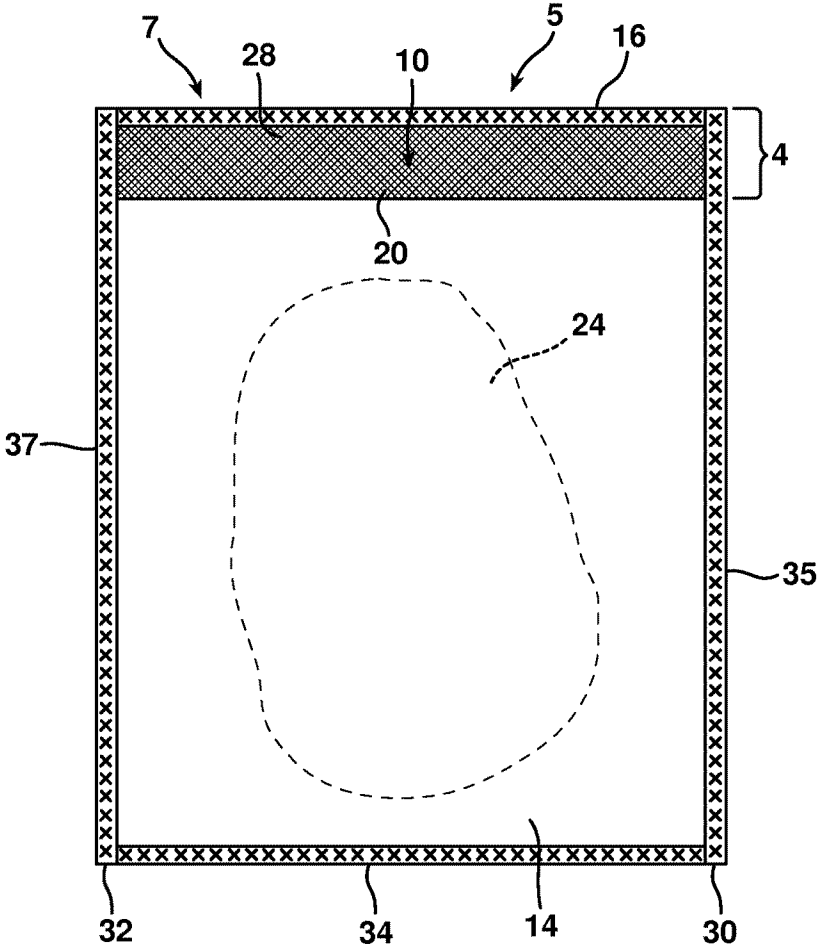
FIG. 4 is a back view of the package of FIG. 1, viewed along lines 4-4 of FIG. 1.
Figure 3:
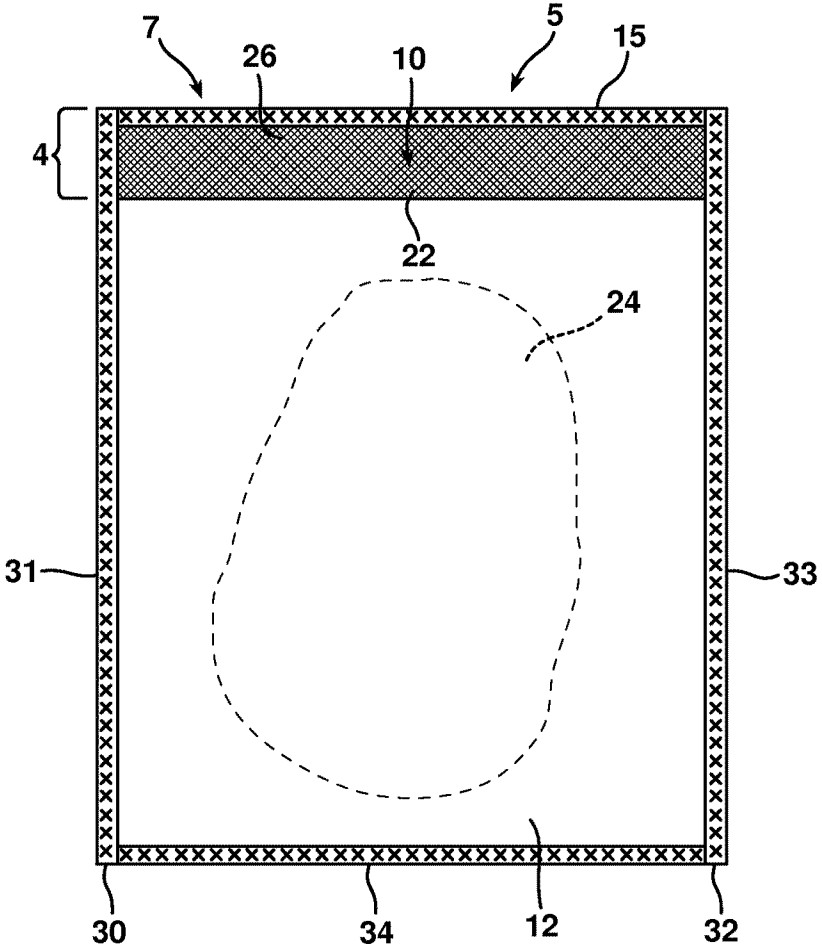
FIG. 3 is a front view of the package of FIG. 1, viewed along lines 3-3 of FIG. 1.

A discrete laminate 4 includes a panel section 6 having an outer surface 66 and inner surface 67, and a tape 8 including a base strip 10 and a PSA layer 19. Base strip 10 is anchored to the inner surface of second panel 14 at sealing zone "A", e.g. with a strong (regular) seal. The laminate, panel section, tape, base strip, and PSA layer can each be of any suitable dimension and shape, and will typically be longer in length than in width, with the length being e.g. greater than two times the width, e.g. greater than 3, 4, or 5 times the width. A typical dimension for the discrete laminate is a width of from about 1 to 1.5 inches and a length of about 4 to 10 inches. The strip 10 will be shorter in one dimension than the pouch and package. For example, the strip can extend across the transverse width of a pouch made in e.g. a HFFS or VFFS process, but will be significantly narrower than the length of the package (see e.g. FIGS. 3 and 4). In one embodiment, the strip will occupy less than 50%, such as less than 40%, less than 30%, less than 20%, or less than 10% of the length of the package.

Base strip 10 comprises a first surface 23 and a second surface 25. In one embodiment, both of these first and second surfaces comprises a sealant. The second surface 25 is anchored to the inner surface 29 of the second side panel 14. The film strip can be of multilayer or monolayer construction.

When a product 24 is placed in the pouch 7, by any suitable process such as processes herein disclosed, and the pouch 7 is closed, the package 5 is made.

In some cases, the strip can be spaced apart from but near an end of the pouch or package. "Near" herein means that the first end 28 of the base strip closest to the first end of the pouch and package will be typically within about three inches of the first end of the pouch. The strip 10 can be closer than this, such as within about two inches, one and one quarter inches, one inch, 0.75 inches, 0.5, 0.4, 0.3, 0.2, or 0.1 inches of the first end of the pouch.

The base strip and the PSA layer can each be of any suitable thickness. The base strip can for example have a thickness of between 2.0 and 5.0 mils, such as between 2.5 and 4.5 mils, between 3.0 and 4.0 mils, or any thicknesses therebetween. Factors such as the composition of the base strip, arrangement of layers within the base strip, and flexural modulus of the materials used may affect the choice of appropriate thickness of the base strip. The PSA can also have any suitable thickness, typically 0.5 mils, e.g. between 0.1 mil and 1 mil, or 0.2 mils and 0.8 mils, etc.

Any suitable web, including any of the hybrid materials of the type described herein for web materials, e.g. H7225B or a non-barrier analog of such material, can be used to make the panel section 6 and base strip 10. In embodiments where no seal is required between surfaces 25 and 29, the seal between surfaces 23 and 27 can be made either before or after the finished package is made.

In some embodiments, the PSA layer covers the entire first outer surface 23 of the base strip. The PSA serves to adhere the base strip to the inner surface 67 of the panel section 6. In accordance with the invention, the PSA layer also provides, after a package has been made, a reclosability function as described further herein.

The panel section 6 is anchored to the first side panel.

In embodiments where the PSA covers the entire first outer surface 23, there is no clear area on the outer surface of the base strip, and to facilitate opening of the package, at least one of the die cuts in the panel section 6 should be disposed outside the portion of the first side panel underlain by the PSA layer 19.

In some embodiments, at least one die cut, or a portion of a die cut, is disposed closer to the first end of a pouch than the first end 28 of the base strip of the tape, i.e. the end of the base strip of the tape closest to the first end of the pouch.

In the embodiments disclosed in the drawings, a second portion of the first outer surface of the base strip is substantially free of pressure sensitive adhesive, and the first portion of the first outer surface of the base strip is closer to the first end of the pouch than the second portion.

The portion of the first surface of the base strip coated with PSA can be at one terminal portion of the strip, either closest to the first end of the package, or furthest from the first end of the package. Alternatively, the first portion can be disposed intermediate from, and spaced apart from, the two longitudinal (with respect to the first and second ends of the package) ends of the strip, such that clear areas of the base strip are present on both sides of the intermediate portion coated with PSA. Thus, the PSA layer can be co-extensive with the first surface of the base strip, or can extend along only one or more terminal or intermediate portions of the strip, and the first surface of the strip can consequently have no clear areas, one clear area, or two or more clear areas.

Panel section 6 is anchored to the first side panel by anchoring a second part of the inner surface 67 of panel section 6 to the outer surface 59 of first side panel 12 (see anchoring region "D" in FIGS. 2A through 2C), or by anchoring a second part of the outer surface 66 of panel section 6 to the inner surface 27 of first side panel 12.

Figure 2:
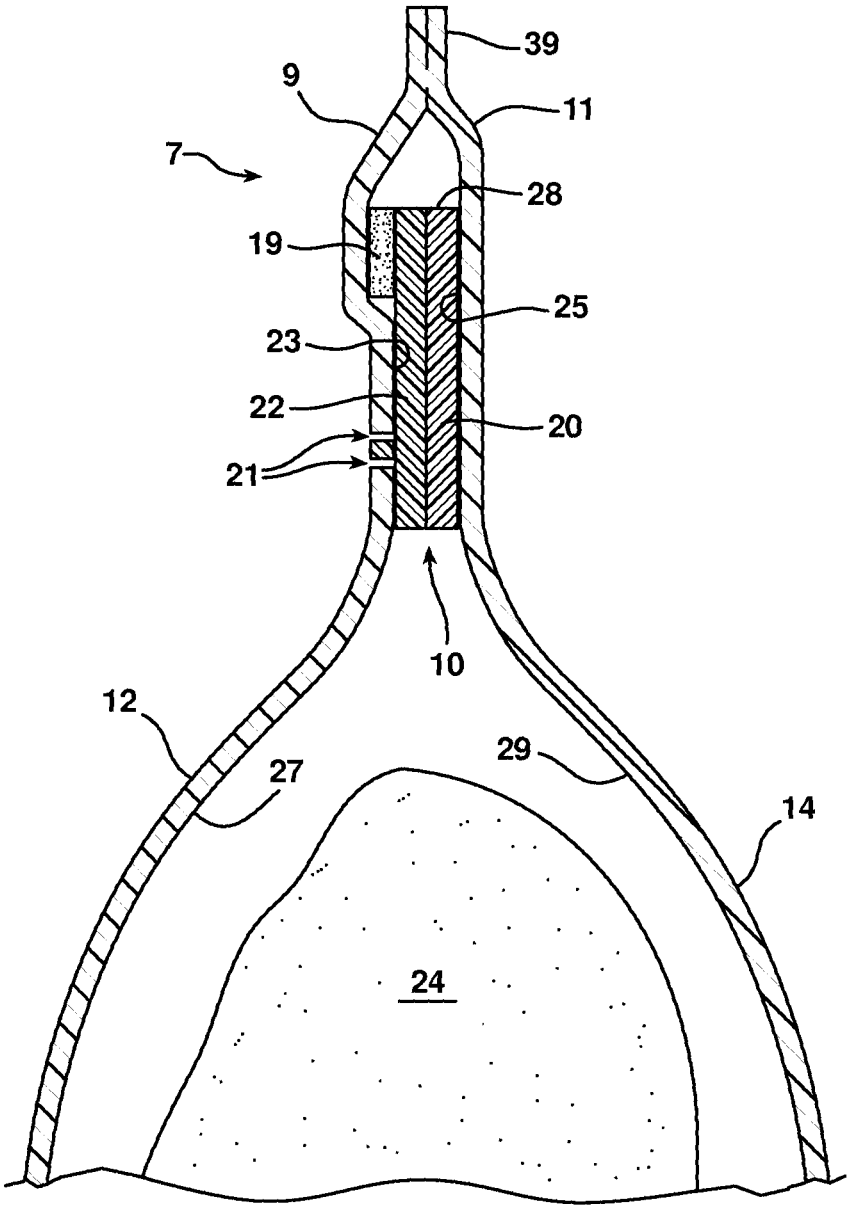
FIG. 2 is an enlarged view of the package of FIG. 1.
Figure 2A:
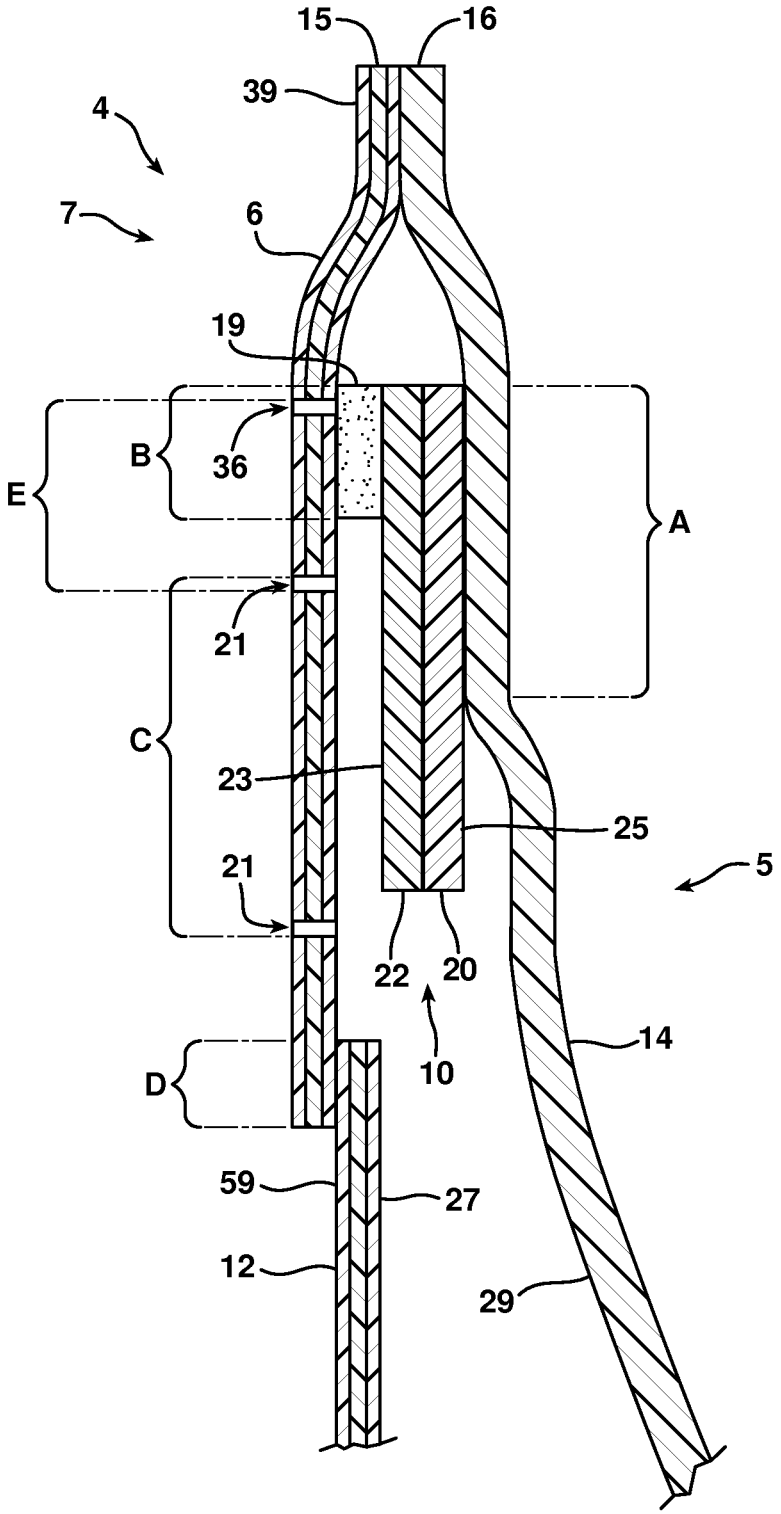
FIG. 2A is an enlarged cross-sectional view of a portion of FIG. 1.

When the appropriate die cut segment is removed or displaced from the package to open the package, the first end of the front of the package effectively becomes the first end of the portion of the panel section that remains after the die cut segment is removed or displaced. To illustrate, in a typical package orientation, shown in elevation view in FIG. 2A, the original first end of the package 5 is the top of the package, defined by top ends 9 and 11 (see FIG. 2) of the panel section and second side panel respectively. When the die cut segment defined by "C" is removed, the top or first end of the front of the package becomes the location of the panel section where the lowest die cut 21 was located (the lower end of "C" in the drawing.) It is a characteristic of the invention that the location of the first end of panel section 6 after opening, which in the embodiment of FIG. 2A is the top of that panel section after opening, is lower, i.e. further from the first end (top) of the package, than the pressure sensitive adhesive 19. Of course, more generally, the first end of the panel section will after opening be typically further from a given end of the package than the pressure sensitive adhesive.

C. Opening Mechanisms and Strip Construction

The package of the invention can be easily manually opened, as described herein. In some embodiments, a supplemental seal, acting as an easy-open seal (see e.g. sealing zone "F" in FIG. 2C) is used to ensure hermeticity of the package before initial opening of the package. Any suitable mechanism or combination of mechanisms for obtaining this functionality and feature can be used according to the invention. The following are examples of such mechanisms.

1. Adhesive Failure

In this embodiment, surface 23 and inner surface 67 each comprises a polymeric composition that, when surface 23 is sealed to surface 67, forms an easy-open seal. This seal provides the interface that breaks apart upon manually opening the package. The interlaminar bonds between layers of the base strip itself (where the strip is of multilayer construction), the cohesive strength of each layer within the strip or of the single layer of a monolayer strip, and the seal that holds surface 25 to inner surface 29, are stronger than the seal that holds surface 23 to surface 67.

In some embodiments, the polymeric composition of surfaces 23 and 67 will be the same or similar. Useful in these embodiments are the peel systems disclosed in U.S. Pat. No. 4,189,519 (Ticknor) (blend of EVA or EMA or EEA with crystalline isotactic polybutylene, and optionally with anhydride grafted EVA); U.S. Pat. No. 4,252,846 (Romesberg et al.) (blend of EVA and HDPE, optionally with IO or polybutylene (PBU)); U.S. Pat. No. 4,550,141 (Hoh) (blend of 10 and polypropylene/ethylene copolymer (EPC)); U.S.

Pat. No. 4,666,778 (Hwo) (three component blend of PE, that can be LLDPE, LOPE, MDPE, or HDPE, or EVA or EMA, with PBU, and PP or EPC); U.S. Pat. No. 4,882,229 (Hwo) (butene-1 polymer or copolymer blended with modified or unmodified LDPE); U.S. Pat. No. 4,916,190 (Hwo) (blend of butylene polymer or copolymer, with PE polymer or copolymer (LLDPE, LDPE, MDPE, EVA, EMA, EEA, EBA, or HOPE), with propylene polymer or copolymer); U.S. Pat. No. 4,937,139 (Genske, et al.) (propylene polymer or copolymer blended with HDPE); U.S. Pat. No. 5,547,752 (Yanidis) (blend of PBU and IO); and U.S. Pat. No. 5,997,968 (Dries et al.)(blend of Component 1 (a copolymer of ethylene and propylene or ethylene and butylene or propylene and butylene or ethylene and another –olefin having 5 to 10 carbon atoms or propylene and another –olefin having 5 to 10 carbon atoms or a terpolymer of ethylene and propylene and butylene or ethylene and propylene and another –olefin having 5 to 10 carbon atoms) and Component 2 (HDPE, MDPE, LDPE, LLDPE or VLDPE); these U.S. patents all incorporated herein by reference in their entirety.

In other embodiments, the composition of surfaces 23 and 67 will differ, i.e. dissimilar sealants are used. Useful in these embodiments are the peel systems disclosed in U.S. Pat. No. 3,655,503 (Stanley et al.) (LOPE or MOPE sealed to polypropylene (PP), EPC, saran, nylon 6, polycarbonate (PC), polyvinyl chloride (PVC), or polyethylene oxide (PEO); PP sealed to saran, nylon 6, PC, PVC, PEO, IO, phenoxy, or EVA; or nylon sealed to 10); U.S. Pat. No. 4,729,476 (Lulham et al.) (a blend of EVA and IO sealed to 10); U.S. Pat. No. 4,784,885 (Carespodi) (PP, HDPE, or LLDPE sealed to substantially linear PE (HOPE, LLDPE) blended with a polyolefinic thermoplastic elastomer such as ethylene propylene diene monomer (EPDM), EPM, butyl rubber, halogenated butyl rubber, isoprene rubber, and styrene butadiene rubber); U.S. Pat. No. 4,859,514 ((Friedrich et al.) (IO or IO blended with EVA, sealed to a blend of EVA and ethylene butene copolymer (EBC) and PP); U.S. Pat. No. 5,023,121 (Pockat, et al.)(a blend of PBU and PP and a third polymeric material selected from EVA, LDPE, LDPE, and IO, sealed to EVA, LDPE, LLDPE, or IO); these U.S. patents all incorporated herein by reference in their entirety.

In some embodiments, surface 23 is not sealed to surface 67, and strip 10 thus remains unattached to panel section 6 in the finished package, except for any side seals in the package that hold the two sides of base strip 10 between the panel section and second side panel, and the adhesion of PSA layer 19 to the inner surface 67 of panel section 6.

2. Delamination Failure

In this embodiment, one of the interlaminar bonds between layers of the base strip itself (where the strip is of multilayer construction) can be broken. Thus, the interlaminar bond provides the interface that will break apart upon manually opening the package. The seal between surfaces 25 and 29, and between surfaces 23 and 67, and the cohesive strength of each layer within the strip, are stronger than the interlaminar bond. Useful in this embodiment are the peel systems disclosed in U.S. Pat. No. 4,944,409 (Busche et al.), this patent incorporated herein by reference in its entirety.

3. Cohesive Failure

In this embodiment, one of the layers of the base strip itself (where the strip is of multilayer construction) or the monolayer base strip, fractures when the package is opened. The seal between surfaces 25 and 29, and between surfaces 23 and 67, and the interlaminar bonds between layers of the strip itself (where the strip is of multilayer construction) are stronger than the layer that fractures. Useful in this embodiment is the peel system disclosed in U.S. Pat. No. 6,476,137 (Longo) (internal rupture of a sealant layer comprising a blend of an ionomer having a melt flow index of less than 5, and a modified ethylene/vinyl acetate copolymer having a substantially higher melt flow index, where the melt flow indices of the two polymers in the seal layer differ by at least 10), this patent incorporated herein by reference in its entirety.

Other peel systems useful in connection with the present invention are those disclosed in U.S. Pat. No. 4,058,632 (Evans et al.), U.S. Pat. No. 4,615,926 (Hsu et al.); U.S. Pat. No. 5,128,414 (Hwo); U.S. Pat. No. 6,395,321 (Schaft et al.), U.S. Pat. No. 7,055,683 (Bourque et al.), and US Patent Publication Nos. 20030152669 (Vadhar et al.) and 2008/0260305 (Shah et al.) (disclosing as easy-open sealant), DuPont APPEEL™ resins, such as those based on EVA, modified EVA, EAA, or modified EAA; polyethylenes such as LOPE and/or EVA blended with PP; LDPE or EVA blended with polybutene-1, or random propylene/ethylene copolymer blended with polybutene-1; EVA or LDPE blended with PP; LDPE blended with EVA and PP; such blends provide an easy-open sealant when adhered to polyethylene sealants); these U.S. patents and publications all incorporated herein by reference in their entirety.

4. Failure Involving PSA

In some embodiments, a package can be made where no easy-open seal and no easy-open sealant is present, and easy-open functionality is provided in the package by the PSA. Opening can involve e.g. the PSA preferentially adhering to one of two surfaces, as the two surfaces are pulled apart; or adhering to both of two surfaces as the two surfaces are pulled apart. These embodiments are used in combination with displacing or removing the die cut segment from the front panel. A first portion of the die cut segment is underlain by a clear area, and a second portion of the die cut segment is underlain by pressure sensitive adhesive. The die cut segment is so arranged with respect to the base strip that when the die cut segment is displaced or removed from the first side panel, at least a portion of the pressure sensitive adhesive, and in some embodiments at least a portion of the base strip is exposed, i.e. is visible to the viewer facing the first side panel. By grasping the first end of the panel section remaining after removing the die cut segment, and pulling towards the user, the package contents can be accessed. The package can thereafter be reclosed by adhering the pressure sensitive adhesive to the first side panel.

The supplemental seal reduces the possibility that, if the pressure sensitive adhesive becomes partially unadhered, oxygen from outside the package can enter the package. If the supplemental seal is positioned as shown in the embodiment of FIG. 2C, sealing region "F", i.e. between the interior of the package and the PSA, this arrangement also helps keep the adhesive from being contaminated by the package contents. This supplemental seal is an easy-open seal. The supplemental seal can be located in the area of the base strip between the pressure sensitive adhesive and the second end of the base strip, or can be located in the area of the pressure sensitive adhesive itself. FIG. 2C shows an area between the first and second end of the base strip not coated with a pressure sensitive adhesive, and within which the supplemental seal can be made.

In some embodiments, the first and second portion of the die cut segment will correspond to a first portion of the die cut segment having a score, and a second portion of the die cut having a through cut; and will also correspond to a first portion of the underlying base strip coated with a pressure sensitive adhesive, and a second portion of the underlying base strip with a clear area. However, those skilled in the art will appreciate, after a review of this disclosure, that some variation is possible in this arrangement, such that e.g. a first portion of the die cut segment may comprise to some extent a through cut, and a second portion of the die cut may comprise to some extent a score, in particular if both portions of the die cut segment are shadowed by the base strip. If the first portion of the die cut segment is closer to the first end of the package than the first end of the base strip, i.e. is not shadowed by the base strip, such an arrangement may suffice provided hermeticity of the package is not required. Likewise, some clear areas may be present in the first portion of the base strip (such as an area to accommodate the supplemental seal), provided the easy-open and reclosable functionality of the package is substantially maintained.

In some embodiments, in particular those in which a hermetic package is desired, the portion of the die cut or die cuts that is cut all the way through the first side panel is bracketed or surrounded collectively by the top seal of the package, the side seals of the package, and the supplemental seal. In some embodiments, the PSA itself can also function as a component in ensuring a hermetic package. However, because of the possibility of unintended premature release of part of the PSA from contact with the inner surface of the panel section, this feature can not always be relied on to ensure hermeticity.

In an alternate embodiment, two die cut segments may be present in the first side panel. The primary die cut segment can be removed or displaced to open the package and access the contents of the package. The secondary die cut segment is in one embodiment at least partially underlain by the PSA, but the first die cut segment is in one embodiment not underlain by the PSA. Thus, in initially opening the package, the PSA is not exposed. In other embodiments, the primary die cut segment may be partially underlain by PSA, such that in initially opening the package, the PSA is exposed to a limited extent. In either embodiment, when it is desired to reclose the package, the secondary die cut segment is removed or displaced, the underlying PSA 19 is exposed, and the package is folded over to bring the PSA into contact with the outer surface of the first side panel 12 and close the package.

The secondary die cut segment is in one embodiment defined by a closed loop die cut, and the secondary die cut segment is removed so that the underlying PSA 19 is exposed, and the package is folded over to bring the PSA into contact with the outer surface of the first side panel 12 and close the package. It will be appreciated that thereafter, subsequent removal of package contents can potentially come in contact with and contaminate the now exposed PSA. Thus in an alternative embodiment, the secondary die cut segment is defined by an open loop die cut. This results in a flap that is displaced but not completely removed when exposing the PSA. The flap can be held back while reclosing the package. When it is desired to reaccess the contents of the package, the package can be reopened, and the flap can be placed over the PSA to recover the PSA before package contents are withdrawn from the package. Depending on the placement and configuration of the secondary die cut segment, nature of the materials, etc. the flap may exhibit a tendency to close over the PSA, aiding this step. This protects the PSA from contamination by the package contents.

Strip Construction

The base strip 10 can have any suitable number of layers. In FIGS. 1 and 2, a strip 10 has two layers. Layer 22 comprises a polymeric composition that in one embodiment provides an easy-open seal when sealed at surface 23 to inner surface 67. Layer 20 comprises a polymeric composition that exhibits a relatively strong seal when sealed at surface 25 to inner surface 29.

Figure 5:
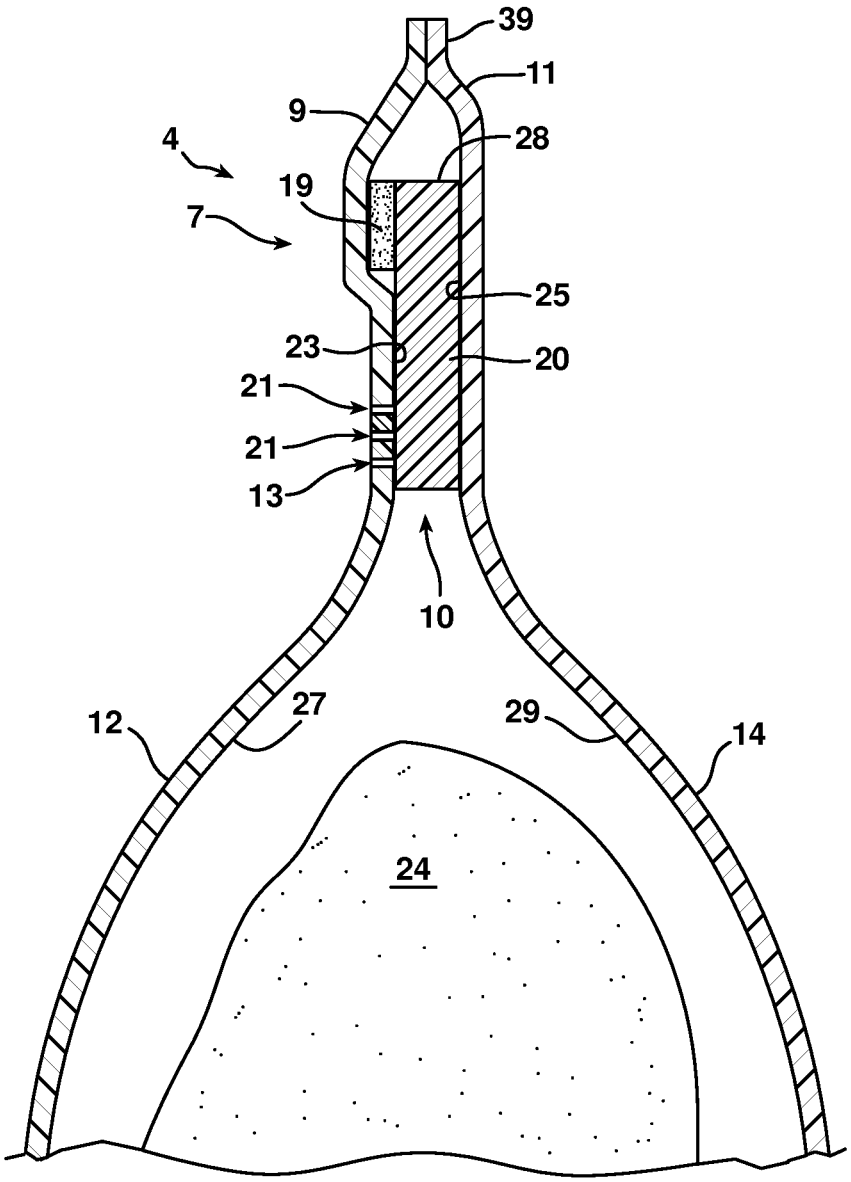
FIG. 5 an enlarged view of a portion of the package of FIG. 1 according to another embodiment.

Alternatively, (FIG. 5), base strip 10 is of monolayer construction. Layer 20 comprises a polymeric composition and includes first outer surface 23 and second outer surface 25 that can be like those disclosed herein for a multilayer base strip.

In any of these alternatives, the surface of the strip facing inner surface 67 in some embodiments is not sealed to inner surface 27 except at any side seals of the package.

Referring to FIG. 2A, panel section 6 includes at least one die cut 21. Strip 10 is adhered to a portion of the inner surface 67 of panel section 6, with a PSA, at adhesive region "B". During manufacture of the package, the second surface of the strip is sealed to a portion of the inner surface 29 with a relatively strong heat seal, at anchor region "A". A portion of die cut region "C" of the first side panel is underlain by a portion of the strip that is neither sealed, nor adhered by PSA, to inner surface 67. The seal at anchor region "A" can alternatively be made at a suitable location on a lay-flat web to be made later into a package of the invention.

Figure 6:
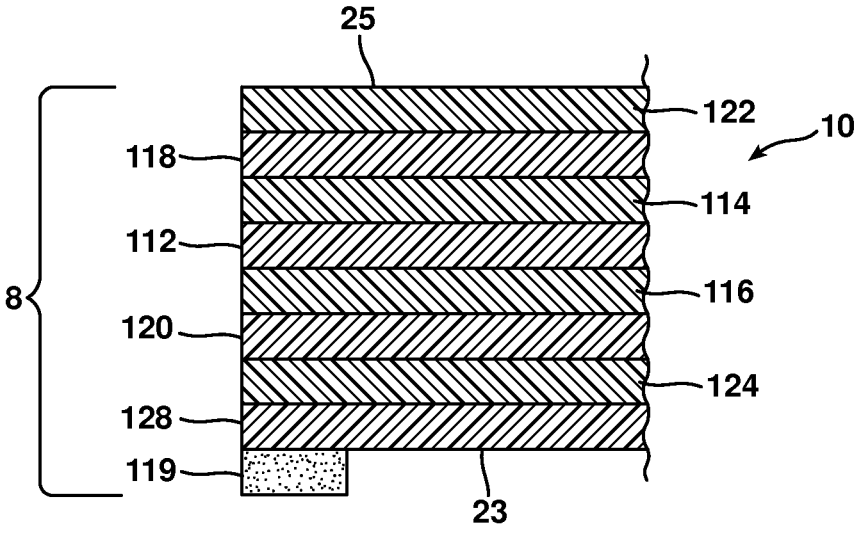
FIG. 6 is a cross-sectional view of a tape.

A representative film structure "A1" suitable for use as the base strip 10 according to the invention is shown in FIG. 6. In one embodiment, this film has the composition shown in Table 1.

TABLE 1

(Example 1)

| Layer | Composition | Gauge (thickness %) | Gauge (mils) | Gauge (μm) |
|---|---|---|---|---|
| 122 | EZ1 | 25.00 | 0.50 | 12.7 |
| 118 | AD1 | 7.50 | 0.15 | 3.8 |
| 114 | 80% NY1 + 20% NY2 | 7.50 | 0.15 | 3.8 |
| 112 | OB1 | 10.0 | 0.20 | 5.1 |
| 116 | 80% NY1 + 20% NY2 | 7.50 | 0.15 | 3.8 |
| 120 | AD1 | 7.50 | 0.15 | 3.8 |
| 124 | 65% AD2 + 35% PE1 | 17.50 | 0.35 | 8.9 |
| 128 | PE1 | 17.50 | 0.35 | 8.9 |

This example of a material suitable as the base strip 10 is a barrier film with an easy-open sealant, and is currently used as a barrier/easy-open component of various laminated materials that also include a polyester film component, sold commercially by the Cryovac business unit of Sealed Air Corporation, under designations including H52XXBZ, and H72XXBZ. These are sold as primary packaging materials, i.e. webs that form the main body of the package, not as discrete laminates to be used in combination with a primary web.

When used according to the invention, the easy-open sealant layer 122 of A1 exhibits a peel force of typically about 2 pounds/inch (ASTM F88). Layer 128 of A1 yields a peel force of typically 8 pounds/inch.

The resins disclosed in Table 1, and other resins referred to elsewhere in the present application, are identified in Table 2.

TABLE 2

| Material Code | Tradename Or Designation | Source(s) |
|---|---|---|
| AB1 | 10853 ™ | Ampacet |
| AD1 | PLEXAR ™PX1007 ™ | Equistar |
| AD2 | BYNEL ™39E660 ™ | DuPont |
| AD3 | PLEXAR ™PX3236 ™ | LyondellBasell |
| EM1 | LOTADER ™ 4503 ™ | Arkema |
| EV1 | ESCORENE ™ LD318.92 ™ | ExxonMobil |
| EZ1 | APPEEL ™72D727 | DuPont |
| NY1 | ULTRAMID ™ B33 01 | BASF |
| NY2 | GRIVORY ™ G21 | EMS |
| OB1 | SOARNOL ™ ET3803 | Nippon Gohsei |
| PE1 | PE ™1042cs15 | Flint Hills |
| PE2 | AFFINITY ™ PL 1888G ™ | Dow |
| PE3 | PETROTHENE ™ NA 345-013 ™ | LyondellBasell |
| PE4 | — | — |
| PE5 | EXCEED ™ 3512CB ™ | ExxonMobil |
| PE6 | AFFINITY ™ PT 1450G1 ™ | Dow |
| PE7 | MARFLEX ™ 1019 ™ | Chevron Phillips |
| PE8 | — | — |
| PET2 | MYLAR ™ M34 ™ | DuPont Teijin |

AB 1 is a masterbatch having about 81% linear low density polyethylene, and about 21% of an antiblocking agent (diatomaceous earth).

AD1 is a maleic anhydride modified EVA that acts as a polymeric adhesive (tie layer material).

AD2 is a maleic anhydride modified EVA that acts as a polymeric adhesive (tie layer material).

AD3 is a maleic anhydride modified LLDPE that acts as a polymeric adhesive (tie layer material).

EM1 is ethylene/methyl acrylate copolymer with a methyl acrylate content of about 20%.

EV1 is an ethylene/vinyl acetate copolymer with a vinyl acetate content of less than 10% by weight of the copolymer.

EZ1 is a compound polymer blend of 65% ionomer (SURLYN™ 1650SB), 30% EVA (ELVAX™ 3134Q), and 5% polybutylene (MONTELL™ PB8640), each by weight of the blend.

NY1 is nylon 6 (polycaprolactam).

NY2 is an amorphous copolyamide (6I/6T) derived from hexamethylene diamine, isophthalic acid, and terephthalic acid.

OB1 is EVOH with about 38 mole % ethylene.

PE1 is LOPE.

PE2 is a branched, single-site catalyzed ethylene/octene copolymer with a density of about 0.9035 grams/cubic centimeter.

PE3 is LDPE.

PE4 is a dry/pellet blend of 65% AD2 and 35% PE1.

PE5 is a linear, single-site catalyzed ethylene/hexene copolymer with a density of about 0.9120 grams/cubic centimeter.

PE6 is a branched, single-site catalyzed ethylene/octene copolymer with a density of about 0.902 grams/cubic centimeter.

PE7 is LDPE.

PE8 is a blend of between 0.01% and 100%, by weight of the total composition, PE5, and between 100% and 0.01%, by weight of the total composition, EV1.

PET2 is a saran-coated biaxially oriented polyester.

All percentages herein are by weight unless indicated otherwise.

Example 1 as shown has a total thickness ranging from about 2.0 mils to 3.5 mils.

Core layer 112 of the above film structure can comprise any suitable oxygen barrier material, such as EVOH, and can be blended in any suitable proportion with other polymeric materials or organic or inorganic additives as desired. In one embodiment, intermediate layers 114 and 116 can each comprise 100% semicrystalline polyamide such as nylon 6.

In another embodiment, Intermediate layers 114 and 116 each comprise a blend of an amorphous polyamide and a semicrystalline polyamide.

Tie layers 118 and 120 can comprise any suitable polymeric adhesive that functions to bond two layers together, e.g. EVA, EAO, LDPE, EMA, and anhydride grafted derivatives of these polymers. Tie layers 118 and 120 can be the same, or can differ.

Bulk layer 124 can comprise a suitable polyolefin, such as an EAO; and/or a polymeric adhesive such as those disclosed herein for tie layers 118 and 120.

In one embodiment, first outer layer 122 functions as an easy-open sealant layer of the film, and provides a surface 23 that can be sealed to the inner surface 67. Layer 122 can comprise any suitable material or blend of materials that provides an easy-open peelable seal when adhered to the inner surface 67. Layer 122 comprises EZ1 or any suitable resin or resin blend that provides an easy-open peelable sealant.

Second outer layer 128 can function as a sealant layer of the film, and provides a surface 25 that can be sealed to the inner surface 29. Layer 128 can comprise any suitable material or blend of materials that provides a relatively strong seal when adhered to inner surfaces 29. Layer 128 comprises PE1 or any EAO such as EXACT™ 3024, a single-site catalyzed linear ethylene/butene copolymer from ExxonMobil with a density of 0.905 g/cc; or AFFINITY™PL 1888G, a single-site catalyzed branched ethylene/octene copolymer from Dow with a density of 0.9035 g/cc.

Additional materials that can optionally be incorporated into one or more of the film layers, as appropriate, include antiblock agents, slip agents, antifog agents, fillers, pigments, dyestuffs, antioxidants, stabilizers, processing aids, plasticizers, fire retardants, UV absorbers, etc.

In any of these embodiments, the PSA layer (19, 119, 219) will occupy a portion of the surface of the strip that faces and contacts inner surface 67 of panel section 6.

The invention is characterized by the fact that:

- the package before initial opening does not have a PSA on the exterior surface of the package,
- before opening the package, the PSA is in contact with the inner surface of the panel section of the discrete laminate of the package,
- before opening the package, the PSA is not in direct contact with the outer surface of the first side panel, the outer surface of the panel section, or of the outer surface of the second side panel,
- a portion of the panel section acts functionally like a release liner for the PSA, although in some embodiments there is no discrete release liner separate from the functional effect of the panel section.

In general, strip 10 can have any total thickness desired, and each layer can have any thickness desired, so long as the strip and package provide the desired functionalities. Typical total film thicknesses are from 0.1 mils to 15 mils, such as 0.2 to 12 mils, such as 0.5 mils to 10 mils, 0.8 mils to 8 mils, and 1 mil to 4 mils. Suitable gauges include 1.5 mils, 2 mils (as in Example 1); and 3 mils.

Figure 7:
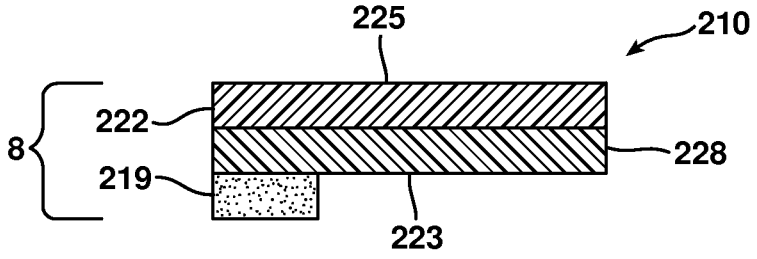
FIG. 7 is a cross-sectional view of a tape according to another embodiment.

Thus, by way of example, FIG. 7 shows, in another embodiment, a two layer film 210 having a first outer layer 222 compositionally and functionally like layer 122 of FIG. 6, with a first outer surface 225; and having a second outer layer 228 compositionally and functionally like layer 128 of FIG. 6, with a second outer surface 223.

Two, three, four, five, six, seven, and eight layer films can thus alternatively be produced, that each include the layers described above with respect to the film strip of FIG. 7, with additional layers as needed, using suitable polymers such as olefin homopolymers or copolymers.

In some embodiments, such as the base strip of FIG. 7, an oxygen barrier layer is not necessary, for example in the packaging of produce. In these embodiments, the web or webs that comprise the pouch will typically also not have an oxygen barrier layer. In contrast, embodiments of film strip 10 that include an oxygen barrier layer will typically be suitable in connection with web or webs for the pouch that include an oxygen barrier layer.

FIG. 2A shows a primary die cut segment defined by die cuts 21, and identified as region "C". Also shown is a secondary die cut segment defined by upper die cut 21 and die cut 36, and identified as region "E". Region "C" is underlain by a clear area; region "E" is partially underlain by the PSA, and partially by a clear area. See also FIGS. 27 A to D, and 28A to C. The PSA covers a first portion of the first surface of the base strip, and the first end of the PSA is congruent with the first end of the base strip. Inner surface 67 of panel section 6 is anchored to outer surface 59 of first side panel 12 at anchor region "D".

Figure 2B:
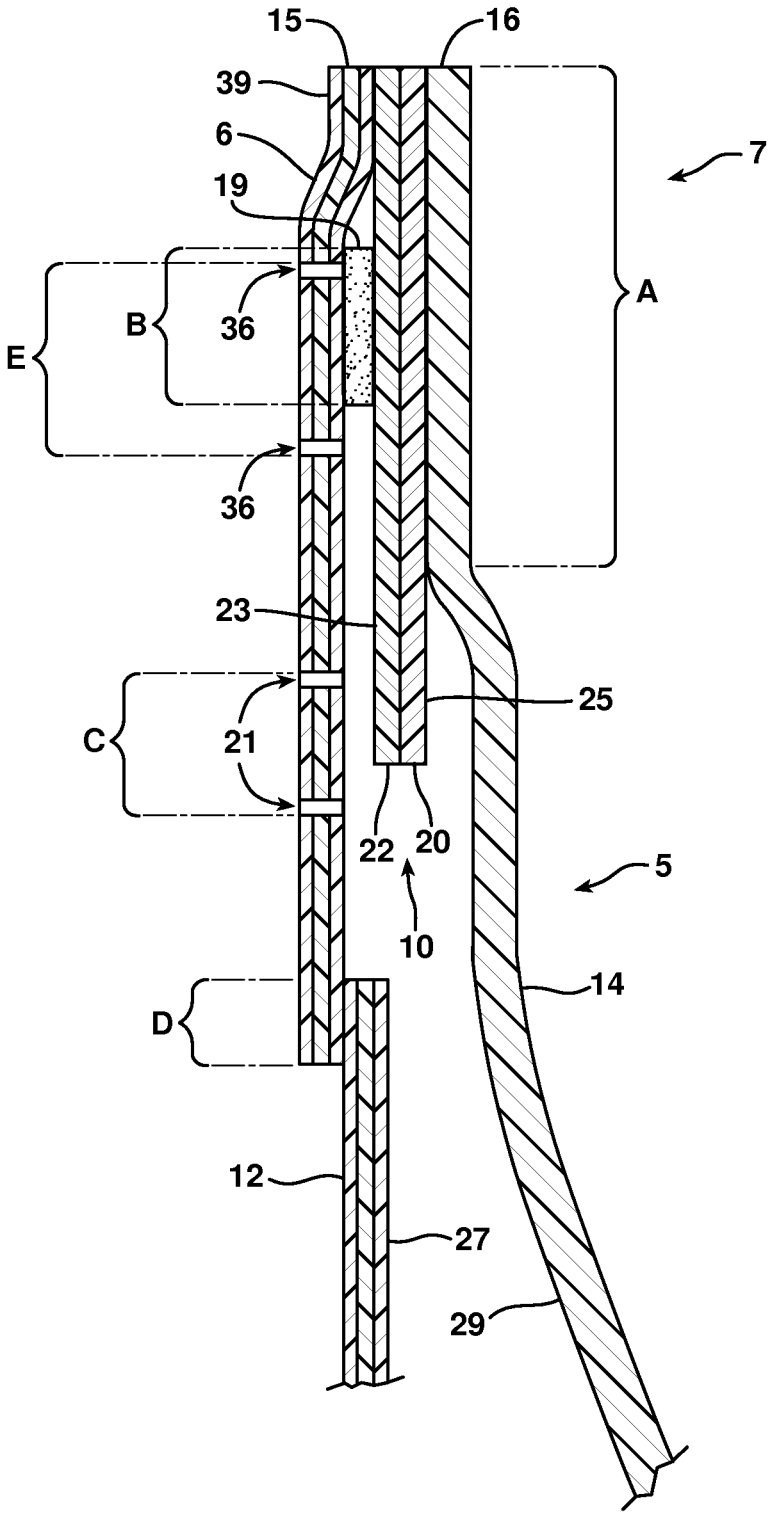
FIG. 2B is an enlarged cross-sectional view of another embodiment of a portion of a package.
Figure 2C:
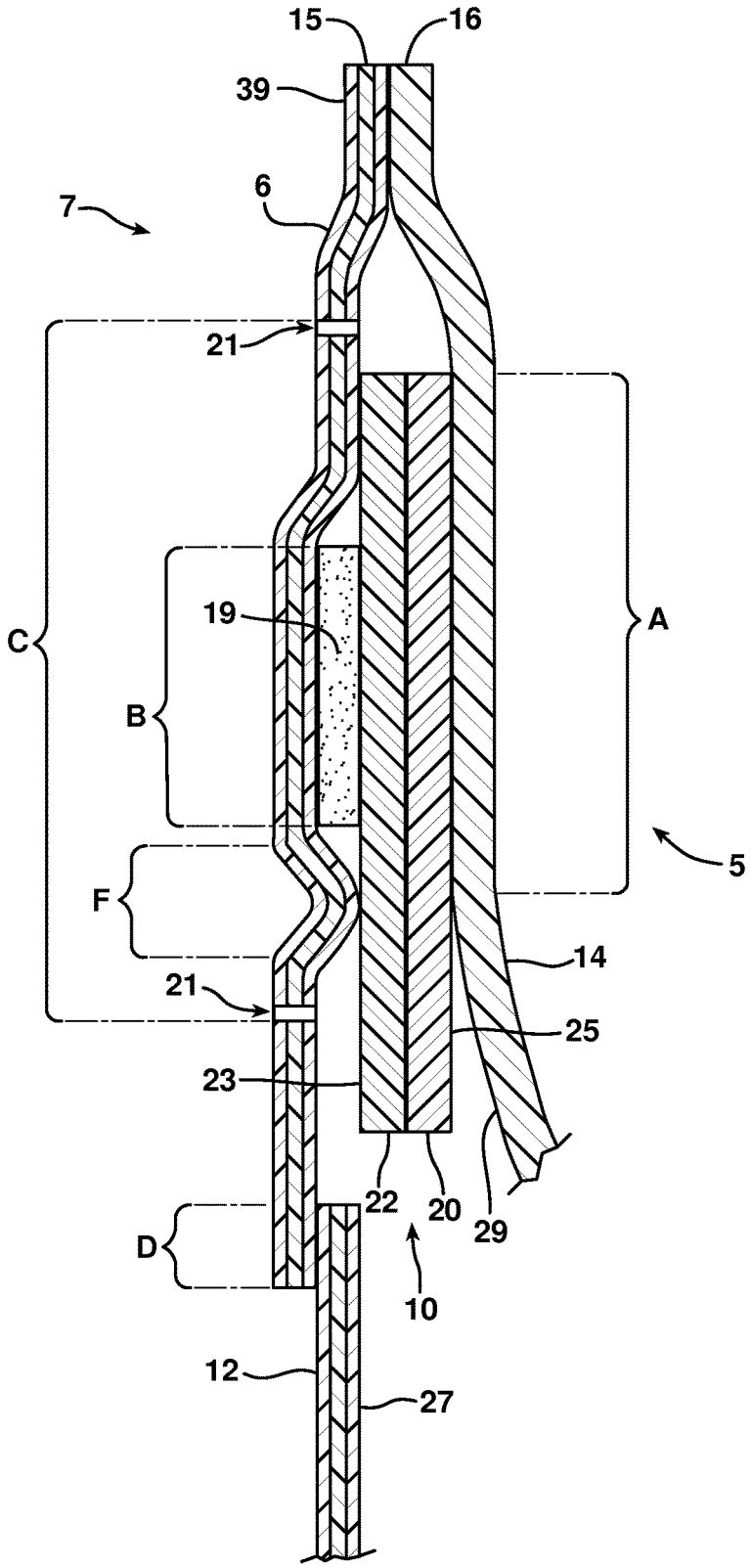
FIG. 2C is an enlarged cross-sectional view of another embodiment of a portion of a package.

In an alternative embodiment, FIG. 2B is similar to FIG. 2A, but in which 1) strip 10 is sealed at its first end 28 to the inner surfaces of the first ends of the panel section and second side panel respectively; 2) regions "C" and "E" are spaced from one another, and do not share a common die cut; and 3) the first end of the PSA is not congruent with the first end of the base strip. The embodiments of both FIGS. 2A and 2B offer the feature of having the opening mechanism of the package (removing the primary die cut segment) different from the reclosing mechanism (removing the secondary die cut segment to exposed the PSA, etc.). Thus, in these embodiment, the PSA need not be exposed to open the package.

In each of the embodiments of the package and process disclosed herein, a non-hermetic or hermetic package can be made in accordance with the invention.

In some embodiments, a package can be made where no easy-open seal is present, and easy-open functionality is provided in the package by displacement or removal of the primary die cut segment.

Layer 20 comprises a sealant that provides a relatively strong seal when layer 20 is sealed to surface 29. An example of a material suitable as a strip for this embodiment is a barrier/sealant component of various laminated materials that also include a polyester film component, sold commercially by the Cryovac business unit of Sealed Air Corporation, under designations including H52XXB, H75XXB, and H72XXB. These are sold as primary packaging materials, i.e. webs that form the main body of the package, not as discrete strips to be used in combination with a primary web.

2. Method of Making a Package a. Horizontal Form/Fill/Seal (HFFS)

HFFS packaging systems are generally well known to those of skill in the packaging industry, and can be used to make packages of the present invention.

Referring to FIGS. 8, and 9A through 9C, lay-flat web 300 is unwound from roll 302, then advanced to forming plow 304 to convert lay-flat web 300 to folded web 305 (typically a centerfold film). The second end of each of the pouches to be made will comprise a second end fold 306. Second end fold 306 therefore is equivalent to second end 34 of FIG. 1. This second end fold can be optionally sealed, or left as a folded second end of the pouch. Side seals 308 are made to define a plurality of vertically arranged pouches 309. Each pouch 309 is cut off from the trailing edge of web 300 by an appropriate cutting mechanism (not shown) such as a knife, at position 311, a product (not shown in FIG. 8, but see product 24 in FIGS. 1 to 5) is inserted or dropped into the open mouth 312 of each pouch, and the pouch mouth 312 is then closed by a suitable sealing mechanism such as a heat sealer (not shown) to create a seal 314.

Discrete laminate 310, equivalent to discrete laminate 4 of FIGS. 1 to 5, can be introduced into the HFFS process in a number of ways. For example, discrete laminate 310 can be unwound from a roll 315 in the vicinity of roll 302, and disposed on lay-flat web 300 prior to, or as web 300 is being folded into folded web 305. The discrete laminate is disposed on the web such that the discrete laminate overlaps the lay-flat web sufficient to allow the discrete laminate to be anchored to the web.

Discrete laminate 310 includes a base strip, at least a first portion of the first surface of the base strip coated with a pressure sensitive adhesive, and a second portion of the first surface of the base strip optionally substantially free of PSA. The first portion is in one embodiment closer to a longitudinal end of the pouch, e.g. the first end of the pouch, than the second portion. Alternatively the first portion can be substantially free of PSA, and the second portion can be coated with a pressure sensitive adhesive.

The first portion of the first surface of the strip is adhered by the pressure sensitive adhesive to a panel section 6 (see FIGS. 2A and 2B). The panel section includes die cuts made in a predetermined pattern (see FIGS. 28A to 30D) to produce packages according to the invention. The panel section is anchored to the folded web 305 on one side of the fold 306, and the second surface of the base strip is anchored to a second inner surface of the folded web on the other side of fold 306, by a suitable means such as a sealing mechanism such as a heat sealer (not shown). Optionally, the first surface of the base strip is sealed to an inner surface of the folded web with an easy-open seal. Discrete laminate 310 would thus be installed on the pouch in the same overall HFFS process that achieves production of the pouch, loading of a product into the pouch, and completion of the final package. Discrete laminate 310 is incorporated onto the pouch material and after cutting and sealing as described hereinabove, comprises an extension of the first side panel of each pouch as shown in FIG. 8, and FIGS. 1 to 5.

Figure 9A:
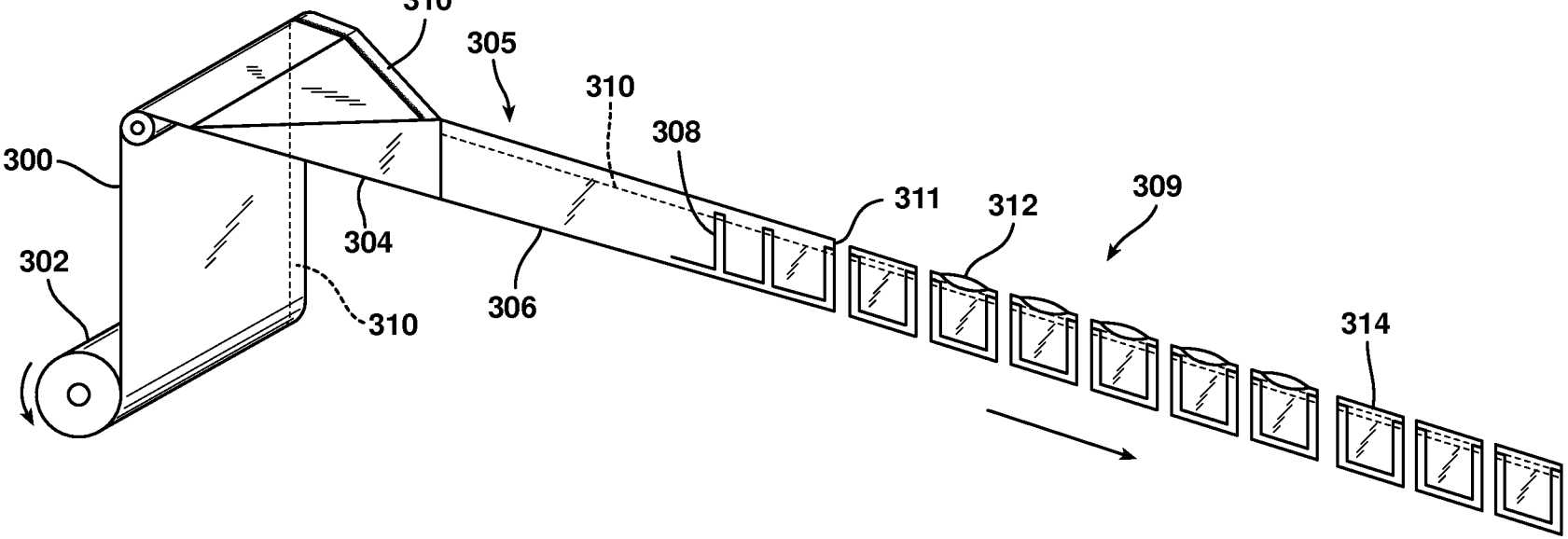
FIG. 9A is a perspective view of a HFFS process and apparatus for making a package according to another embodiment.
Figure 9B:
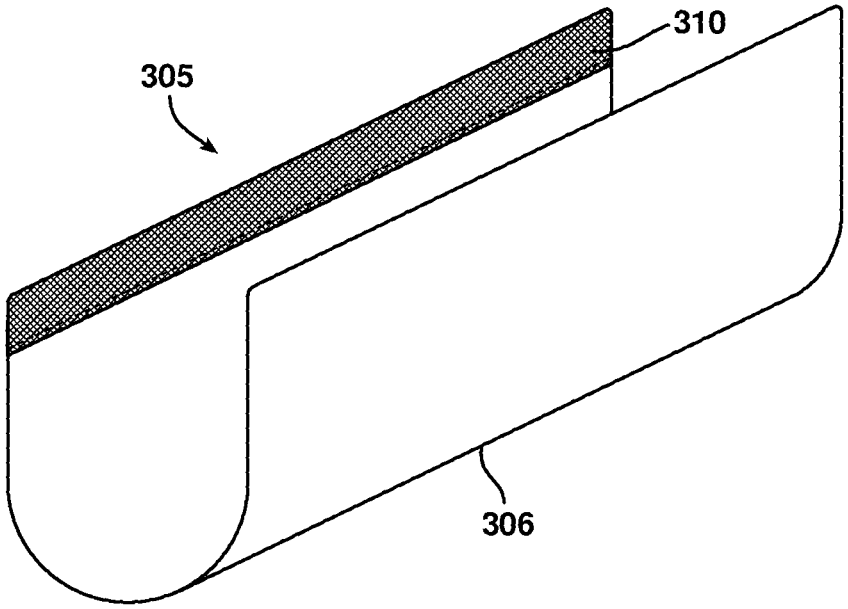
FIG. 9B is a perspective view of a section of folded web.

Alternatively, and referring to FIGS. 9A and 9B, discrete laminate 310 is shown as being installed on the lay-flat web prior to the start of the HFFS packaging process. This can be accomplished off-site from the processor, e.g. by the supplier of the web roll 302.

Figure 8:
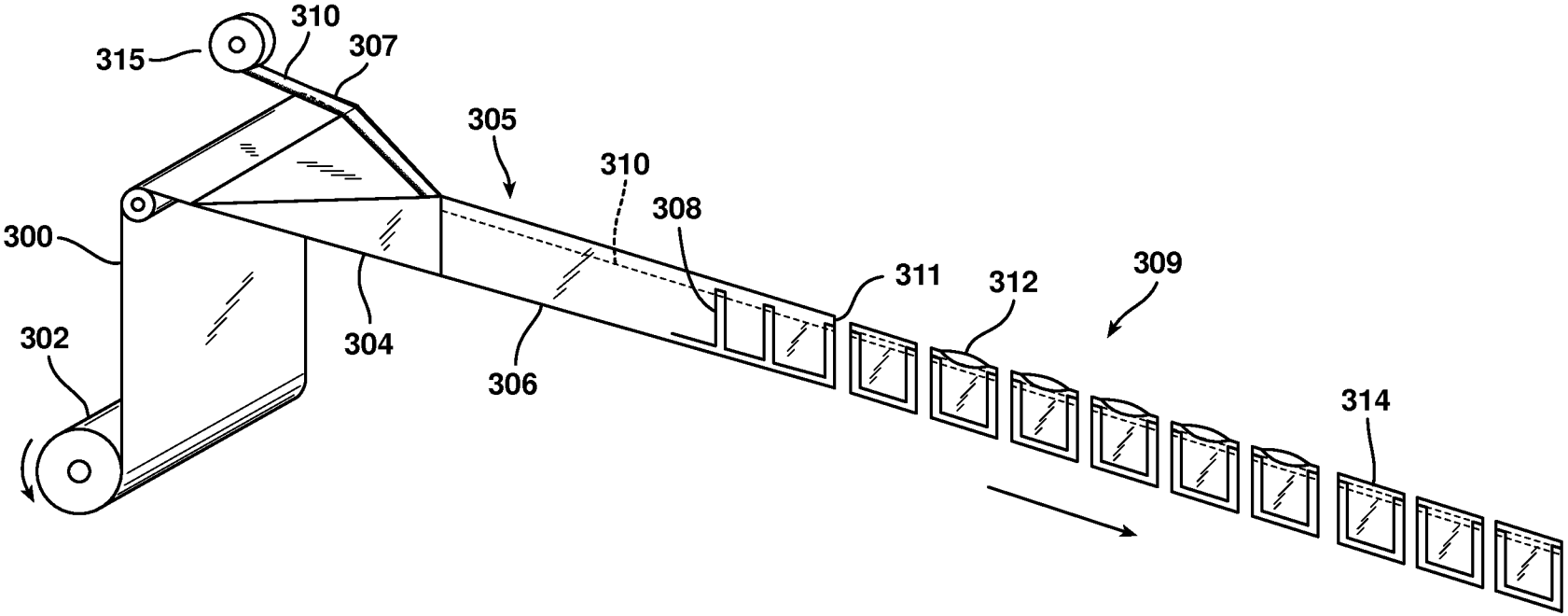
FIG. 8 is a perspective view of a HFFS process and apparatus for making a package.

FIG. 9B is a perspective view of a section of folded web as shown in the HFFS process and apparatus of FIGS. 8 and 9A, as the lay-flat web is folded to create folded web 305. The discrete laminate 310 is shown disposed, and optionally attached to, an inner surface of one panel of the folded web 305, such that upon sealing the web to create a pouch, the discrete laminate functions as an extension of the panel.

Figure 9C:
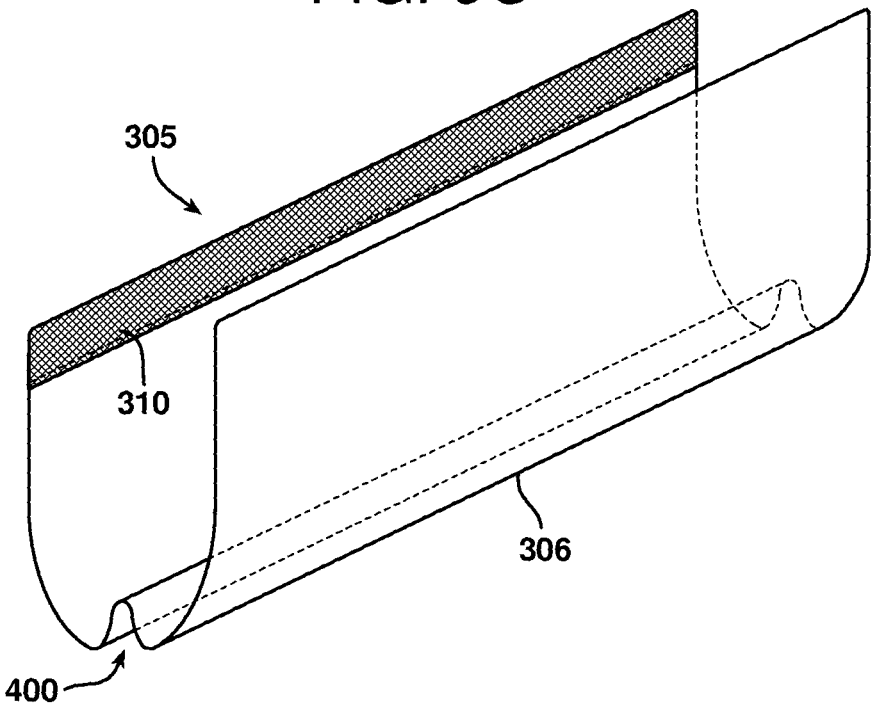
FIG. 9C is a perspective view of a section of a gusseted folded web.

The embodiment of FIG. 9C is similar to FIG. 9B, but additionally shows an optional gusset 400 that can be made in the second end fold 306 of the folded web. The gusset can be optionally thereafter heat sealed. A gusseted second end provides a stand-up pouch feature in the final package. Gusseting can be accomplished by any suitable means known to those of skill in the art, such as a second forming plow (not shown) placed in-line in the manufacturing line at a position downstream of the forming plow 304. The bottom area of the folded web takes on a generally "W" shape, i.e. a gusseted shape, in cross-section, with the outside legs of the "W" extending upwardly, and two parallel reverse folds to create the gusseted bottom. Seal opening or holes are previously punched in the inner legs of the "W" shape and aligned with one another so that the two outside plies can be sealed together through these holes. When the seals are made the panels are sealed to one another through the holes. One or more static plows may be mounted above the seal zone to form the gussets. Gusset holes can be die punched by a die at a hole-punch station which punches clearance holes at an appropriate position designed to be in general alignment with the side seal, adding rigidity to the gusset portion of the final package. This added rigidity enables the final package to stand up by itself when placed on a flat surface.

B. Vertical Form/Fill/Seal (VFFS)

Figure 10:
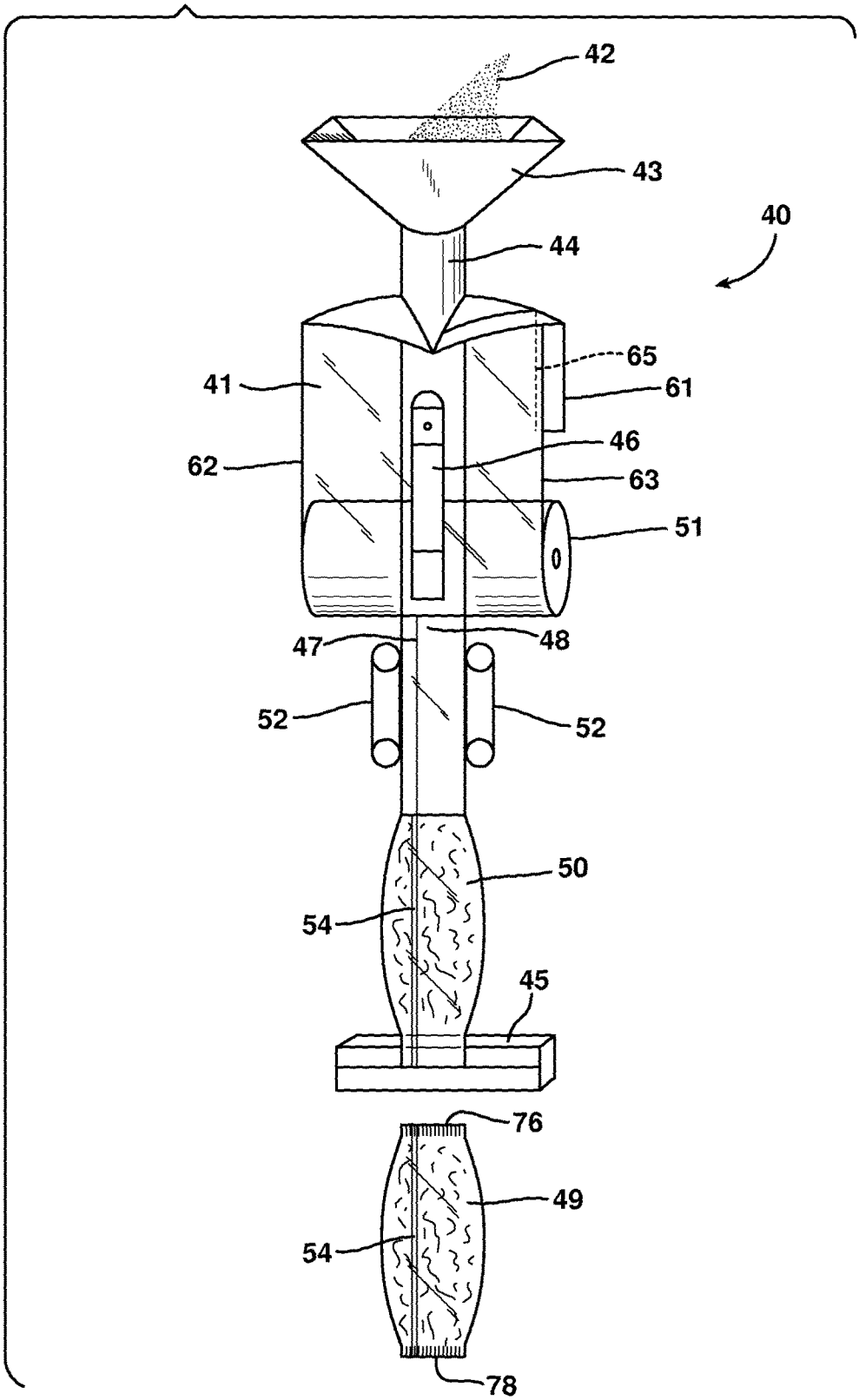
FIG. 10 is an elevational view of a VFFS process and apparatus for making a package.

FIG. 10 schematically illustrates a VFFS apparatus that can be used in conjunction with the apparatus and process according to some embodiments of the present invention. VFFS packaging systems are generally well known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), and U.S. Pat. No. 4,808,010 (Vogan), all incorporated herein by reference in their entirety.

Apparatus 40 utilizes a lay-flat web 41 as a rollstock. Product 42 is manually or mechanically supplied to apparatus 40 from a source (not illustrated), from which a predetermined quantity of product 42 reaches the upper end portion of forming tube 44 via funnel 43, or other conventional means. The packages are formed in a lower portion of apparatus 40, and web 41 from which the packages are formed is fed from feed roll 51 over certain forming bars (not illustrated), is wrapped about forming tube 44 (sometimes known as a "sailor's collar" or "forming collar") and is provided with a longitudinal fin seal or lap seal 47 by longitudinal heat sealing device 46, resulting in the formation of a vertically-oriented folded web in the form of a tube 48. Transverse heat seal bars 45 operate to close and seal horizontally across the lower end of vertically-sealed tube 48, to form a pouch 49 which is thereafter packed with product 42. Film drive belts 52, powered and directed by rollers, as illustrated, or by suitable alternative motive means, advance tube 48 and pouch 49 a predetermined distance, after which seal bars 45 close and simultaneously seal horizontally across the lower end of vertically-sealed tube 48 as well as simultaneously sealing horizontally across upper end of sealed pouch 49, to form a product packaged in sealed pouch 49. The next pouch 50, thereabove, is then filled with a metered quantity of product 42, forwarded, and the packaging cycle is repeated. It is conventional to incorporate with the seal bars 45 a cut-off knife (not shown) which operates to sever a lower sealed pouch 49 from the bottom of upstream pouch 50.

Figure 11:
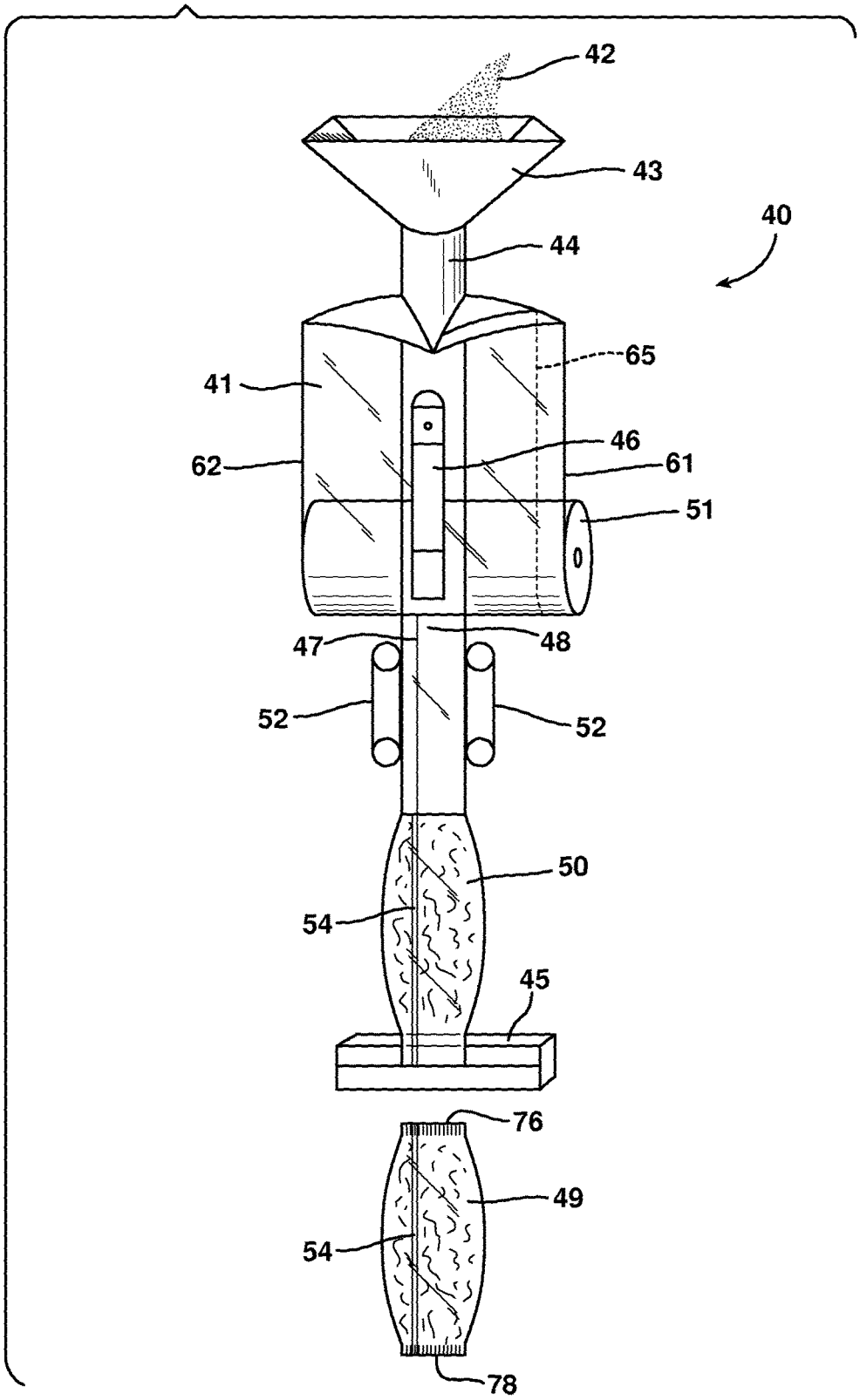
FIG. 11 an elevational view of a VFFS process and apparatus for making a package according to another embodiment.

Lay-flat web 41 of FIGS. 10 and 11 will in operation travel upward, e.g. vertically upward from roll 51 to the forming tube 44, and then downward, e.g. vertically downward for the remaining process steps. Discrete laminate 54 is unwound from roll 51 to dispose discrete laminate 54 in overlapping relationship onto web 41 before, or as, web 41 is wrapped about forming tube 44. When longitudinal seal 47 is made, discrete laminate 54 becomes part of the folded web. As with the HFFS process, a coat of PSA will cover a first portion of the base strip 10 of discrete laminate 54.

Figure 12:
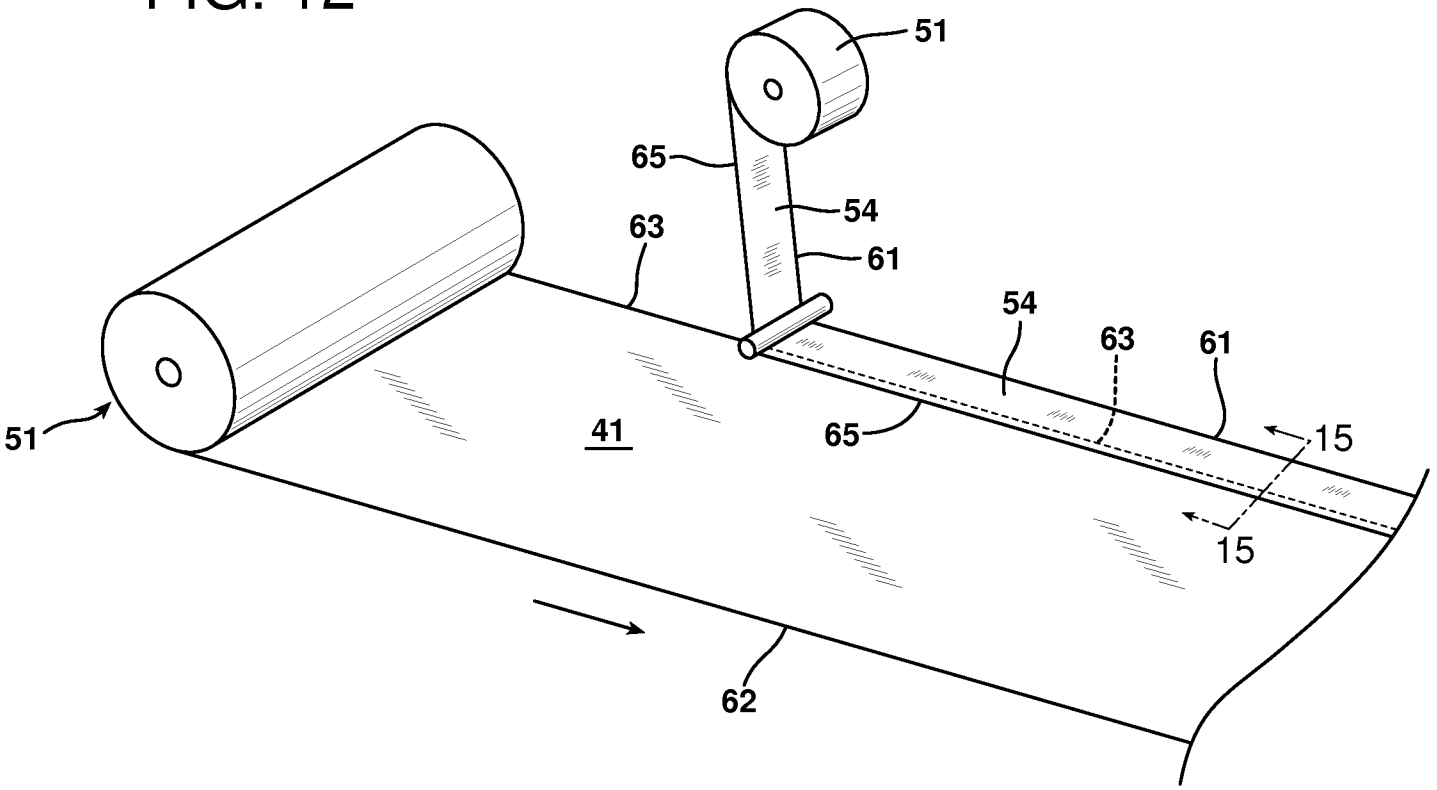
FIG. 12 is a perspective view of a roll of lay-flat web and a roll of a discrete laminate.

FIG. 12 discloses the roll 51 of lay-flat web 41 according to one embodiment of the invention. Discrete laminate 54 is fed from roll 51 onto a portion of lay-flat web 41.

Figure 13:
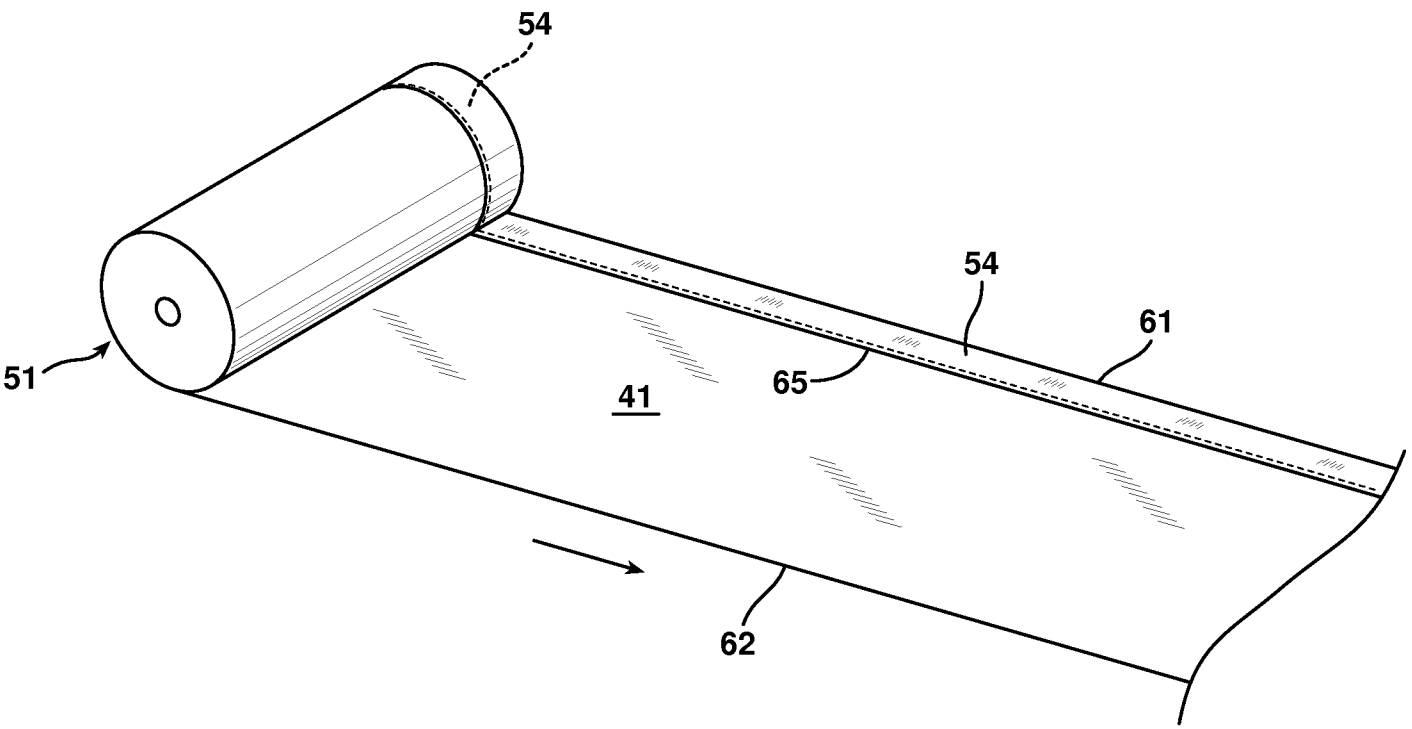
FIG. 13 is a perspective view of a roll of lay-flat web and a discrete laminate according to another embodiment.

Alternatively, and referring to FIGS. 11 and 13, discrete laminate 54 is already installed on the lay-flat web prior to the start of the VFFS packaging process. This can be accomplished off-site from the processor, e.g. by the supplier of the feed roll 51.

The discrete laminate includes die cuts on the panel section of the discrete laminate, the die cuts made in a predetermined pattern (see FIGS. 28A to 30D) to produce packages according to the invention.

In some embodiments, at least one of the web and the discrete laminate carries a registration device. Printed indicia can be in the form of registration marks, such as eye-spots. Those skilled in the art will be familiar with the use of eye-spots and registration marks in processing web material in packaging operations. Registration marks are printed in uniformly spaced fashion along or near an edge of the web or tape, and facilitate the controlled production of packages of the invention, and can be printed in conjunction with other decorative printing.

Figure 14:
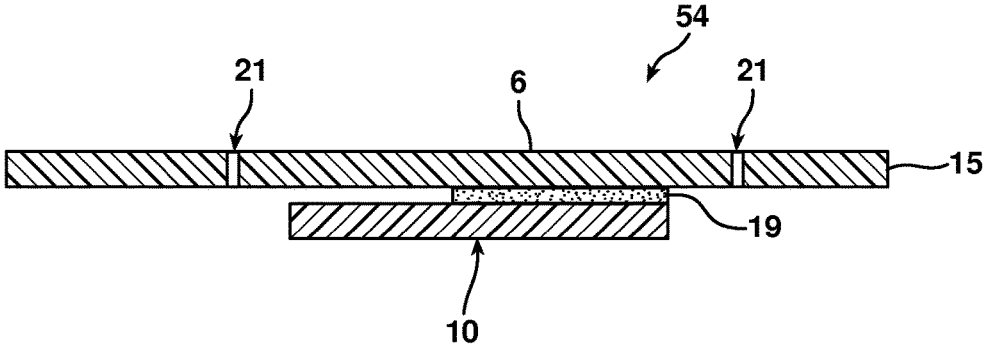
FIG. 14 is a side view of a discrete laminate.

FIG. 14 shows a discrete laminate 4 of the invention, which can be used in the various processes and packages disclosed herein, e.g. as a discrete laminate 54 of FIGS. 12 and 13. Discrete laminate 54 includes tape 8 including base strip 10 selectively coated with PSA layer 19; and panel section 6 including die cut(s) 21.

Figure 15:
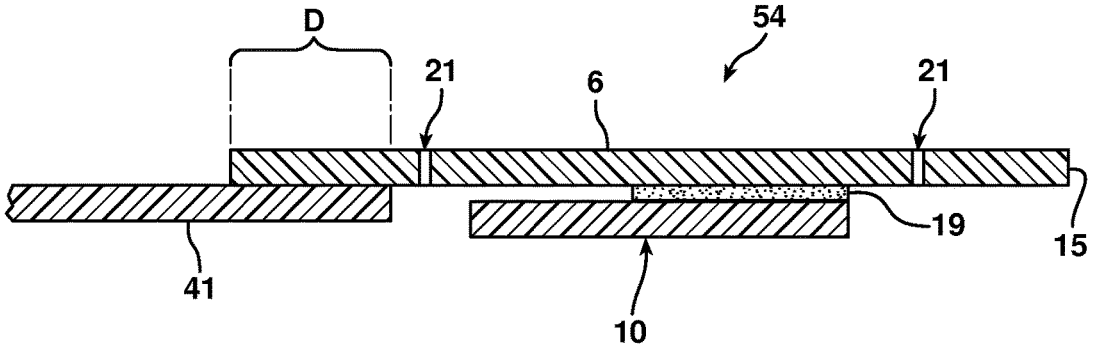
FIG. 15 is a view of a discrete laminate and a portion of a lay-flat web taken along lines 15-15 of FIG. 12.

FIG. 15 shows a discrete laminate 54 of the invention (see also FIG. 12) that has been anchored to lay-flat web 41. In the embodiment shown in FIG. 15, a seal (sealing zone "D") is used to anchor the panel section 6 of the discrete laminate to the lay-flat web 41. Alternatively, the discrete laminate can be anchored at a second surface of base strip 10 to lay-flat web 41.

Figure 32:
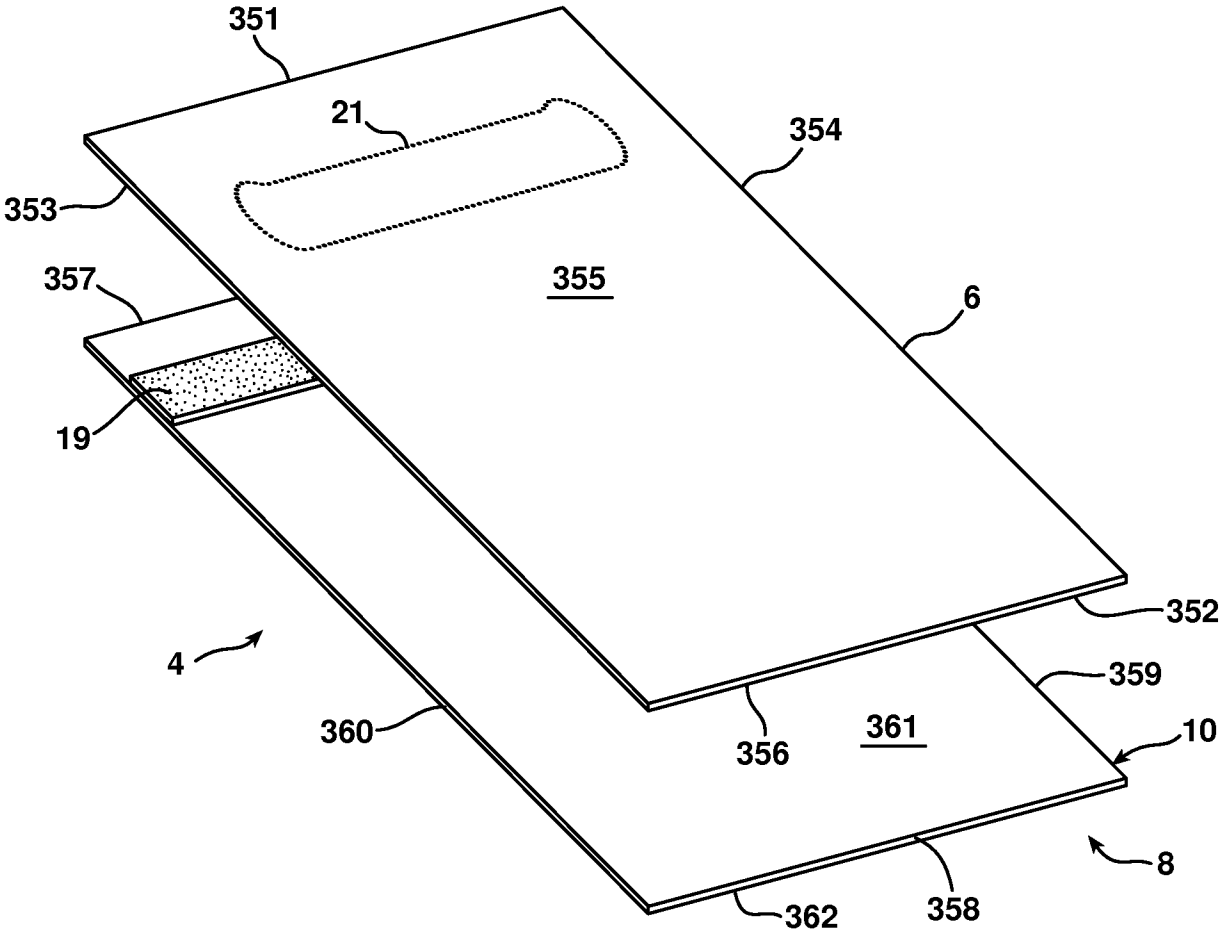
FIG. 32 is a perspective, blown-up view of the discrete laminate.
Figure 33:
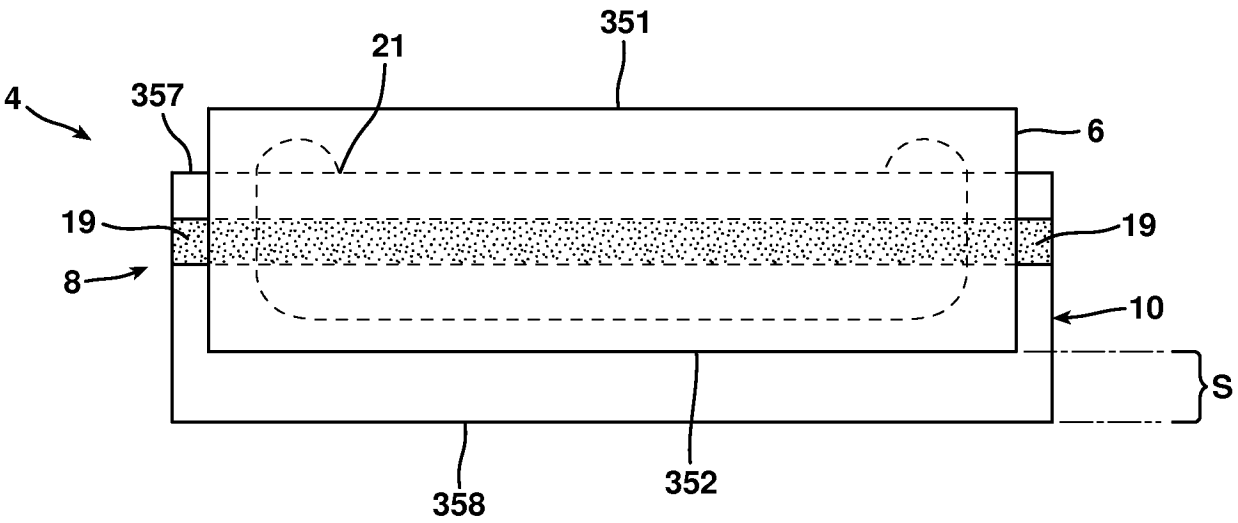
FIG. 33 is a plan view of the discrete laminate.

FIGS. 32 and 33 show a discrete laminate 4 in accordance with the invention. The discrete laminate includes a panel section 6 including an outer surface 355, an inner surface 356, a first side edge 353, a second side edge 354, a first end 351, a second end 352, and a die cut 21; and a tape 8 including a base strip 10 including a first surface 361, a second surface 362, a first side edge 360, a second side edge 359, a first end 357, a second end 358, and a PSA layer 19 coated on at least a first portion of the first surface 361 of the base strip 10. Each of the components of discrete laminate 4 can have any suitable dimensions, and in some embodiments base strip 10 and panel section 6 can be congruent.

Although for purposes of illustration FIG. 33 shows the first and side edges of the base strip as extending beyond the first and side edges of the panel section, typically in packages of the invention the first and second side edges of the panel section will be congruent with the first and second edges respectively of the base strip.

Figure 16:
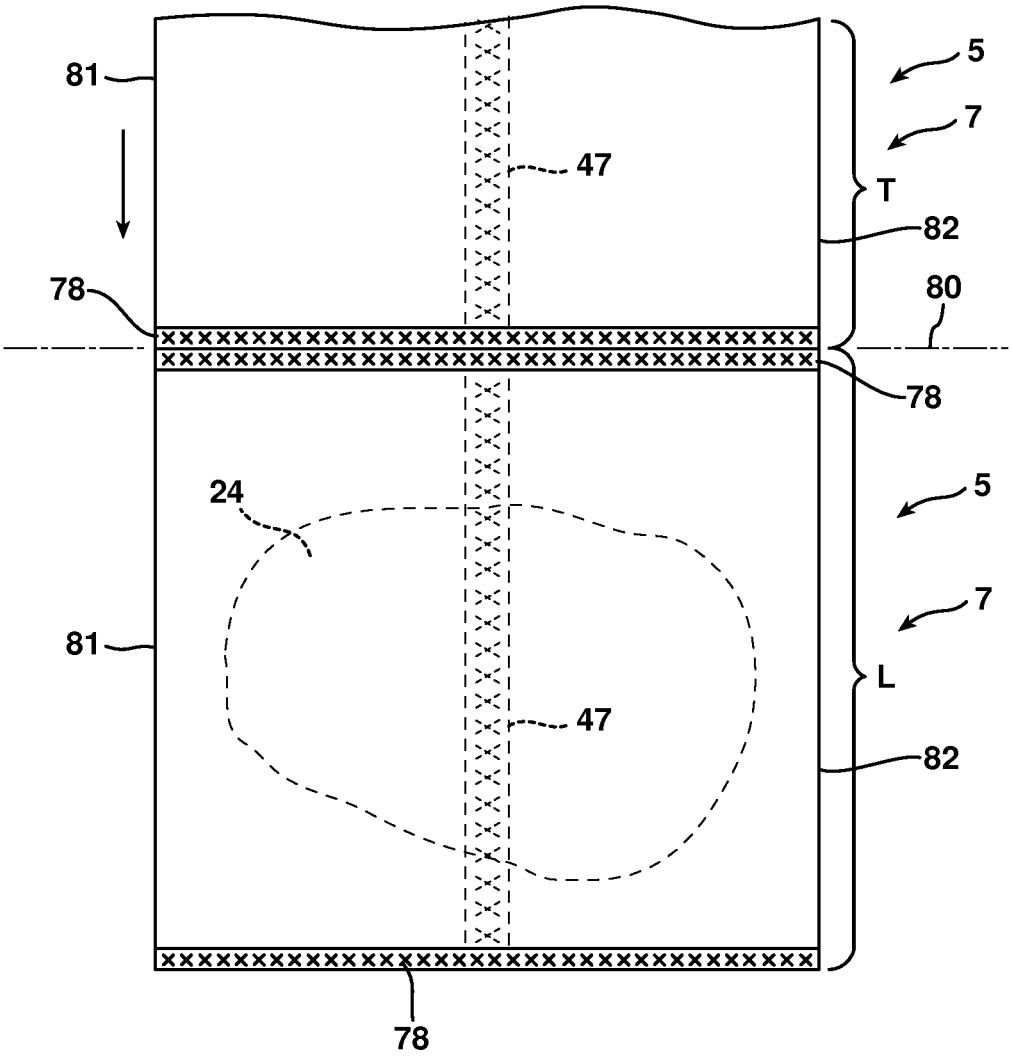
FIG. 16 is an elevational view of two consecutive pouches in a VFFS embodiment.

In FIG. 16, a leading or downstream pouch "L" includes a transverse bottom and top seals 78, folded side edges 81 and 82, and longitudinal seal 47. Trailing or upstream pouch "T" has features similar to leading pouch "L". Leading pouch "L" is severed from upstream pouch "T" at cut line 80, and the seals 78 are made by suitable sealing equipment commonly used in VFFS packaging processes, such as heat sealing equipment, not shown. Die cuts 21 and optionally 36, present in the first side panel of the package, are not shown in all of the drawings. The discrete laminate is not shown in FIG. 16.

Figure 17:
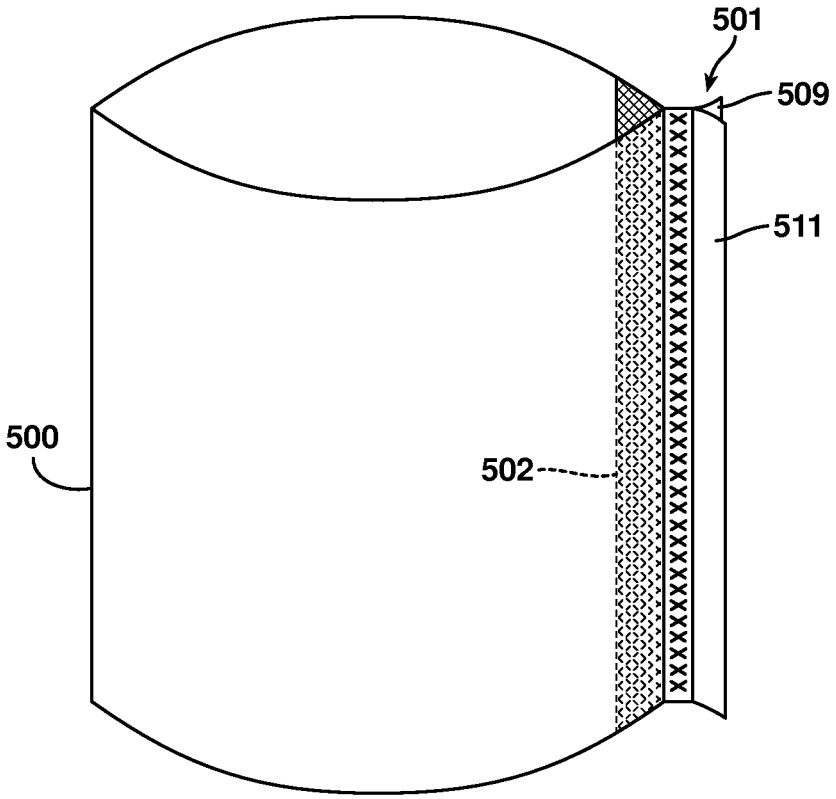
FIG. 17 is a perspective view of a folded web for use in the invention.

FIG. 17 shows folded web 500 with a discrete laminate 502 anchored to a folded web, and fin seal 501, formed as disclosed hereinabove, and prior to a step of making transverse seals in the folded web. A finished package made according to FIG. 17 will thus look like the packages of FIGS. 3 and 4, when these are viewed at right angles to their position in FIGS. 3 and 4, i.e. with the discrete laminate 4 to the right side of each package, and the second end 34 representing a fold. The embodiment of FIG. 17 thus provides a method of producing packages on a VFFS apparatus where the longitudinal seal of the package effectively becomes the first end of the finished package (discounting any unsealed material between the longitudinal seal and the top edge of the package). The apparatus and methodology of U.S. Pat. No. 6,293,073 (Caudle) this patent incorporated herein by reference in its entirety, can be utilized in combination with the teachings herein, to produce packages according to this embodiment. A point of distinction is that in the present invention, the transverse seals will typically (although not necessarily) be rectilinear, whereas the transverse seals disclosed in Caudle '073 are wavy or sinusoidal.

Figure 18:
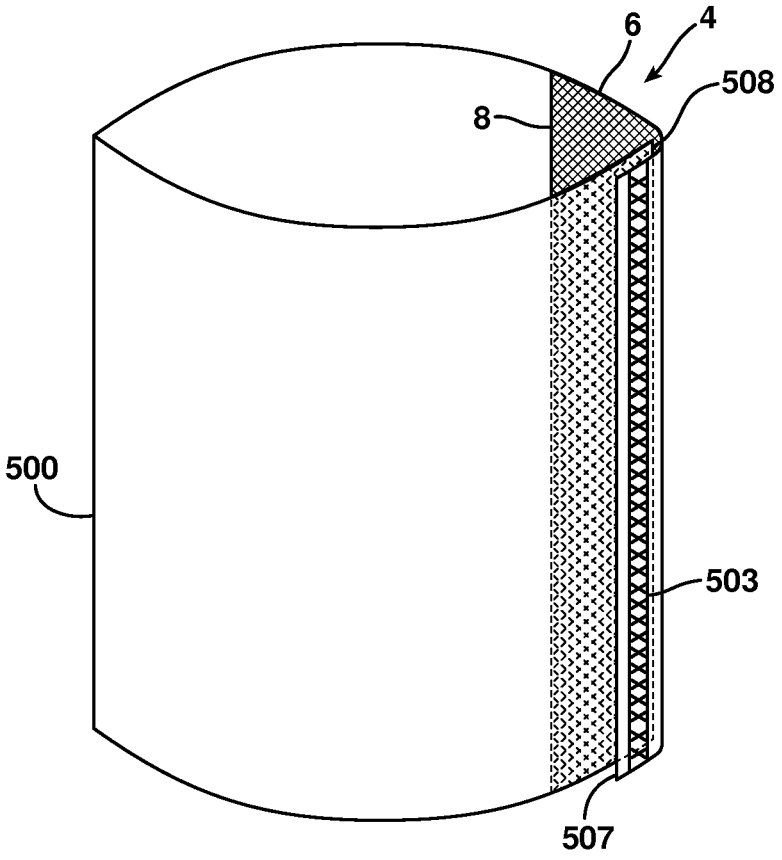
FIG. 18 is a perspective view of a folded web for use in the invention.
Figure 19:
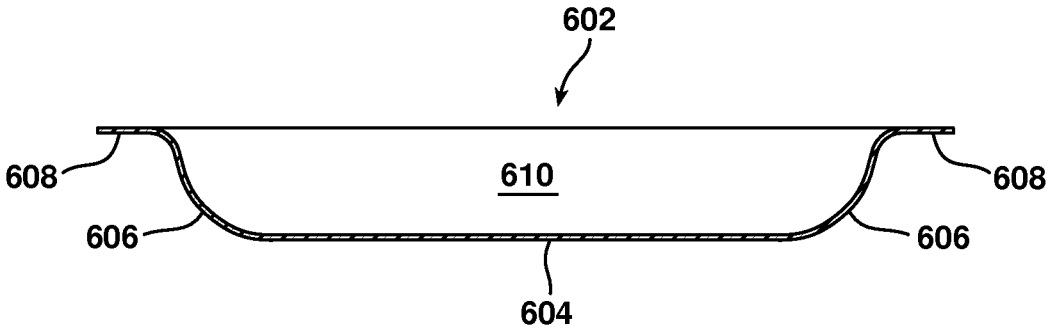
FIG. 19 is a side view of a tray for use in connection with the invention.

Alternatively (FIG. 18), a package like the embodiment of FIG. 17 is shown, but where a lap seal 503 is shown. In this as well as the other processes disclosed herein, a lap seal can be used in lieu of a fin seal when making a longitudinal seal according to the invention. A finished package 5 according to FIG. 18 has a product therein; the two longitudinal ends of the package are closed by a transverse seal; the lap seal runs down the middle or spine of the package, bounded on both ends by the transverse seals; and the discrete laminate is anchored to an interior surface of the folded web.

At any time during the method of making the package in an VFFS process, the panel section is anchored to the lay-flat web, the folded web, or the inner or outer surface of the first side panel, and the second surface of the base strip is anchored to the lay-flat web, the folded web, or the inner surface of the second side panel. This can be done on the lay-flat web prior to supplying the web to the processor, or prior to or as the lay-flat web is advanced over a forming device, or before or after a product is put in a pouch.

C. Lidstock/Formed Web

FIGS. 19, 20A, 20B and 21 illustrate in another embodiment the use of a formed web, e.g. a tray, and a non-formed web, e.g. a lidstock, used in connection with the invention. Tray 602 will typically be made during the packaging process. Thermoforming equipment, available from e.g. Multivac, Tiromat, Ulma or Rapid Pak, is used to convert flat thermoplastic forming web into formed pockets to create trays for containing product such as food, various industrial and consumer items and sterile medical products. Trays are formed from a lower web by heat and pressure, and can be loaded with product manually or automatically on the machine. After that, the packages are vacuumized or back-flushed with modified atmosphere (if required), hermetically sealed to an upper web, separated, and removed for distribution or storage. Alternatively, pre-formed trays can be used.

Each tray 602 has a tray bottom 604, tray sides 606, and a tray flange 608 along its perimeter to which the lidstock 612 can be sealed by heat or other means. Tray bottom 604 and tray sides 606 define tray cavity 610. Prior to any thermoforming step, tray 602 can be of any suitable thickness, e.g. from 2 to 30 mils thick, and any suitable construction.

Figure 20A:
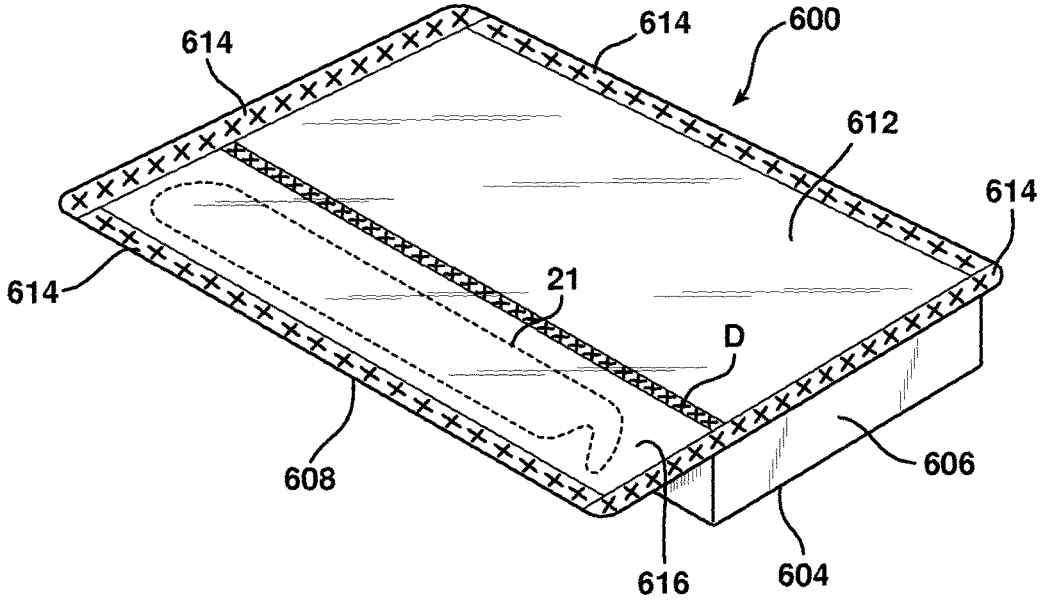
FIG. 20A is a perspective view of a package.
Figure 20B:
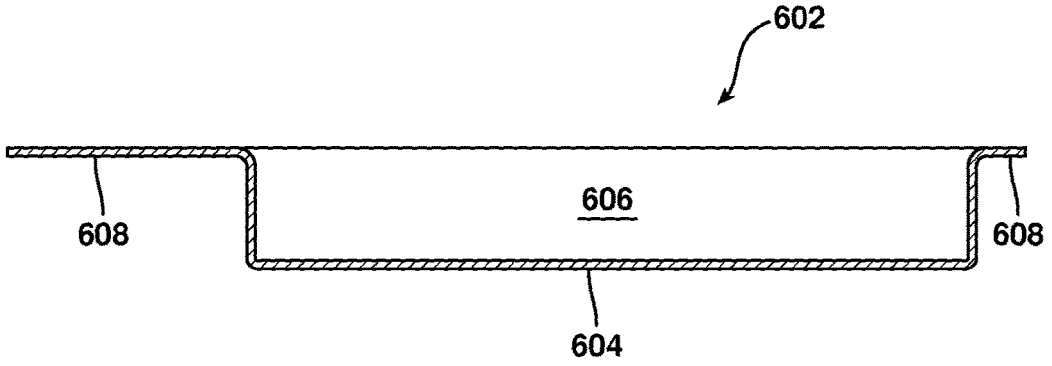
FIG. 20 B is an elevational view of a tray with an extended flange for use in connection with the invention.
Figure 21:
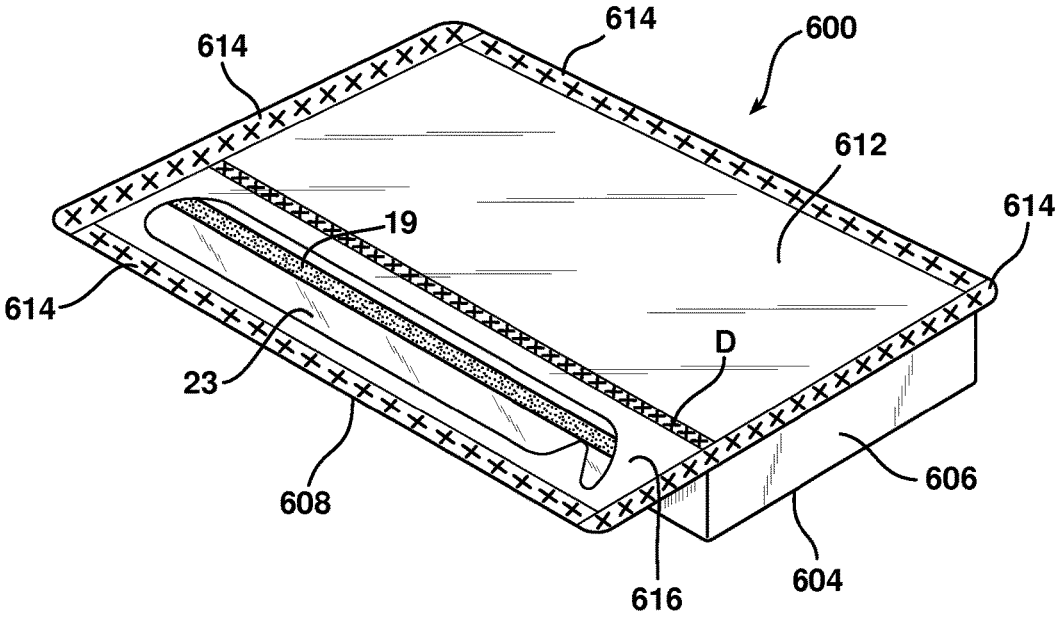
FIG. 21 is a perspective view of the package of FIG. 20A in an opened condition, with the die cut segment removed to expose a pressure sensitive adhesive.

If a pre-made tray is used according to the invention, it can be rigid or semi-rigid, can be in the form of a flat or shaped tray, and can be made from any suitable material, including solid or expanded embodiments, such as PP, polystyrene, polyamide, 1,4-polymethylpentene (e.g. TPX™ available from Mitsui), or crystallized polyethylene terephthalate (CPET). A tray liner can optionally be used that adheres to the surface of the pre-made tray on which the product is to be placed. This liner can be of any suitable design, and can be a multi-layer structure with at least one layer with gas-barrier properties. Such a liner can be adhered to the tray by heat lamination, extrusion lamination, extrusion coating, adhesives, corona treatment, etc. Tray 602 can be a flexible or semi-rigid, or rigid formed web. Referring to FIGS. 20A and 21, a package includes tray 602 to which lidstock 612 has been sealed with perimeter seal 614. Lidstock 612 includes a lay-flat web 611 (see FIGS. 22 and 23) formulated to function as a lid on a formed web, and can be any suitable monolayer or multilayer thermoplastic film as described herein with respect to webs useful in connection with the present invention. Lidstock 612 also includes discrete laminate 616. The base strip of the discrete laminate is anchored to the tray flange, i.e. to the inner surface of the folded web. Discrete laminate 616 has the easy-open characteristics and composition discussed herein with respect to the discrete laminate of HFFS or VFFS packages. The first side panel at closed loop die cut 21 can be removed so that the package is easily opened and product can be removed as desired. Removal or displacement of the die cut segment defined by die cut 21 also exposes the PSA layer 19. After removing the product, the package can be reclosed by folding over the first end of the package (where the extended tray flange is located) such that the PSA contacts the outer surface of lidstock 612.

Figure 22:
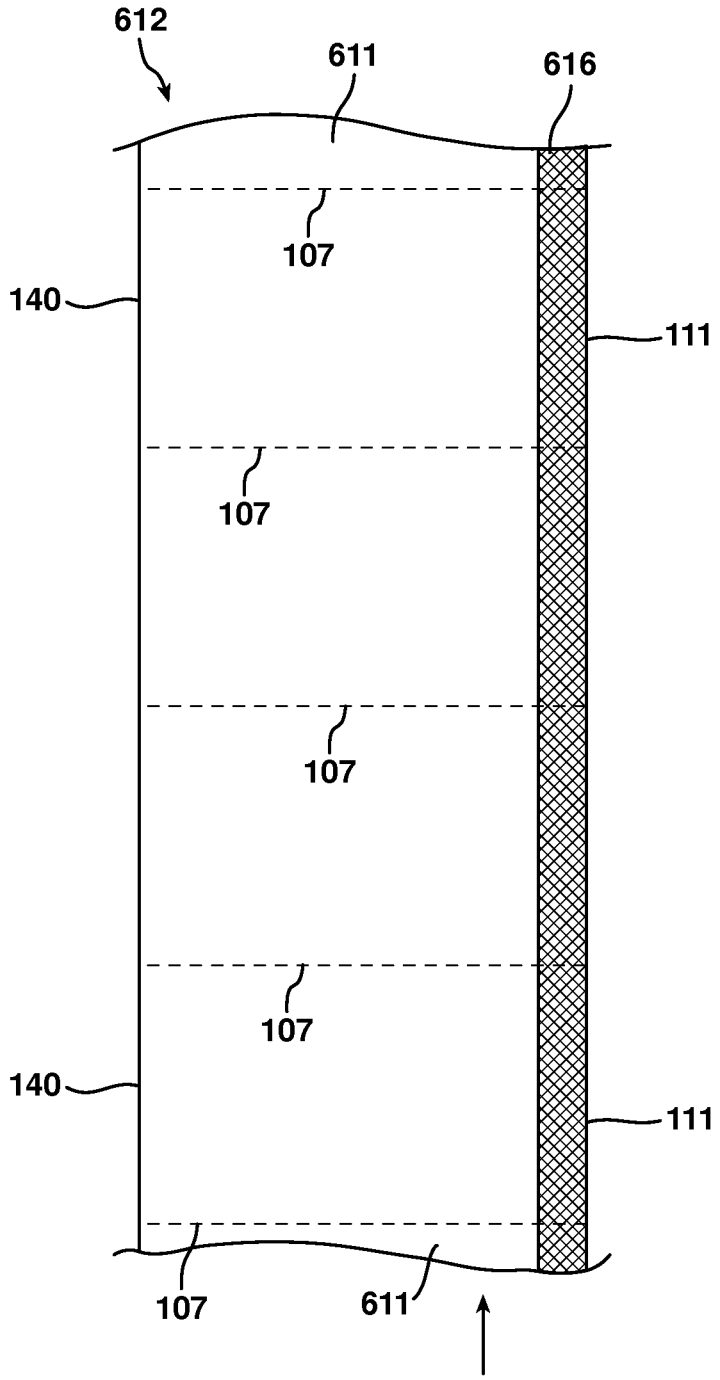
FIG. 22 is a plan view of a lidstock.

Referring to FIG. 22, discrete laminate 616 has a first lateral edge 111. As shown, discrete laminate 616 has been anchored to the lay-flat web 611 to produce lidstock 612. Dotted lines 107 indicate the location at which lidstock 612 is sealed and cut, e.g. perimeter heat sealed and cut, in registered fashion by otherwise conventional means as discussed herein, e.g. in thermoforming equipment, to create individual packages. Lines 107 represent what will become the side edges and seals of individual packages when lidstock 612 is advanced into a packaging system where it is progressively fed over filled trays, sealed to the trays, and cut to create finished packages. Lines 111 and 140 also represent what will become the first and second end respectively of individual packages. Lay-flat web 611, as rolled up, and as it feeds into thermoforming equipment, has a first lateral edge 140. Discrete laminate 616 can be preanchored on lay-flat web 611 by the supplier of the lidstock, as in the embodiments of FIGS. 9A, 11 and 13. Alternatively, discrete laminate 616 can be anchored to the lay-flat web 611 during the packaging process, as in the embodiments of FIGS. 8A, 10, and 12.

Figure 23:
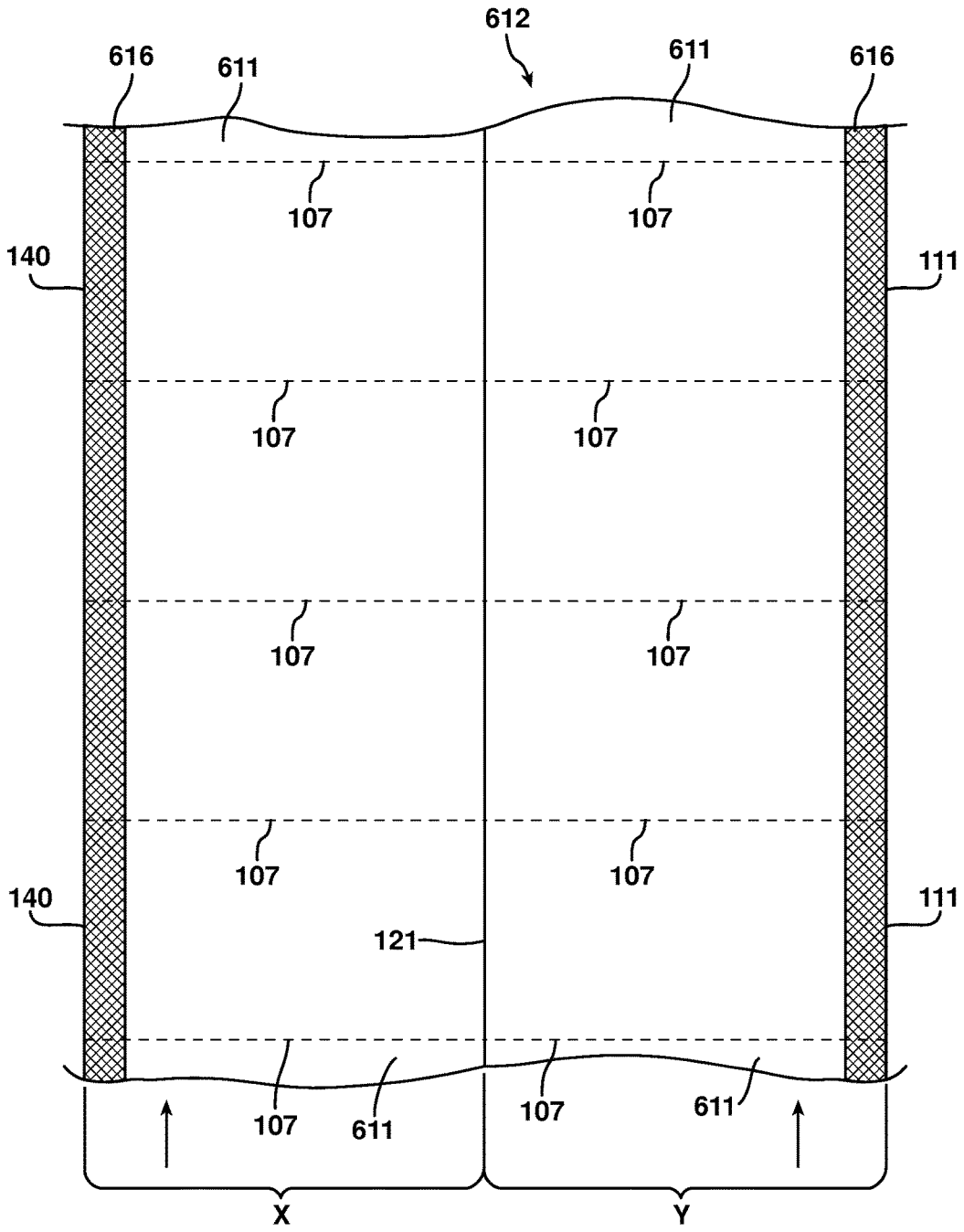
FIG. 23 is a plan view of a lidstock according to another embodiment.

FIG. 23 shows an alternative embodiment of FIG. 22, in which the lidstock is produced as described above, but "two across", so that when run in a packaging machine, with suitable machine die set-ups, two, four, etc. packages can be made simultaneously. In addition to the seal and cut steps at locations 107, the web is cut longitudinally along line 121, so that individual packages made from the longitudinal portion "X" of FIG. 23 will have a second end 121; and individual packages made from the longitudinal portion "Y" of FIG. 23 will have a second end 121.

At any time during the method of making the package having a formed web, the panel section of the discrete laminate is anchored to the inner or outer surface of the lay-flat web, and the second surface of the base strip is anchored to the inner surface of the formed web, e.g. at an extended tray flange as shown in FIGS. 23A and 23C. This can be done on the lay-flat web prior to supplying the web to the processor, or before or after sealing the lidstock to the formed web.

D. Continuous Horizontal Packaging

Figure 25:
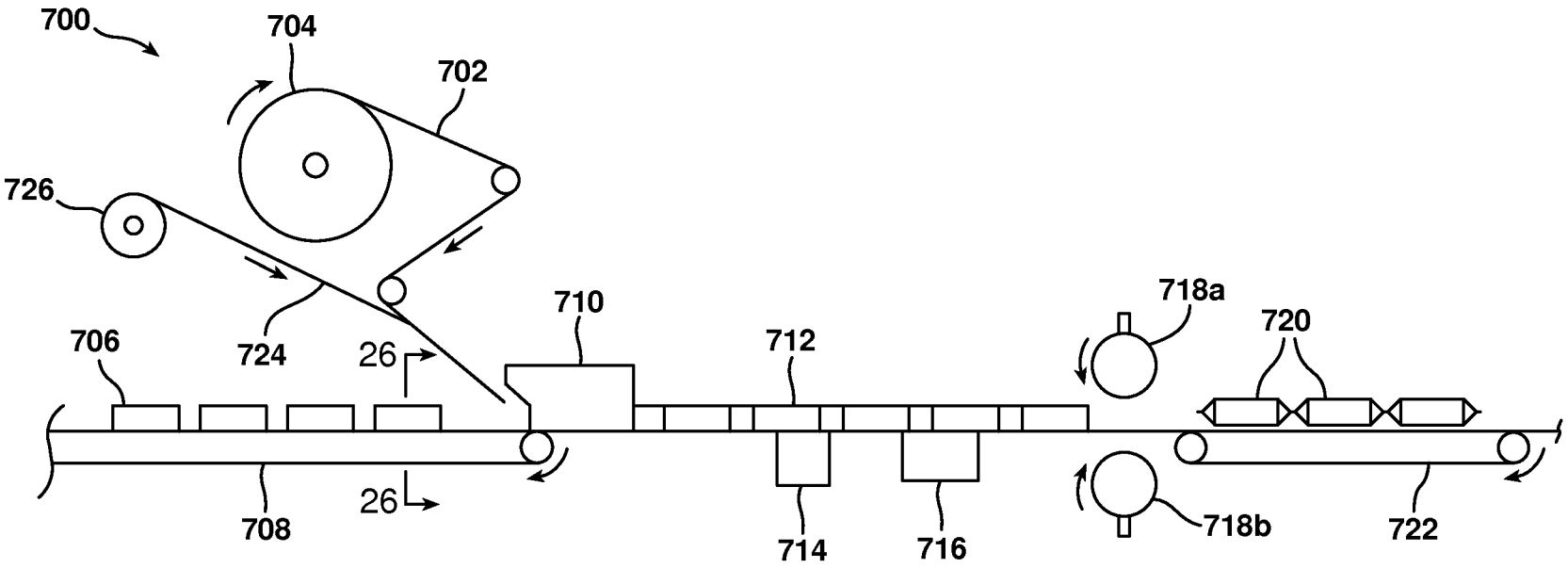
FIG. 25 is an elevational view of a continuous horizontal packaging process and apparatus for making a package.
Figure 26:
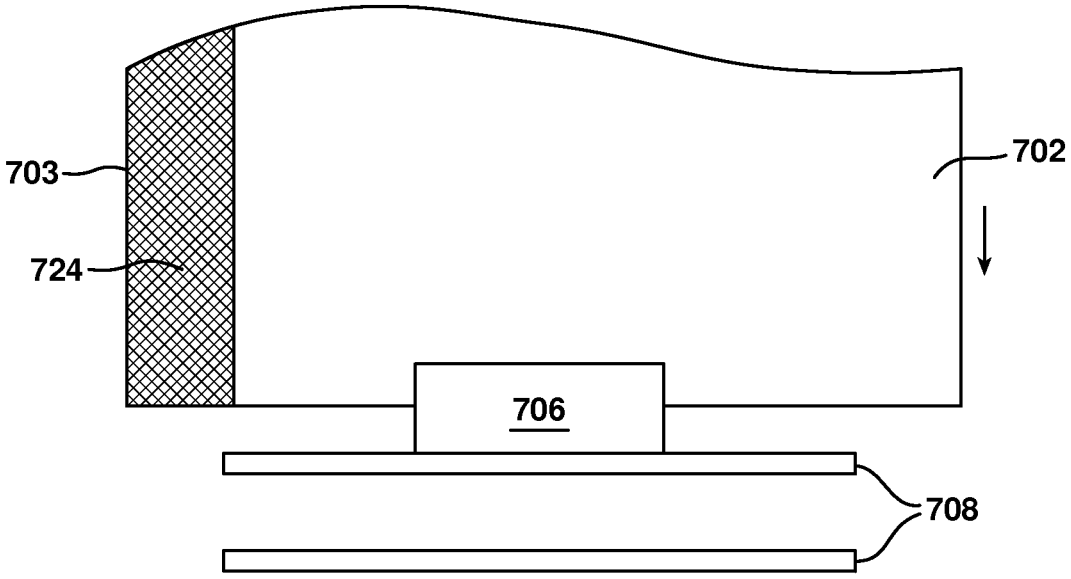
FIG. 26 a front end view of the apparatus of FIG. 25, viewed along lines 26-26 of FIG. 25.
Figure 27A:
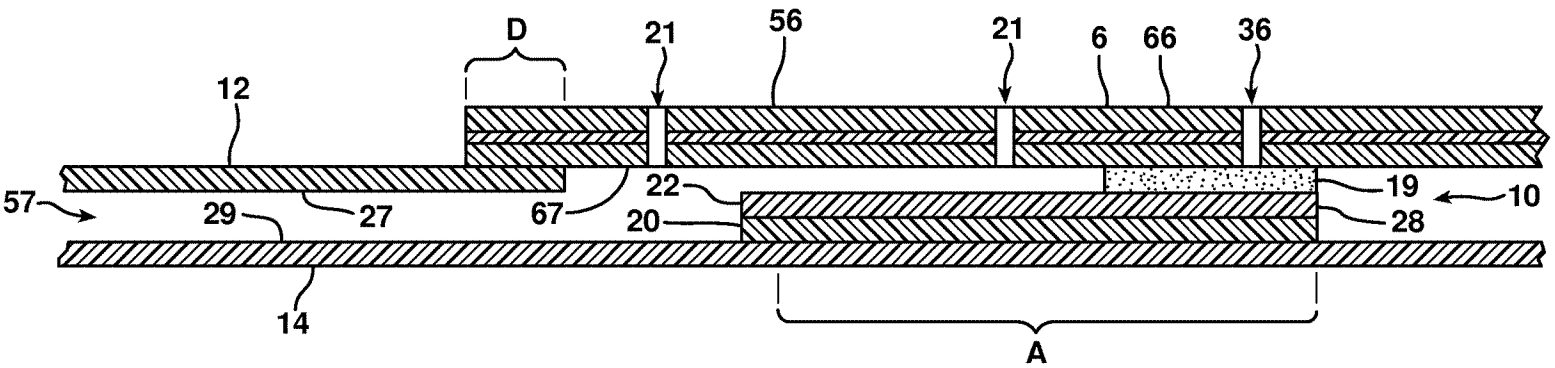
FIGS. 27A, 27B, 27C, 27D, and 27E are each cross-sectional views of a portion of the package, showing a sequence for opening and reclosing the package.
Figure 27B:
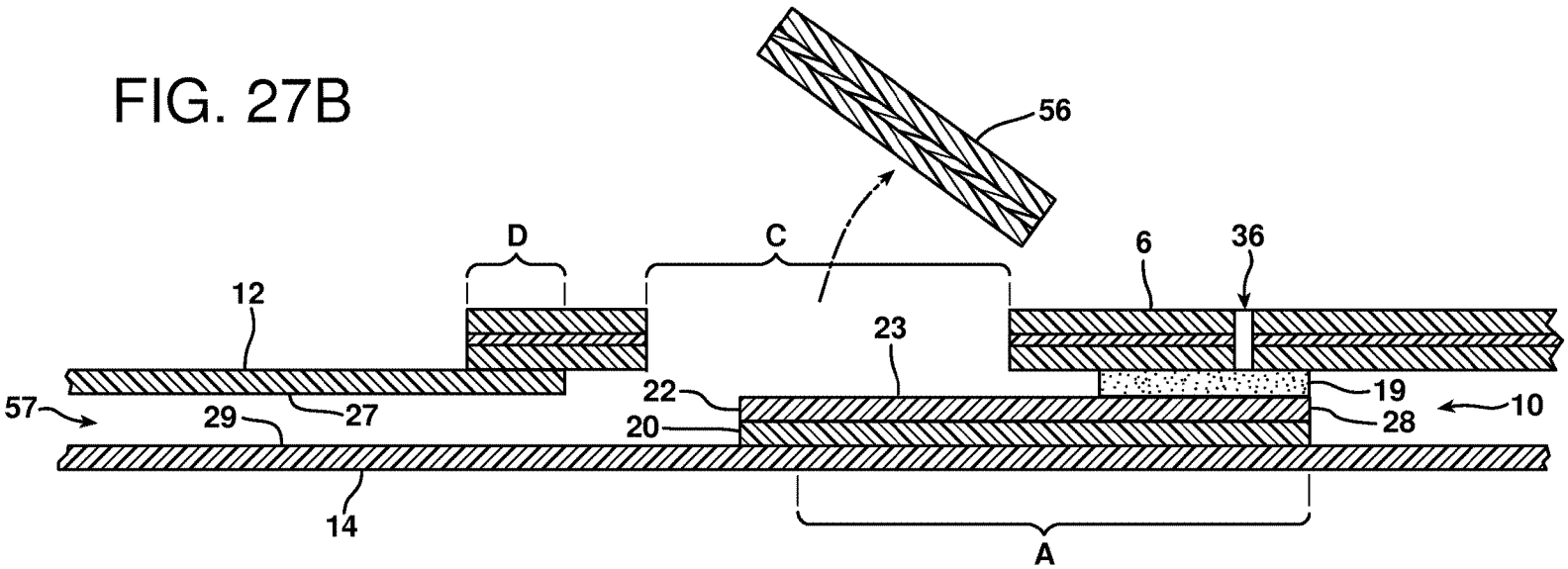
Figure 27C:
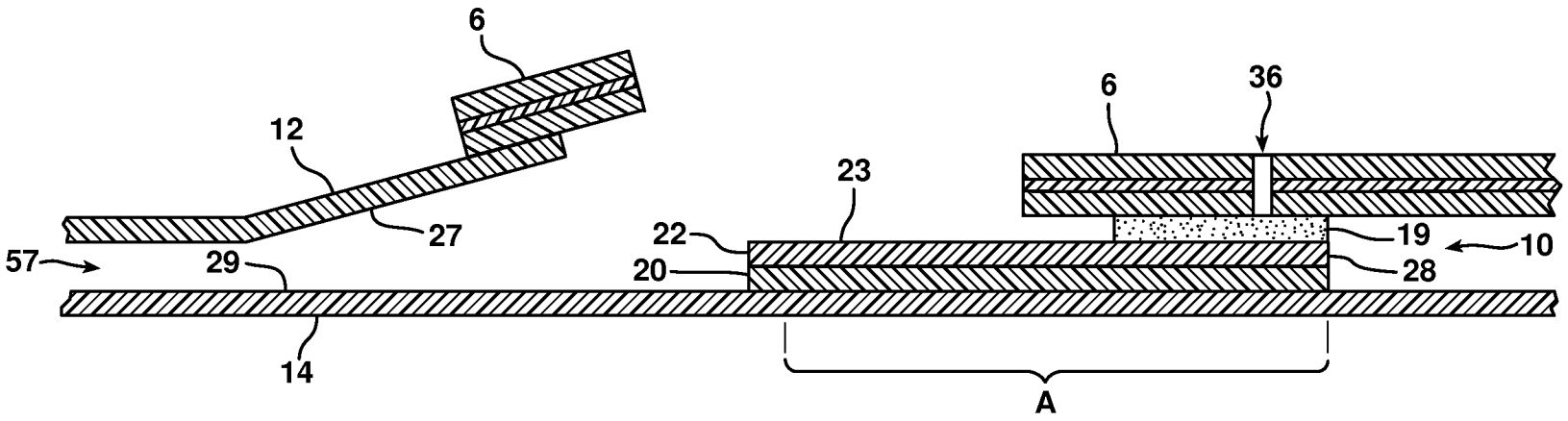
Figure 27D:
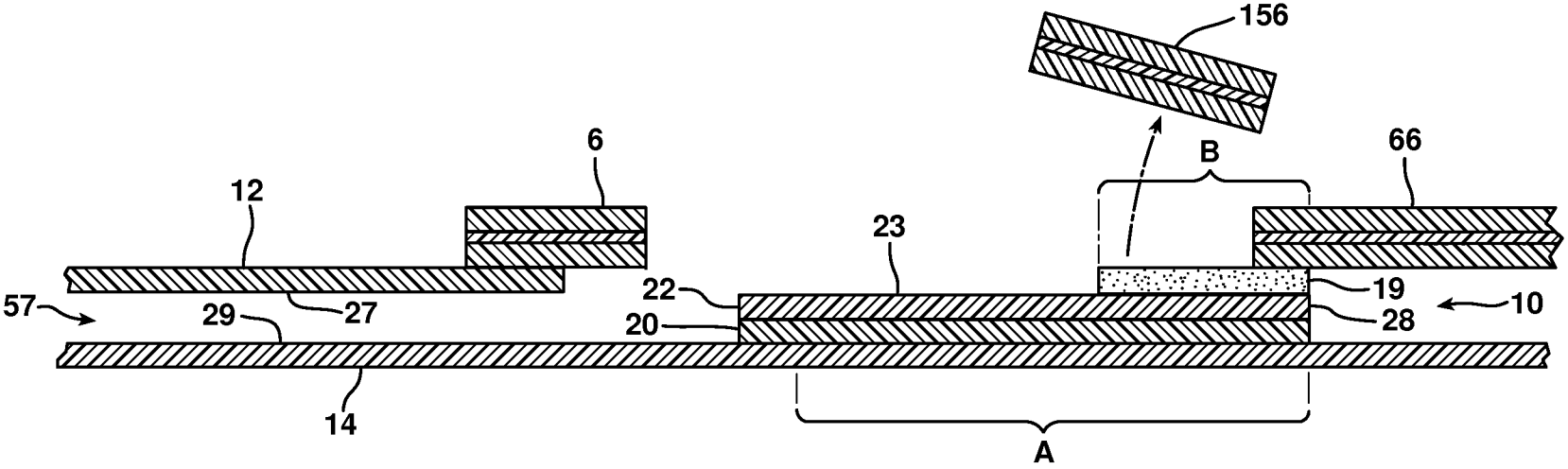
Figure 27E:
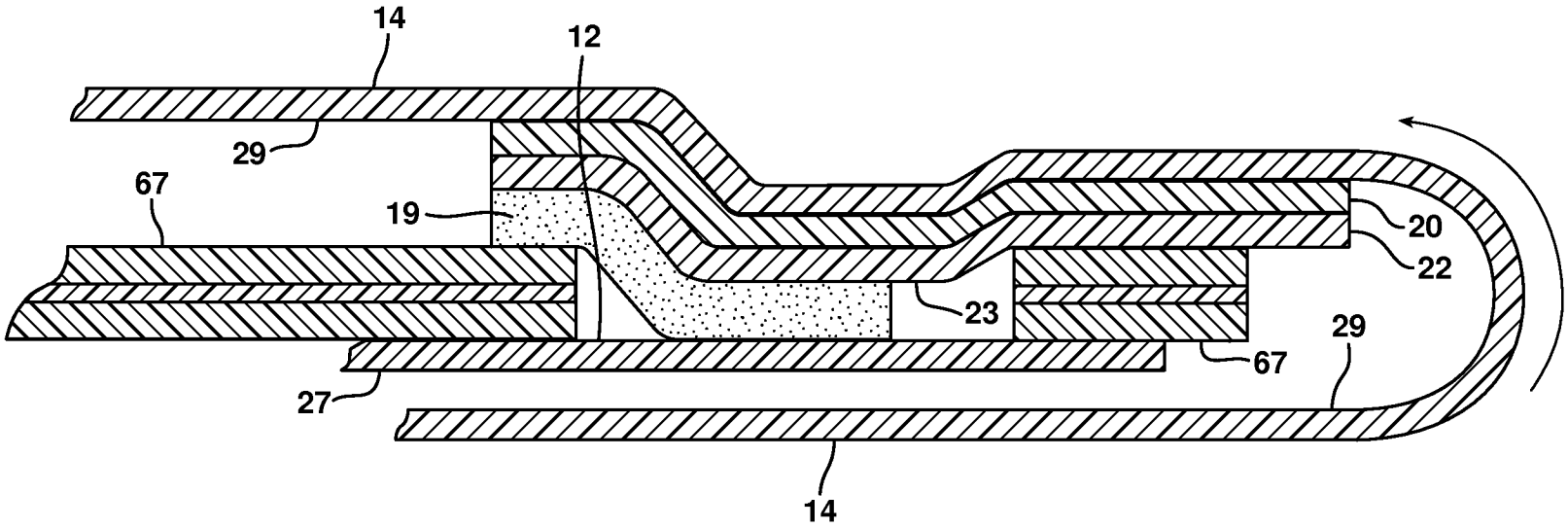
Figure 28B:
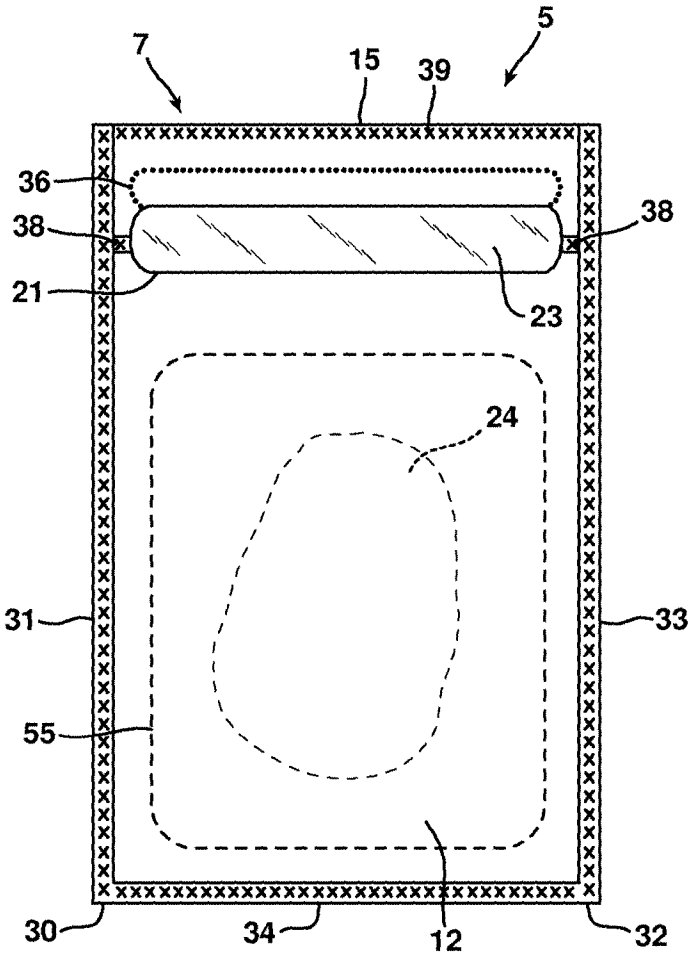
FIGS. 28A, 28B, and 28C are each plan views of an alternative embodiment of the package, showing a sequence for opening the package.
Figure 28A:
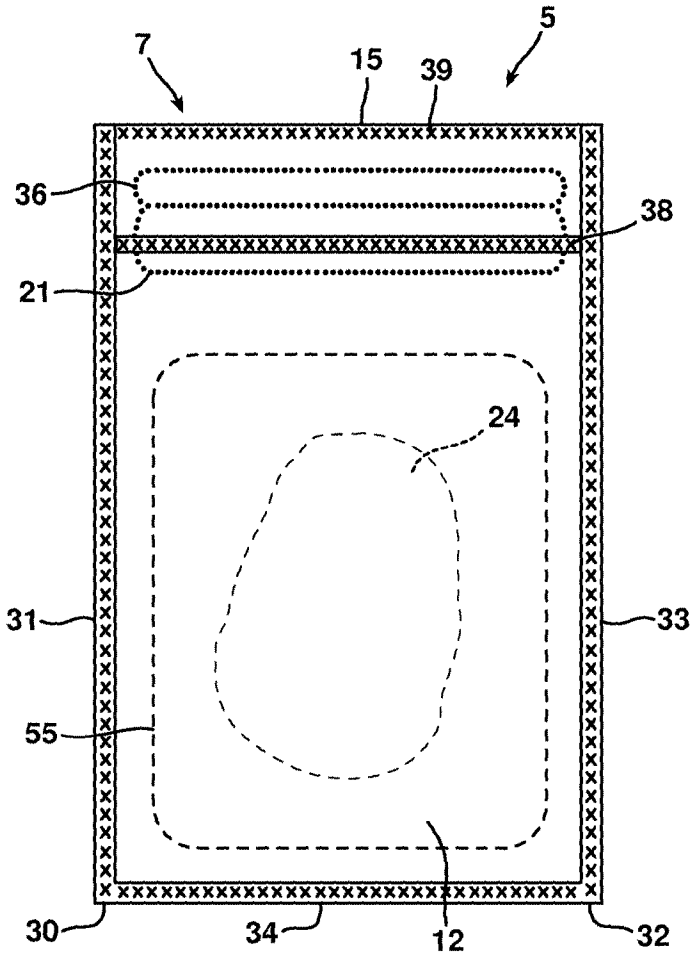
Figure 29:
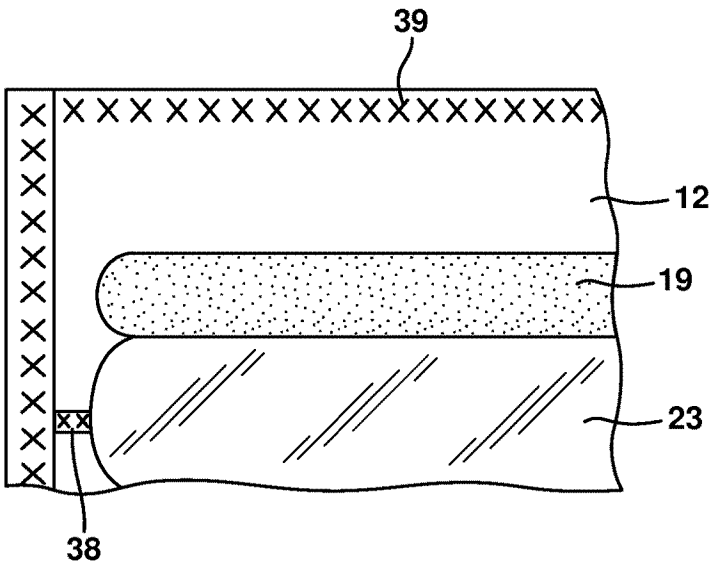
FIG. 29 is an enlarged view of a portion of the package of FIG. 28C.
Figure 28C:
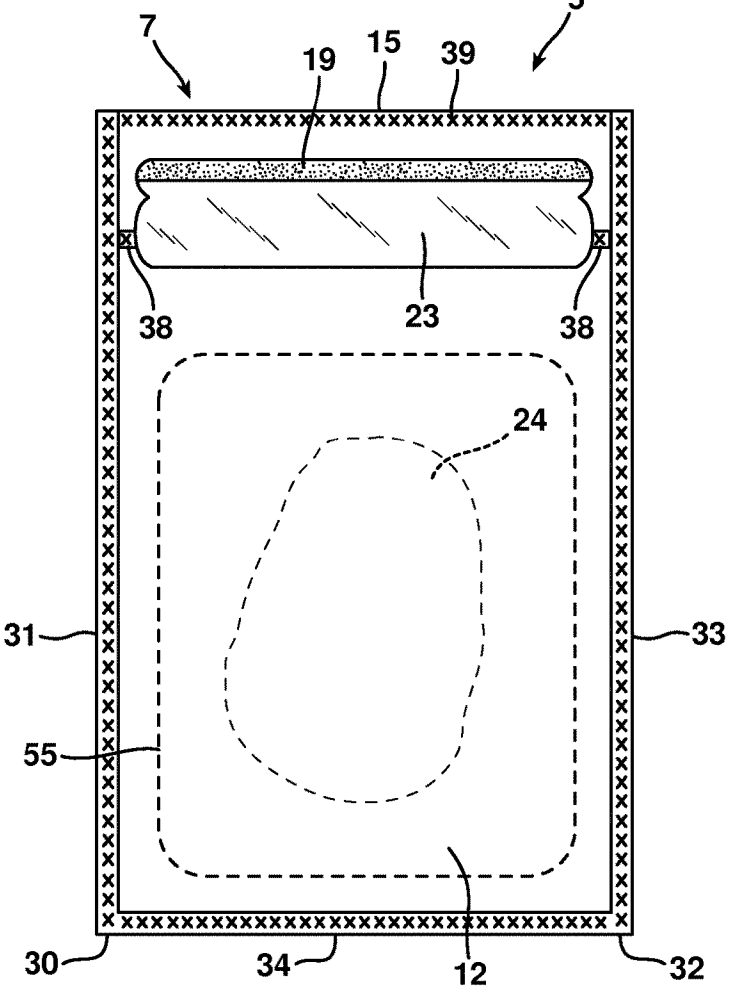
Figure 30A:
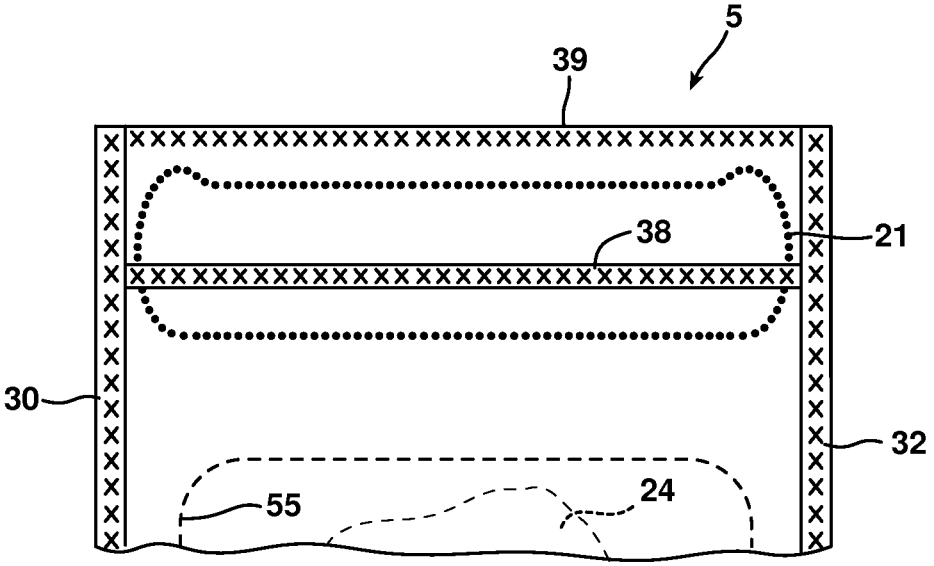
FIGS. 30A, 30B, 30C, and 30D are each a plan view of alternative embodiments.
Figure 30B:
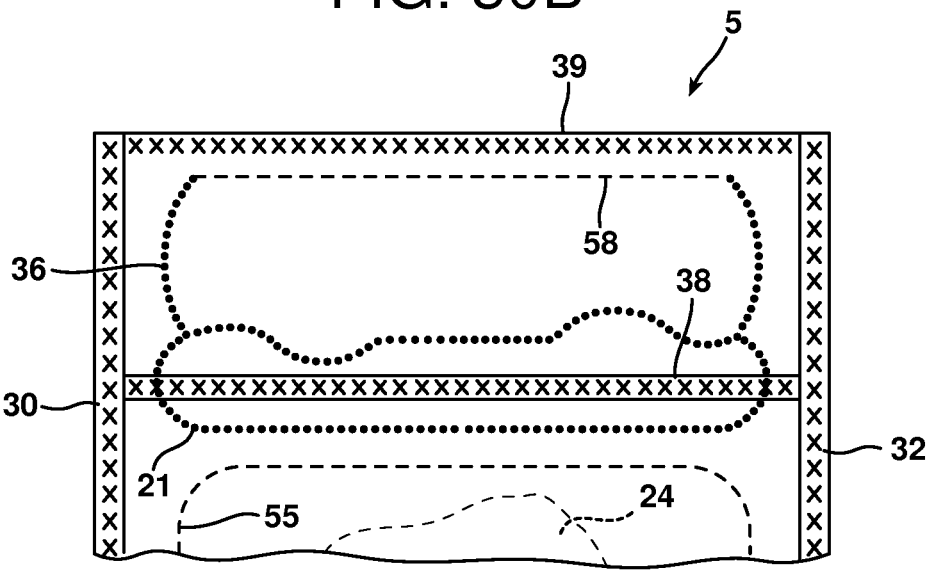
Figure 30C:
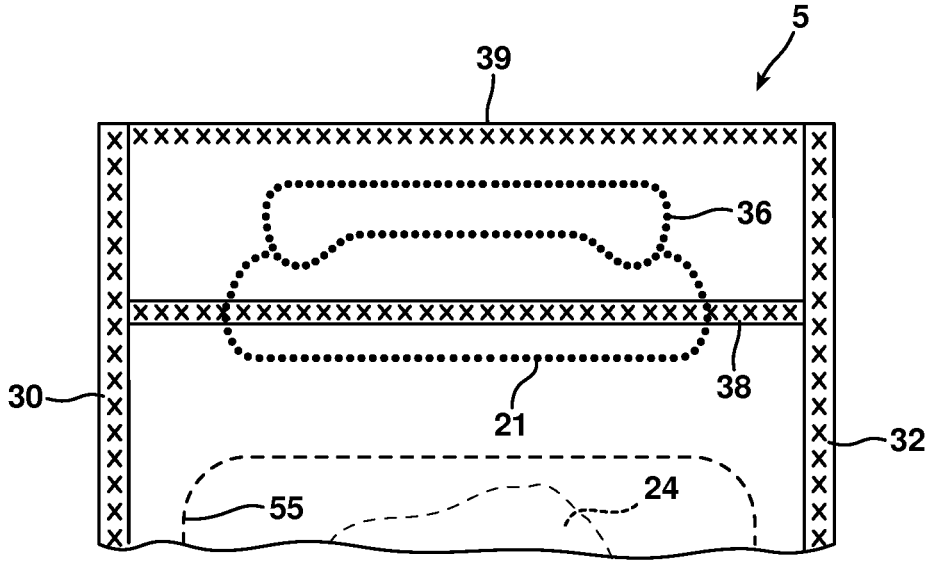
Figure 30D:
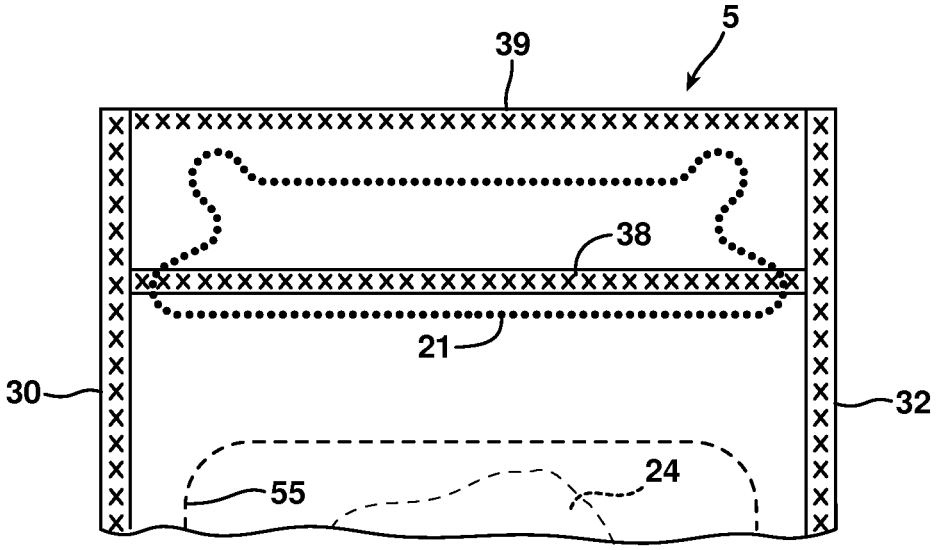

In another embodiment, and referring to FIGS. 25 and 26, the package of the invention can be made using a continuous HFFS process and apparatus such as those used for packaging bakery and other goods, sometimes known as Flow Wrap, Flow-Wrap or Flow wrapping machines or systems, and available from manufacturers/suppliers such as Ilapak, ULMA, and Bosch.

FIG. 25 shows such a process and apparatus 700, but one in which a discrete laminate 724 is installed into a package. Lay-flat web 702 is drawn from roll 704 and advanced to forming device 710. As this occurs, a series of products 706 is advanced along conveyor 708 to forming device 710, and discrete laminate 724 is drawn from roll 726 and advanced to forming device 710. Web 702, with the discrete laminate in some embodiments anchored thereto either before or during forming of the web in the forming device, is formed by forming device 710 into folded web 712. This folded web will be like the folded web described above with respect to VFFS embodiments, but in a substantially horizontal orientation. Folded web 712 wraps around products 706. A longitudinal sealing device that can be part of forming device 710 forms a lap or fin seal (of the type disclosed above with respect to VFFS embodiments) on the folded web, typically at the bottom of the folded web, but can also be embodied as a fin seal along a longitudinal edge of the finished package. The lap or fin seal is typically a heat seal. An alternative is to have a separate sealing device 714 to produce the lap or fin seal. The products travel downstream from forming device 710 or sealing device 714 to transverse sealing device 716 where the folded web is transversely sealed in areas of the folded web between adjacent products. Such seals are typically heat seals. The products are advanced from transverse sealing device 716 to cutting device 718*a* and 718*b*, where the formed and longitudinally and transversely sealed folded web is severed in areas of the folded web between adjacent products, in or near the transverse seals, such that individual packages 720 are produced.

Alternatively, the sealing function of transverse sealing device 716 and the cutting function of cutting device 718*a* and 718*b* can be combined at a single station, rather than being performed at separate locations on the production path.

Web 702 and discrete laminate 724 can be of any suitable dimension and composition, such as those disclosed herein. As discrete laminate 724 is fed to forming device 710, it can be brought into contact with, and optionally anchored to a surface of web 702. This embodiment is shown in FIGS. 25 and 26, where discrete laminate 724 is shown as anchored to web 702 as it progresses toward forming device 710. The panel section, or the second surface of the base strip, can be anchored to web 720. First longitudinal edge 703 of discrete laminate 724 can be seen in FIG. 26. Alternatively, discrete laminate 724 can be fed into forming device 710, and then incorporated into folded web 712 by anchoring the discrete laminate (panel section, second surface of the base strip, or both) to the formed web adjacent to or in the area of the formed web in which the lap or fin seal is made, and in a manner and format analogous to the embodiment of the VFFS pouch and package of FIGS. 10, 17 and 18, but in a horizontal rather than vertical position. In another embodiment, discrete laminate 724 can be pre-applied to web 702 by the supplier of the web, analogous to the embodiment of the VFFS pouch and package of FIG. 13, and the HFFS pouch and process of FIGS. 9A and 9B.

At any time during the method of making the package in a continuous horizontal packaging process, the second surface of the base strip is anchored to the lay-flat web or the formed web. This can be done on the lay-flat web prior to supplying the web to the processor, or prior to or as the lay-flat web is advanced to a forming device, or before or after advancing a product to a forming device.

E. Side Seal Bags

Figure 34:
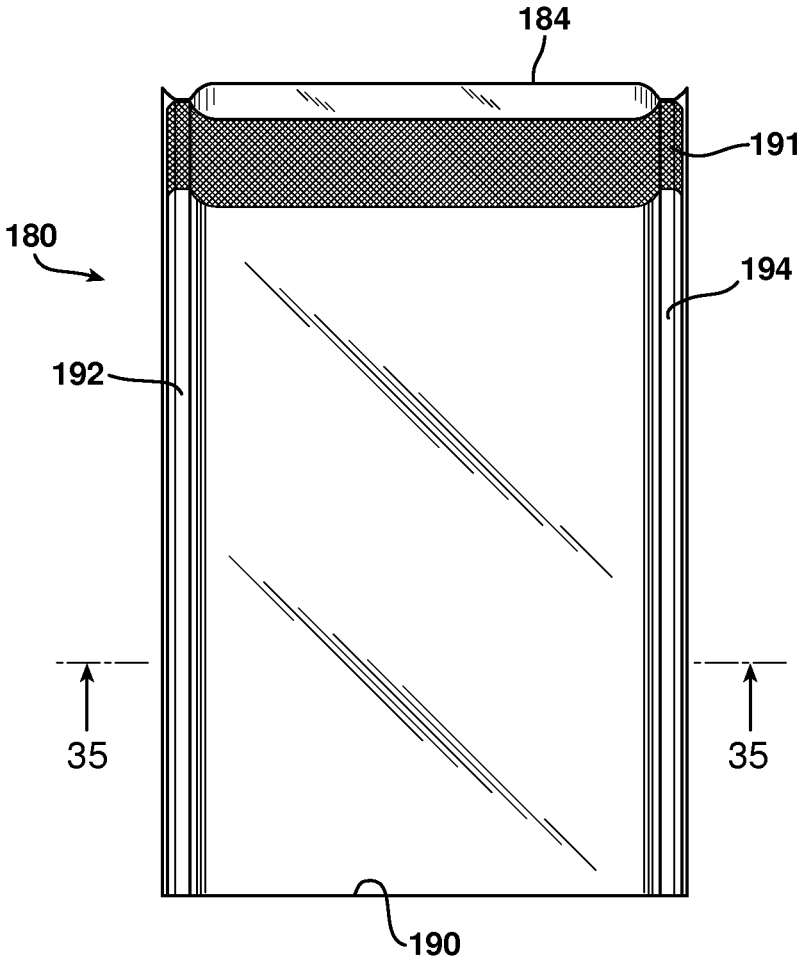
FIG. 34 is a plan view of another embodiment of the invention.
Figure 35:
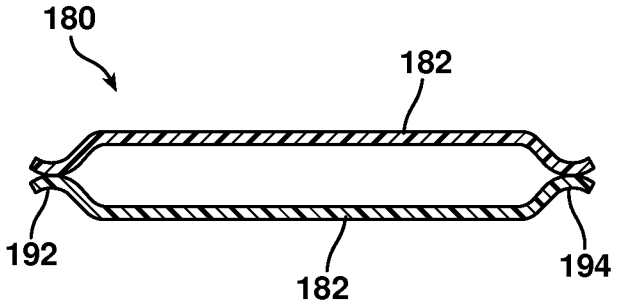
FIG. 35 is a cross sectional view of FIG. 34, viewed along lines 35-35 of FIG. 34.

In one embodiment, and referring to FIGS. 34 and 35, the package of the invention can be made using otherwise conventional bag making equipment and processes. Bags are often made as side seal bags. The side seal bag has a factory-made heat seal at opposite bag edges. The bag bottom is formed by one of two folds of film created during the extrusion of bag tubing during manufacture. The opposite fold of film is slit to form a bag mouth. The bag is typically made from a long length of bag tubing. A method of making side seal bags is disclosed in US 2008/0138478 A1 (Ebner et al.), this patent incorporated herein by reference in its entirety.

FIGS. 34 and 35 illustrate bag 180. FIG. 34 illustrates a side seal bag 180, in a lay-flat view; FIG. 35 illustrates a cross-sectional view taken through section 35-35 of FIG. 34. With reference to FIGS. 34 and 35 together, side seal bag 180 comprises a web 182, first edge 184 defining an open mouth, edge fold 190, first side seal 192, and second side seal 194. Discrete laminate 191 is installed on the individual bag, or on a slit bag tube that is then cut and sealed at predetermined intervals to make a series of side seal bags 180, by any suitable process such as any of those disclosed herein.

A bag can be made by extruding a thermoplastic tube to make a bag tubing; slitting the tubing at one longitudinal edge thereof to make a slit bag tubing; anchoring the discrete laminate as described herein to the slit bag tubing; and transversely cutting and sealing the bag tubing at predetermined intervals to make a plurality of individual bags each with the discrete laminate disposed thereon. The discrete laminate can function as described herein for other embodiments and processes, in providing an easy-open and reclosable package. Some of the steps set out in US 2008/0138478 A1, for making a bag, are optional with respect to the present invention; such steps including irradiation and orientation of the tubing.

The discrete laminate can be anchored to the first side panel of a web, pouch, or package in a number of different configurations. An example is that shown in FIGS. 2A and 2B. Alternatives are shown in FIGS. 36 to 38.

Figure 36:
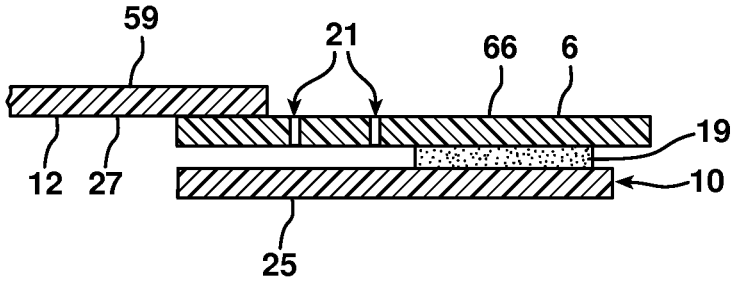
FIG. 36 is a cross sectional view of an alternative embodiment.

FIG. 36 shows the discrete laminate anchored to the first side panel 12 by anchoring a second part of the outer surface 66 of panel section 6 to the inner surface 27 of first side panel 12.

Figure 37:
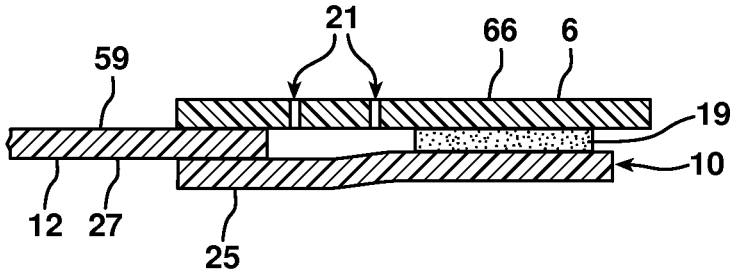
FIG. 37 is a cross sectional view of an alternative embodiment.

FIG. 37 shows the discrete laminate anchored to the first side panel 12 by anchoring a second part of the inner surface 67 of panel section 6 to the outer surface 59 of first side panel 12.

Figure 38:
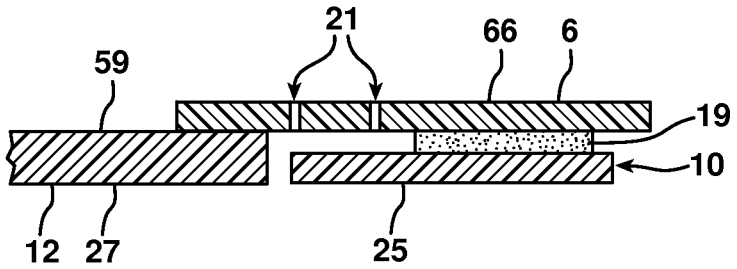
FIG. 38 is a cross sectional view of an alternative embodiment.

FIG. 38 shows the discrete laminate anchored to the first side panel 12 by anchoring a second part of the inner surface 67 of panel section 6 to the outer surface 59 of first side panel 12. FIG. 39 shows the discrete laminate anchored to the first side panel 12 by anchoring a second portion of the second surface of the base strip 10 to the outer surface 59 of first side panel 12.

For each of these alternatives, In the event that the anchor is in the form of a seal, appropriate sealants should be present at surfaces to be anchored by sealing.

Method of Operation

In opening the package of FIGS. 27A to 27E, primary die-cut segment 56 defined by a first closed-loop die cut 21 (see also FIGS. 28A to 28C) is removed (FIG. 27B), and the end of the remaining portion of panel section 6 is manually grasped and pulled away to open the package and access product in the interior 57 of the package (FIG. 270). A secondary die cut segment 156 (see FIG. 27D) defined by secondary die cut 36 is then removed, exposing PSA 19. The package can then be reclosed by folding the first end or top of the package over to bring the PSA into contact with the outside surface of the first side panel 12 (see FIG. 27E). During this opening/reclosing sequence, the anchor in region "A" between second surface 25 of the strip and inner surface 29 of second side panel 14 will typically remain intact, such that a portion of the strip 10 stays on and in contact with surface 29. Here, and in FIGS. 28A through 28C and FIGS. 30B and 30C, more than one die cut is present. The first die cut in some embodiments is close-looped, i.e. the die cut defines a primary die-cut segment that can be displaced or completely removed from the panel section of the package. The secondary die cut can also be closed-loop (see e.g. FIG. 30C), or can be open-loop and hinged such that the flap formed by a second die cut and a hinge line can be opened without removing the flap from the first side panel of the package (see FIG. 30B). Alternatively, a single die cut can be used, that is either close-looped (FIGS. 30A and 30D) or includes a hinge line. Each die cut can be of any suitable geometry and depth. In the area of first die cut region "C" on the panel section of FIGS. 2A and 27A, there is neither a seal nor PSA holding the strip to the inner surface 27. This leaves an area of the package where a portion of the panel section can be relatively easily removed. PSA layer 19 is not initially exposed when the package is opened in each of these embodiments. To reclose the package, a secondary die cut segment is removed to expose the PSA. A portion of the second side panel can be folded over to allow the PSA to contact the first side panel. Alternatively, removal of a single or primary die cut segment can expose the PSA as well as provide an opening for accessing product in the package. The package can be opened and reclosed several times.

Method of Applying a PSA Layer to a Base Strip

Figure 31:
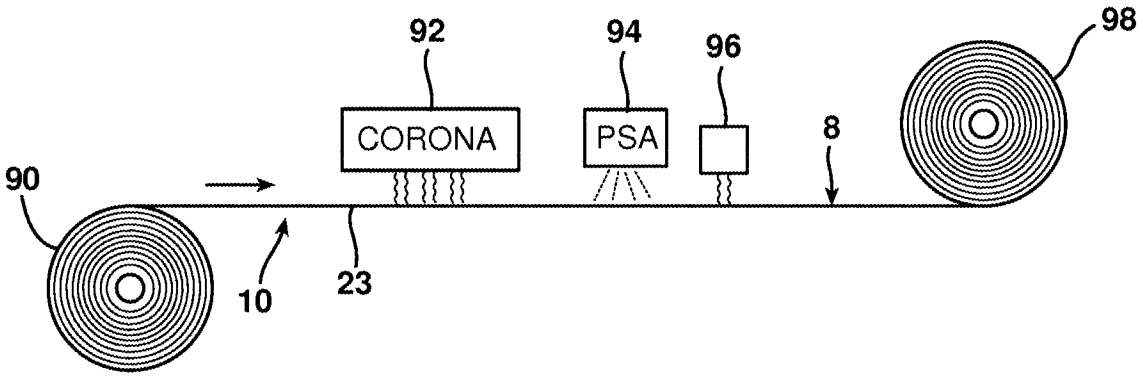
FIG. 31 is an apparatus and process for making a tape.

FIG. 31 shows a method of applying a PSA layer to a base strip to make a tape, comprising the following steps:

1) advancing base strip 10 by suitable motive means (not shown, and well known in the art, such as a motor) from roll 90.

2) Optionally, corona treating surface 23 using a conventional corona treater 92 in preparation for the application of a PSA to the treated surface. The PSA may adhere to strip 10 without corona treatment. However, in this embodiment, depending on the materials chosen, the PSA may, upon opening of a package, exhibit cohesive failure, or alternating adhesive failure, i.e. some of the PSA may adhere to strip 10, and some to surface 67.

3) applying a coating of PSA 19 to substantially the entire surface 23 of strip 10. A conventional PSA applicator 94 is shown applying PSA to now corona treated surface 23. As an alternative, a release liner such as a silicone-coated liner can be coated with PSA, and the PSA-coated liner is then laminated to corona treated strip 10. When the liner is removed, the PSA remains with the strip 10. The PSA can be of any suitable composition and thickness. The thickness of the coating of PSA may vary from one portion of the coated surface to another. This is acceptable as long as the finished package functions in its intended way with respect to its reclosability.

4) providing, in a selected portion of surface 23, a clear area.

5) curing the coating of PSA. Curing can be accomplished by any suitable process, taking into account the type of PSA being used, including hot air drying by a conventional hot air dryer 96.

6) advancing resulting tape 8 to take-up roll 98.

Method of Making a Die Cut in a Web

A conventional die cutter can be used to create a first die cut 21, and optionally one or more additional die cuts 36 in a web that is used to make panel section 6. Die cuts can be made by any suitable conventional process and equipment. Any suitable pattern of die cut can be used, open or closed-looped, as long as it serves the function of providing an easy open package in which the packaged product can be accessed by means of a die cut segment created at least in part by the die cut. Alternative patterns include elliptical, oval, triangular, three side rectangle, hour glass, "dog bone", and other regular and irregular shapes.

The die cut extends completely through the panel section, or may extend through most of, but not entirely through, the thickness of the panel section. The die cut may extend through e.g. at least 50% of the thickness of panel section 6, e.g. at least 60%, at least 70%, at least 80%, at least 90%, at least 95%, or 100% of the thickness of the panel section.

A laser system can be configured to produce a laser cut that cuts partly or completely through the panel section, or alternatively, a die cut can be made using a mechanical cutting system using rotary engraved dies, or steel rule dies supported in platens as used in reciprocating presses. The choice of die cutting technique depends on several factors, including the thickness and physical nature of the film or web to be cut.

The die cut may sometimes act as a tamper evident feature.

The application of PSA to the base strip to make a tape, the die cutting of a web used to produce a panel section, the assembling of the discrete laminate from the tape and panel section, and the assembling of a package incorporated a die cut panel section and a PSA coated strip, can be done at a single location, but more practically will typically be done at one or more separate locations, with the assembling of the package by a packager using pre-provided discrete laminate prepared elsewhere and provided in advance of the packaging process.

Method of Applying a Panel Section to a Tape to Make a Discrete Laminate

Figure 24:
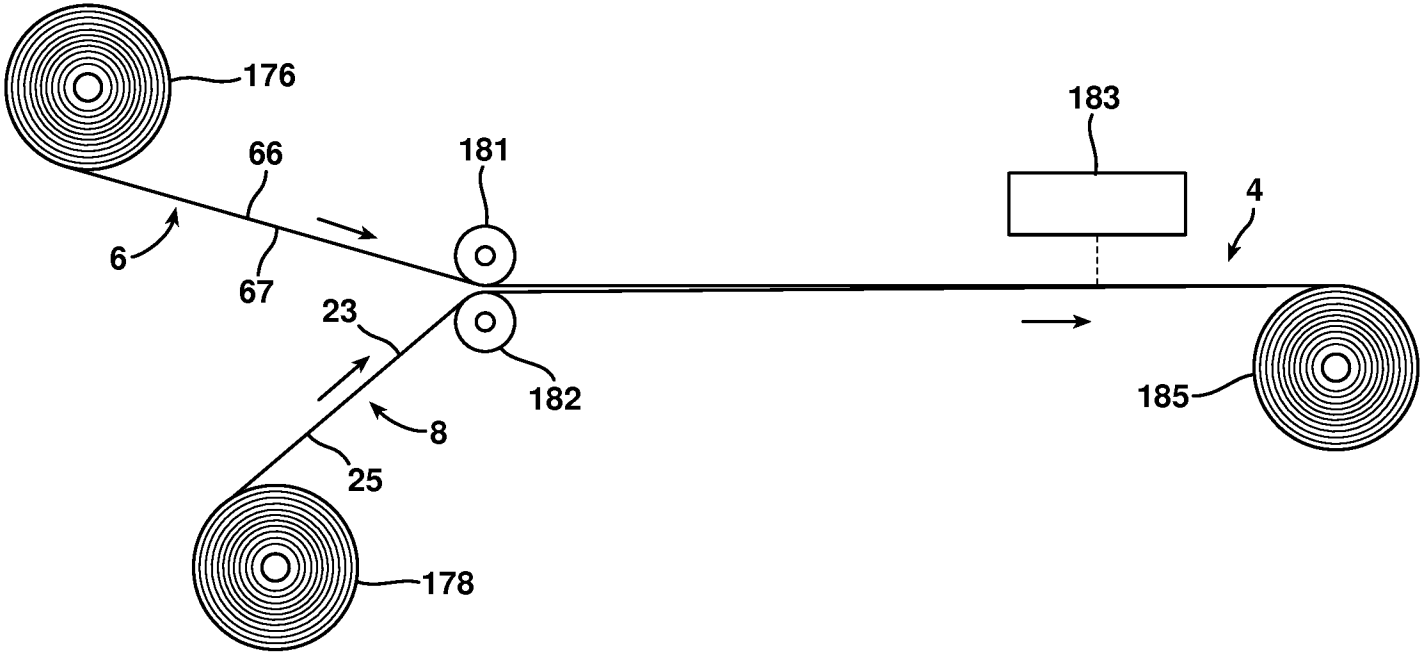
FIG. 24 is a schematic view of an apparatus and process for making a discrete laminate.

FIG. 24 shows a method of applying a panel section to a tape to make a discrete laminate, comprising the following steps:

1) advancing tape 8 including base strip 10 and PSA layer 19 by suitable motive means (not shown, and well known in the art, such as a motor) from roll 178.

2) advancing panel section 6 from roll 176.

3) bringing tape 8 and panel section 6 together at nip rolls 181,182, such that the PSA adheres the tape to the panel section.

4) installing a series of die cuts in panel section at die cutter 183.

5) advancing resulting discrete laminate 4 to take-up roll 185.

The panel section could be die-cut in advance of this process. Also, a seal could optionally be used to attach the tape to the panel section.

Method of Application of the Discrete Laminate to a Web

The discrete laminate can be applied to a web such as a lay-flat web in a number of ways.

In one embodiment, the discrete laminate can be completely assembled, either at the package facility where it will be used to make packages, or at a supplier or converter location. The discrete laminate can then be adhered or anchored to a web as disclosed herein. Anchoring in this embodiment is accomplished by anchoring the panel section of the discrete laminate to a surface of the web, or by anchoring the second surface of the base strip of the discrete laminate to a surface of the web.

In another embodiment, the panel section and base strip are not brought together initially, and the panel section is anchored to one surface of a web, and the tape is separately anchored to an opposite surface of the web, so that the PSA on the base strip adheres to an inner surface of the panel section. Attachment of the panel section and tape to the web can be done simultaneously, or sequentially with attachment of the panel section either before or after attachment of the tape. In this embodiment, the panel section and tape can be congruent, although they do not have to be. As an example, with reference to FIG. 12, in an alternative embodiment, 54 can refer to the panel section 6 only, and a separate roll can feed a tape 8 onto the opposite longitudinal edge 62 of the web, and anchored thereto so that the PSA is exposed, such that when the web is folded as described herein, the PSA adheres to panel section 6. Anchoring of panel section 6 and tape 8 to web 41 can be done at any suitable time in the manufacturing sequence.

In yet another alternative, one of the panel section 6 and tape 8 can be anchored to web 41 as shown in FIG. 12, and the other of the panel section 6 and tape 8 can be pre-anchored to web 41 at the same or a different location on the web by the supplier of the web prior to the packaging method disclosed herein.

These same alternatives can be applied mutatis mutandis to the alternative processes (VFFS, lidstock/formed web, continuous horizontal packaging/side seal bag making) disclosed herein.

PACKAGE EXAMPLES

Example 1

A package is made in accordance with the embodiment illustrated in FIG. 2B and described herein, in a horizontal form/fill/seal system; except that the die cut configuration is like that of FIGS. 27A to 27D. First and second side panels 12 and 14 respectively each comprises T7225B, and panel section 6 comprises H7530B, a laminate having the construction:

| | | |
|---|---|---|
| chemically treated PET | polyurethane adhesive | coextruded barrier film |

where the PET is a biaxially oriented polyester film, and the coextruded barrier film has the construction:

| Layer 1 | Layer 2 | Layer 3 | Layer 4 | Layer 5 | Layer 6 | Layer 7 |
|---|---|---|---|---|---|---|
| PE2 | EV1 | AD3 | OB1 | AD3 | EV1 | 76% PE3 + 20% PE4 + 4% AB1 |
| 0.63 | 0.33 | 0.19 | 0.23 | 0.19 | 0.33 | 0.63 |

The overall thickness of the coextruded barrier film is about 2.50 mils. Layer gauges in mils for each layer are indicated below each layer. Layer 7 is the layer of the barrier film adhered, by the adhesive, to the PET film. Layer 1 is the heat sealant layer of the film, and the EAO (PE2) of layer 1 forms the inner or sealant surface of the panel section, facing the contained product, and the PET forms the outer or skin surface of the panel section. The thickness of the PET film is about 0.48 mils. The overall thickness of the laminate is about 3.0 mils.

Alternatives to the composition of layer 7 include various combinations of materials, including:

–96% PE3+4% AB1.

100% PE3.

76% PE3+20% PE8+4% AB1.

The base strip 10 of the tape is an extrusion laminated film that has the construction:

| Layer 1 | Layer 2 | Layer 3 | Layer 4 | Layer 5 |
|---|---|---|---|---|
| 85% PE6 + 15% PE7 | EM1 | PET2 | EM1 | PE7 |
| 0.75 | 0.25 | 1.50 | 0.25 | 0.75 |

The overall thickness of the base strip is about 3.5 mils. Layer gauges in mils for each layer are indicated below each layer. Layer 5 is the layer of the base strip to which the PSA is pattern coated. Layer 1 is the layer of the base strip facing the interior of the package.

Before the package is made, a PSA (acResin® A 204 UV) carrying 15% tackifier (FORAL® 85 synthetic resin) by weight of the total PSA/tackifier composition is pattern coated on a first portion of layer 5 of the base strip, the PSA/tackifier composition is UV-cured, and the resulting tape adhered by the PSA to the H7530B panel section (specifically, to layer 1 of the coextruded barrier film of the H7530B laminate) while the latter is in a lay-flat condition. A closed loop die cut is made in the panel section by a $CO_2$ laser prior to applying the tape to the panel section; the die cut defining a die cut segment that is positioned so as to result in the package as shown in FIG. 2B, but with the die cut configuration of FIGS. 27A to 27D. The discrete laminate 4 made up of the base strip 10, PSA layer 19, and panel section 6 is then anchored to the web making up the first and second side panel, and specifically anchored to a portion of the web that will constitute the first side panel.

Example 2

A package like that of package example 1 is made, but in which 25% tackifier is used in the PSA/tackifier composition.

Example 3

A package like that of Example 1 is made, but in which the coextruded barrier film of the panel section, is a nine-layer film with a composition very similar to the seven layer film construction of Example 1, but having an additional intermediate layer of EV1, and an additional intermediate layer of a LDPE or a blend including LLDPE.

Example 4

A package like that of Example 2 is made, but in which the coextruded barrier film of the panel section, is a nine-layer film with a composition very similar to the seven layer film construction of Example 1, but having an additional intermediate layer of EV1, and an additional intermediate layer of a LDPE or a blend including LLDPE.

The above descriptions are those of embodiments of the invention. All parts and percentages are by weight, unless otherwise indicated or well understood in the art. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. All references to ASTM tests are to the most recent, currently approved, and published version of the ASTM test identified, as of the priority filing date of this application. Each such published ASTM test method is incorporated herein in its entirety by reference.

Terms referring to polymers, such as polyester, polyamide, and polyolefin, refer herein to both homopolymers and copolymers thereof, unless otherwise specified.

With reference to the drawings, the flow of materials is in the direction of the arrows.

Those of skill in the art will recognize that the drawings herein are not necessarily to scale, and certain features of the invention may be graphically exaggerated for clarity.

Both the web or webs used in the manufacture of the package according to the invention, and the strip and tape of the discrete laminate of the invention, can be made by any suitable process, including coextrusion, extrusion coating, extrusion lamination, and conventional lamination using polyurethane or other adhesives. These manufacturing processes are well known in the art. Extrusion can be done in annular or flat dies. The extrudate can be hot blown or cast, and optionally solid-state oriented as desired. Chemical or electronic crosslinking of one or more layers of the webs or the strip can be done. Both web and discrete laminate can be advanced by suitable motive means (not shown, and well known in the art, such as a motor) from their respective rolls.

A package according to the invention can optionally carry printed indicia, which can be decorative or informational in nature. Decorative printed indicia can include a logo, a trademark, product information, etc. with text and/or graphics.

Printed indicia can be in the form of a message e.g. "easy open" or "open here". This can be printed in scattered process (i.e. registration is not required) on or near the first end of the package. The message is surface printed or reverse printed.

In the embodiments disclosed herein, the first end of the package can be sealed, typically where two webs are used to make the package. Alternatively, the first end of the package can be a fold, e.g. where a single web of material is used to make the package.

The present invention, including the package and methods as disclosed herein, is provided in several embodiments in the absence of: plastic zipper closures; press-to-close or slide zippers; interlocking closures; reclosable fasteners with interlockable fastener elements; interlocking rib and groove elements having male and female profiles; interlocking alternating hook-shaped closure members, and the like. The package of the invention is provided herein in several embodiments in the absence of a discrete release liner for a PSA layer or coating. None of these aforementioned closures, zippers, elements, etc. is present in the package of the invention.

Although the invention is described in some embodiments herein as a package comprising a pouch comprising a first and second side panel each having a top edge, a first side edge, and a second side edge, those skilled in the art will understand, after a review of this disclosure, that in some embodiments, wherein a single web is used, the terms "side panel", "top edge", "first side edge", "second side edge", and the like are used for convenience to describe the relative locations or regions on a single web made into a pouch, so that the overall geometry of the package, and relative positions of the various features of the invention can be described. Thus, for instance, the first and second panels in a single web embodiment of the invention can be simply defined regions of the pouch, and the package made therefrom, and side edges are simply the side end lines of those regions. In such embodiments, the line of joinder of the side edges are the two side folds in the web that define the sides of the package. In contrast, in embodiments with two webs, each web when produced will have an identifiable first and second side edge, that will each be joined to a respective side edge of a second web.

Although the first and second side panels are shown in various embodiments as having the same length, the second side panel can be longer than the first side panel, i.e. extend beyond the first end of the first side panel. The extended portion can accommodate a hang tab with a hole therein.

In some embodiments, a seal can be applied obliquely across the two corners of the panel section of a package of the invention, closest to the first end of the package, such that it crosses over and seals two corners of the discrete tape to the panel section. These angled seals can be useful in facilitating the reclosure of the package after opening, and/or in assuring the integrity of the package before initial opening. An example is shown in FIGS. 29A and 29G, where seals 751 are positioned obliquely with respect to the first end and sides of the package. The seal overlaps a portion of the die cut 21 at upper edges of the die cut. Optionally, the die cut can be discontinuous in the regions of the die cut where the angled seals 751 are present.

In some embodiments, a die cut can be installed on the second side panel near its first end, or the region of a lay-flat web or folded web that will form the second side panel, that can act as a fold line for facilitating reclosure of the package. This die cut, which can be a score, can be of any suitable geometry, e.g. a straight line, positioned to ease or direct the folding of the second side panel to reclose the package after opening.

Those skilled in the art will appreciate that in describing a panel, strip or the like being "sealed" to another panel, strip, or the like, sealing is done by conventional means as described, and typically occurs in seal widths consistent with industry practice for packaging.

Packages of the various embodiments of the invention disclosed herein can optionally be vacuumized or gas flushed by otherwise conventional means. A package in accordance with the invention can contain a modified atmosphere.

What is claimed is:

1. An easy-open and reclosable hermetic package comprising:

a) a pouch comprising i) a first and second side panel each comprising an outer and inner surface, a first and second side edge, and a first and second end, the first and second side panels joined together along their respective first and second side edges with a seal;

ii) a first end;

iii) a second end defined by the second ends of the first and second side panels respectively; and iv) a discrete laminate having a first and second end, the discrete laminate comprising (a) a tape comprising (i) a base strip comprising a first and second surface, a first and second side edge, and a first and second end, at least one of the first and second surfaces of the base strip comprising a sealant, and (ii) a pressure sensitive adhesive coated on at least a first portion of the first surface of the base strip, (b) a panel section comprising an outer and inner surface, a first and second side edge, a first and second end, and a die cut; wherein the at least first portion of the first surface of the base strip is adhered by the pressure sensitive adhesive to a first part of the inner surface of the panel section, the panel section is anchored to the first side panel, and the second surface of the base strip is anchored to the inner surface of the second side panel, the first end of the panel section is joined to the second side panel, the panel section and the second side panel are joined together along their respective first and second side edges with a seal, and the die cut defines a primary die cut segment, wherein a first portion of the primary die cut segment is underlain by the pressure sensitive adhesive, and a second portion of the primary die cut segment is underlain by a clear area, the primary die cut segment so arranged with respect to the base strip that when the package is opened, by removing the primary die cut segment, at least a portion of the pressure sensitive adhesive is exposed, and the package can thereafter be reclosed by adhering the pressure sensitive adhesive to the first side panel; and wherein the discrete laminate is anchored to the first side panel; and b) a product disposed in the pouch.

2. The easy-open and reclosable package of claim 1 wherein the first surface of the base strip comprises an easy-open sealant.

3. The easy-open and reclosable package of claim 1 wherein a second part of the outer surface of the panel section is anchored to the inner surface of the first side panel.

4. The easy-open and reclosable package of claim 1 wherein a second part of the inner surface of the panel section is anchored to the outer surface of the first side panel.

5. The easy-open and reclosable package of claim 1 wherein the primary die cut segment is spaced apart from a first and second side seal respectively.

6. The easy-open and reclosable package of claim 1 wherein a secondary die cut segment is disposed between the primary die cut segment and an end of the package, and is underlain at least in part by the pressure sensitive adhesive, the secondary die cut segment so arranged with respect to the base strip that when the secondary die cut segment is displaced or removed, at least a portion of the pressure sensitive adhesive is exposed.

* * * * *